US007207458B1

(12) United States Patent
Koefelda et al.

(10) Patent No.: US 7,207,458 B1
(45) Date of Patent: Apr. 24, 2007

(54) LOW-DEPTH NESTABLE TRAY FOR FLUID CONTAINERS

(75) Inventors: Gerald R. Koefelda, Rowlett, TX (US); William P. Apps, Alpharetta, GA (US); Gabriel A. Guerra, Lawrenceville, GA (US); Brian T. Musser, Nottingham, NH (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 10/019,519

(22) PCT Filed: Jun. 30, 2000

(86) PCT No.: PCT/US00/18235

§ 371 (c)(1),
(2), (4) Date: Mar. 22, 2002

(87) PCT Pub. No.: WO01/02261

PCT Pub. Date: Jan. 11, 2001

Related U.S. Application Data

(60) Provisional application No. 60/142,240, filed on Jul. 2, 1999.

(51) Int. Cl.
*B65D 1/34* (2006.01)

(52) U.S. Cl. ..... 220/519

(58) Field of Classification Search ..... None
See application file for complete search history.

(56) References Cited

U.S. PATENT DOCUMENTS

| | | | |
|---|---|---|---|
| 820,445 | A | 5/1906 | Speer |
| 1,678,008 | A | 7/1928 | Jackson |
| D103,862 | S | 3/1937 | Randall et al. |
| 2,411,673 | A | 11/1946 | Vechey, Jr. |
| D147,981 | S | 11/1947 | Lehman |
| D152,907 | S | 3/1949 | Richards |
| 2,512,855 | A | 6/1950 | Erickson |
| 2,526,335 | A | 10/1950 | Deichert |
| 2,530,481 | A | 11/1950 | Rawn, Jr. |
| 2,535,493 | A | 12/1950 | Gerber |
| 2,588,805 | A | 3/1952 | Cross |
| 2,626,079 | A | 1/1953 | Keller |
| D172,664 | S | 7/1954 | Emery |

(Continued)

FOREIGN PATENT DOCUMENTS

| | | |
|---|---|---|
| BE | 680197 | 10/1966 |

(Continued)

OTHER PUBLICATIONS

Exhibit 1: Four photos of a prior art case of Rehrig Pacific Company, Model No. PLBC-8-2L-PET-QD (1984).

(Continued)

*Primary Examiner*—Stephen Castellano

(57) ABSTRACT

A low depth tray (100) for fluid containers, such as bottles B, includes a base (102) and a first pair of opposed walls (104, 106) extending upwardly from the base (102). The tray (100) further includes a second pair of opposed walls (108, 110) extending upwardly from the base (102) and integrally joined with the first pair of opposed walls (104, 106) to form a storage area. Each of the second pair of opposed walls (108, 110) includes an upper wall portion (112) and a lower wall portion (114), the upper wall portion (112) first areas (116) having a single-walled construction and second areas (118) for contacting the fluid containers B. When nested with a similar tray, the lower wall portion (114) of an upper tray (100) nests within the corresponding first areas (116) of a tray (100) disposed therebelow.

29 Claims, 56 Drawing Sheets

U.S. PATENT DOCUMENTS 2,743,030 A 4/1956 Reed, Jr.
2,840,256 A 6/1958 Cobb, Jr.
2,928,530 A 3/1960 Sauey
2,935,222 A 5/1960 O'Connell
2,970,715 A 2/1961 Kappel et al.
D189,891 S 3/1961 Schilling
2,979,222 A 4/1961 Levine
3,009,579 A 11/1961 Ettlinger, Jr.
3,055,531 A 9/1962 Chelbor
3,055,542 A 9/1962 Russo
3,092,284 A 6/1963 Stout
D195,702 S 7/1963 Russo
3,148,797 A 9/1964 Cloyd
3,151,762 A 10/1964 Videl
3,155,268 A 11/1964 Fogerty et al.
3,184,148 A 5/1965 Poupitch
D201,257 S 6/1965 Vidal
3,247,996 A 4/1966 Garcia
3,283,947 A 11/1966 Cornelius
3,297,190 A 1/1967 Cloyd
D208,111 S 7/1967 Vidal
3,332,574 A 7/1967 Earp
3,333,727 A 8/1967 Belcher et al.
3,333,729 A 8/1967 Rabb
3,334,767 A 8/1967 Cornelius et al.
3,349,943 A 10/1967 Box
D209,864 S 1/1968 Versteeg
3,376,998 A 4/1968 Cornelius
3,384,261 A 5/1968 Austin
3,390,801 A 7/1968 Adomat
3,391,814 A 7/1968 Box
3,391,815 A 7/1968 Box
3,392,869 A 7/1968 Needt
3,416,694 A 12/1968 Bebb
3,428,207 A 2/1969 Schoeller
3,517,852 A 6/1970 Schoeller
3,638,824 A 2/1972 Sekiguchi et al.
3,701,449 A 10/1972 Schoeller
3,759,416 A 9/1973 Constantine
D229,674 S 12/1973 Quigg
3,812,996 A 5/1974 Bunnell
3,865,239 A 2/1975 Herolzer et al.
3,949,876 A 4/1976 Bridges et al.
3,998,327 A 12/1976 Box
4,027,796 A 6/1977 Martin
4,037,722 A 7/1977 Bremer
4,040,517 A 8/1977 Torokvei
4,071,162 A 1/1978 Steinlein et al.
4,095,720 A 6/1978 Delbrouck et al.
4,101,049 A 7/1978 Wallace et al.
4,161,259 A 7/1979 Palafox
4,162,738 A 7/1979 Wright
4,202,448 A 5/1980 Jaeger et al.
4,204,596 A 5/1980 Davis
4,316,540 A 2/1982 Lapham
4,319,685 A 3/1982 David
4,344,530 A 8/1982 deLarosiere
D266,709 S 10/1982 Box
4,410,099 A 10/1983 deLarosiere
4,416,373 A 11/1983 deLarosiere
D275,142 S 8/1984 Torokvei
4,538,742 A 9/1985 Prodel
4,548,320 A 10/1985 Box
D283,103 S 3/1986 Chusing et al.
D284,841 S 7/1986 Rowland et al.
D289,938 S 5/1987 Warwick
D291,178 S 8/1987 Toms
4,700,836 A 10/1987 Hammett
4,700,837 A 10/1987 Hammett
D295,107 S 4/1988 Frost
4,773,554 A 9/1988 Warwick
4,789,063 A 12/1988 Hammett
4,848,580 A 7/1989 Wise
D304,123 S 10/1989 Warwick
4,899,874 A 2/1990 Apps et al.
4,911,303 A 3/1990 Andersson
4,928,841 A 5/1990 Arthurs
4,932,532 A 6/1990 Apps et al.
4,978,002 A 12/1990 Apps et al.
D313,493 S 1/1991 Apps et al.
D317,670 S 6/1991 Apps
D318,552 S 7/1991 Apps
5,031,774 A 7/1991 Morris et al.
D319,129 S 8/1991 Apps et al.
D320,298 S 9/1991 Apps et al.
5,060,819 A 10/1991 Apps
5,071,026 A 12/1991 Apps
5,096,085 A 3/1992 Eek et al.
D325,279 S 4/1992 Apps
5,105,948 A 4/1992 Morris et al.
D326,749 S 6/1992 Apps et al.
D327,357 S 6/1992 Rehrig
D327,972 S 7/1992 Apps et al.
D329,931 S 9/1992 Apps
D329,932 S 9/1992 Apps
5,184,748 A 2/1993 Apps
5,199,571 A 4/1993 Wolff et al.
5,305,884 A 4/1994 Apps et al.
5,316,172 A 5/1994 Apps et al.
5,335,814 A 8/1994 Hepp
D350,438 S 9/1994 Apps et al.
5,421,477 A 6/1995 Hammett
D360,758 S 8/1995 Umiker
D361,431 S 8/1995 Koefelda
5,465,843 A 11/1995 Koefelda
5,487,487 A 1/1996 Hammett
5,501,352 A 3/1996 Apps
5,529,176 A 6/1996 Apps et al.
D371,239 S * 7/1996 Kelly ..... D3/318
D378,249 S 3/1997 Apps et al.
D379,121 S 5/1997 Apps et al.
D379,717 S 6/1997 Apps et al.
D380,613 S 7/1997 Apps et al.
D380,901 S 7/1997 Apps et al.
5,651,461 A 7/1997 Apps et al.
5,660,279 A 8/1997 Apps et al.
5,704,482 A 1/1998 Apps et al.
D399,060 S 10/1998 Apps et al.
D399,061 S 10/1998 Apps et al.
D400,012 S 10/1998 Apps
5,823,376 A 10/1998 McGrath
5,842,572 A 12/1998 Apps et al.
D404,204 S 1/1999 Apps
5,855,277 A 1/1999 Apps et al.
D410,778 S 6/1999 Apps et al.
D412,399 S 8/1999 Apps et al.
5,964,343 A 10/1999 Steiner
5,979,654 A 11/1999 Apps
5,992,673 A 11/1999 Hwang
D417,784 S 12/1999 Umiker
6,006,912 A 12/1999 McGrath
D420,220 S 2/2000 Apps et al.
6,047,844 A 4/2000 McGrath
6,073,793 A 6/2000 Apps et al.
6,079,554 A 6/2000 Hammett et al.
6,749,065 B1 6/2004 Hammett
2001/0015329 A1 8/2001 Apps et al.

FOREIGN PATENT DOCUMENTS

BE 693216 7/1967
CA 965056 3/1975
CA 1109433 9/1981
DE 1207268 12/1965

| | | |
|---|---|---|
| EP | 0 099 827 | 10/1986 |
| EP | 0 210 712 | 8/1990 |
| EP | 1 008 527 A1 | 6/2000 |
| FR | 1285689 | 1/1962 |
| FR | 1350962 | 12/1963 |
| FR | 1351218 | 12/1963 |
| FR | 1518610 | 2/1968 |
| FR | 2302244 | 9/1976 |
| GB | 943947 | 12/1963 |
| GB | 1032916 | 6/1966 |
| GB | 1115343 | 5/1968 |
| GB | 1120067 | 7/1968 |
| GB | 1152038 | 5/1969 |
| GB | 1312701 | 4/1973 |
| GB | 1319726 | 6/1973 |
| GB | 1330778 | 9/1973 |
| GB | 2 079 256 A | 1/1982 |
| GB | 2 135 278 A | 8/1984 |
| GB | 2158044 A | 11/1985 |
| NE | 6505562 | 10/1966 |
| WO | WO 82/01536 | 5/1982 |
| WO | WO 98/07636 | 2/1998 |
| WO | WO 00/41937 | 7/2000 |

OTHER PUBLICATIONS

Exhibit 2: Two photos of a prior art case of Rehrig Pacific Company for 3 liter PET bottles (1990).

Exhibit 3: Two photos of a prior art case of D.W. Plastics, date unknown.

Exhibit 4: Two photos of a prior art case of International Container Systems, Inc. for 3 liter PET bottles, date unknown.

* cited by examiner

LOW-DEPTH NESTABLE TRAY FOR FLUID CONTAINERS

CROSS-REFERENCE TO RELATED APPLICATION

This application is the U.S. national phase of PCT application number PCT/US00/18235, filed Jun. 30, 2000, which further claims the benefit of U.S. provisional application Ser. No. 60/142,240, filed Jul. 2, 1999.

TECHNICAL FIELD

This invention relates to a low depth nestable tray for use in transporting, storing, and displaying fluid containers, such as bottles.

BACKGROUND ART

Bottles, particularly for soft drinks and other beverages, are often stored and transported in trays. The term "tray" as used herein includes trays, crates, cases, and similar containers having a floor and a peripheral side wall structure. As compared with other materials, plastic trays provide advantages such as strength, durability, and reusability. In order to minimize the storage space of trays as well as to reduce their cost and weight, many trays are constructed to have shallow side and end walls. Such trays are generally referred to as "low depth" trays in which the side and end walls are lower than the height of the stored bottles.

In general, bottles go through a bottling facility and to the bottler's warehouse in the following order: the bottles are filled, sealed, loaded into trays, and then the trays are palletized. A pallet may include multiple layers of trays of a single product, such as soft drinks of the same flavor. Trays in successive layers are stacked or cross-stacked on top of each other, with the bottles bearing most of the load of above-stacked trays. These bulk pallets are stored in a warehouse for shipping to retailers.

In the soft drink industry, there are two methods by which products are shipped to retailers: bulk delivery and route delivery. Bulk delivery is by the pallet, and is typically used for large retailers. Since each pallet contains only trays of a single flavor, retailers must order multiple pallets to ensure that they stock a mixture of products appropriate to meet demand, and must have sufficient space to accommodate all of these pallets. Due the space and sales volume requirements of bulk delivery, the majority of shipments of soft drinks to smaller retailers is done by the route delivery method. These retailers are generally low volume sellers and have less space for storing and merchandising product. Since route delivery retailers cannot accept entire pallets of one product, they receive a mixture of product in a smaller shipment. For the bottlers or distributors, this means that route delivery orders must be processed by breaking down bulk pallets of product and forming delivery pallets which contain a sorted mixture of products.

One recent advance in the shipping and distribution areas is the use of an automated product handling device marketed as the Tygard Claw® by Tygard Machine and Manufacturing Company of Pittsburgh, Pa. The Tygard Claw can be installed to the front or side of a conventional forklift carriage, and enables a distributor to pick from a bulk pallet of product one layer at a time. Briefly, the Tygard Claw is a large clamping device with four individual walls that approach a layer of product on a pallet squarely and uniformly by each wall moving toward and away from a pallet layer in a translating motion. The actuators for the walls are equipped so that the walls are touch sensitive in order to lift the product without damage. The use of clamping devices such as the Tygard Claw enables distributors to assemble route delivery pallets from bulk pallets one layer of product at a time without the need for manual picking.

With the aforementioned storage, handling, and delivery processes in mind, there are several features which are desirable for the design of low depth bottle trays. Generally, low depth trays should have a wall structure that provides support for the bottles stored therein while also allowing the bottles to be visible for merchandising purposes. In addition, trays should be designed with structural features which enhance their stability when stacked and cross-stacked. Still further, the wall structure should have sufficient strength and rigidity to withstand automated handling. Lastly, the trays should be lightweight and be easy to manipulate and carry.

While some trays may fulfill these objectives, two important problems are encountered with current low depth trays. First, the side wall construction of low depth trays often does not allow great enough tolerance for nesting of trays, such that trays can become misaligned and/or stuck together. As a result, conservation of storage space and ease of handling is sacrificed. Second, the side wall structure is often not suited for the automated handling devices and processes described above.

DISCLOSURE OF INVENTION

Therefore, it is an object according to the present invention to provide an improved low depth tray for storing, transporting, and displaying fluid containers.

It is another object according to the present invention to provide a low depth tray for fluid containers which provides greater tolerance for nesting with similar trays when empty.

It is another object according to the present invention to provide a low depth tray for fluid containers constructed to facilitate handling by automated handling devices, such as clamping devices for automated palletizing.

It is another object according to the present invention is to provide a low depth tray for fluid containers that provides stability when stacked and cross-stacked with similar loaded trays.

It is another object according to the present invention to provide a low depth tray for fluid containers which is lightweight and easy to handle.

Accordingly, a low depth tray for fluid containers, such as bottles, is provided. The tray includes a base and a first pair of opposed walls extending upwardly from the base. The tray further includes a second pair of opposed walls extending upwardly from the base and integrally joined with the first pair of opposed walls to form a storage area. Each of the second pair of opposed walls includes an upper wall portion and a lower wall portion, the upper wall portion including first areas having a single-walled construction and second areas for contacting the fluid containers. When nested with a similar tray, the lower wall portion of an upper tray nests within the corresponding first areas of a tray disposed therebelow.

In one embodiment, each of the second pair of opposed walls includes an upper wall portion and a lower wall portion, where the upper wall portion includes a plurality of alternating first areas having a single-walled construction and second areas a having double-walled construction. When nested with a similar tray, the lower wall portion of an upper tray nests within the corresponding first areas of a tray disposed therebelow.

Preferably, the first areas include upper wall panels, and the second areas include columns for providing lateral support to fluid containers loaded in the tray. In one embodiment, an interior surface of each column is substantially flat, whereas in another embodiment the interior surface of each column is generally concave. The second areas may also include portions extending into the storage area. The upper wall portion is preferably slightly tapered in a downward direction. In one embodiment, the upper wall panels are lower in height than the columns. However, the upper wall panels can be substantially equal in height to the columns, thereby defining a continuous upper edge of the upper wall portion. Still further, the upper wall portion of at least one of the second pair of opposed walls can include a contour or a curved upper or lower surface. The upper wall portion also includes a double-walled transition area immediately above the lower wall panels.

In accordance with the present invention, the lower wall portion includes an alternating arrangement of lower wall panels extending upwardly from the base and cutout portions. In one embodiment, the lower wall panels include inwardly extending protrusions positioned to extend between adjacent fluid containers loaded in the tray.

In further accordance with the present invention, the top surface of the base is substantially flat and includes an open grid-work configuration. Preferably, the bottom surface of the base has a plurality of receiving areas for receiving the tops of similar fluid containers in a layer in a similar tray beneath the base. In one embodiment, at least one member is provided extending upwardly from an interior portion of the base top surface.

In a preferred embodiment, each of the first pair of opposed walls includes a handle portion. The handle portion includes a top bar which can protrude above an upper edge of the first pair of opposed walls, or can alternatively be coplanar with an upper edge of the first pair of opposed walls. In one embodiment, the top bar includes at least one inwardly extending projection to provide lateral support to fluid containers loaded in the tray.

Still further, the first pair of opposed walls includes an a lower wall portion and an upper wall portion. For the first pair of opposed walls, the upper wall portion preferably has a double-walled construction. The upper wall portion of the first pair of opposed walls includes columns for providing lateral support to fluid containers loaded in the tray, and the lower wall portion of the first pair of opposed walls includes an alternating arrangement of lower wall panels extending upwardly from the base and cutout portions.

In still another embodiment, the tray for bottles includes a floor member having a plurality of bottle support areas a sidewall structure integrally formed with the floor member. The sidewall structure has an upper wall portion and a lower wall portion, such that the upper wall portion has at least one double-walled area, and the lower wall portion has a single wall construction. Further, the lower wall portion includes an inner surface having a plurality of inwardly extending protrusions positioned to extend between adjacent bottles positioned in the tray.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figure 8:
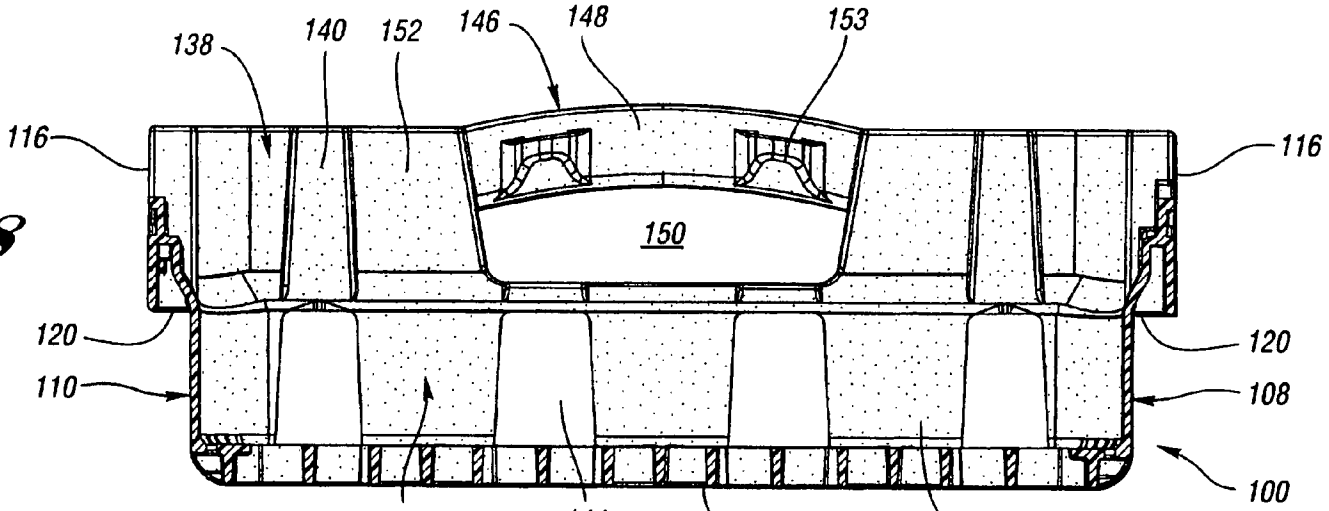
FIG. 8 is a cross-section of the tray taken along line 8—8 of FIG. 2.
Figure 9:
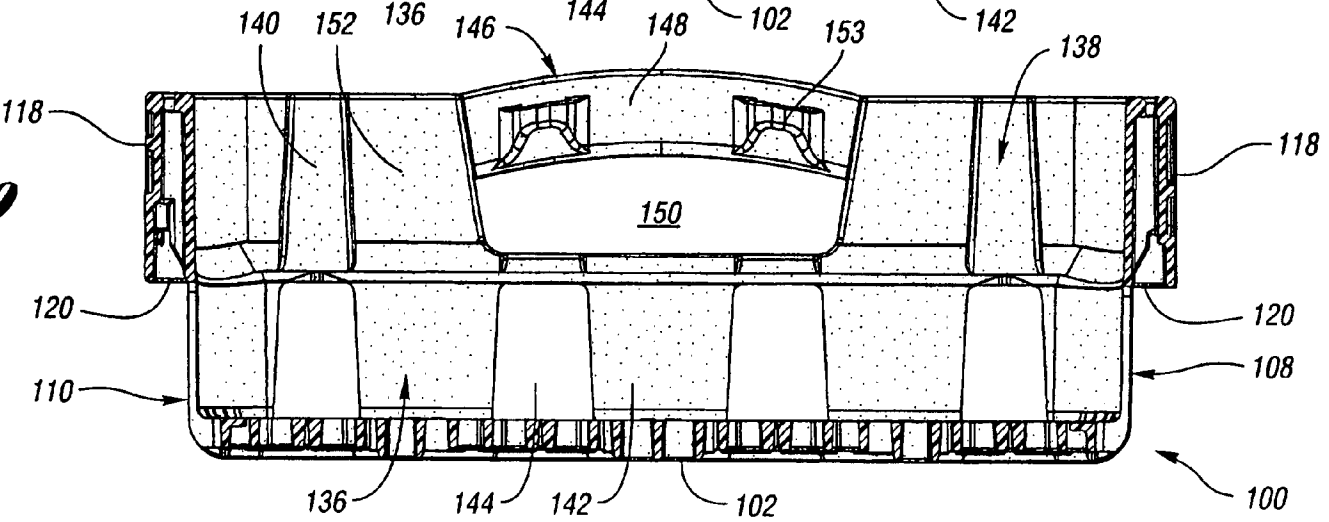
FIG. 9 is a cross-section of the tray taken along line 9—9 of FIG. 2.
Figure 10:
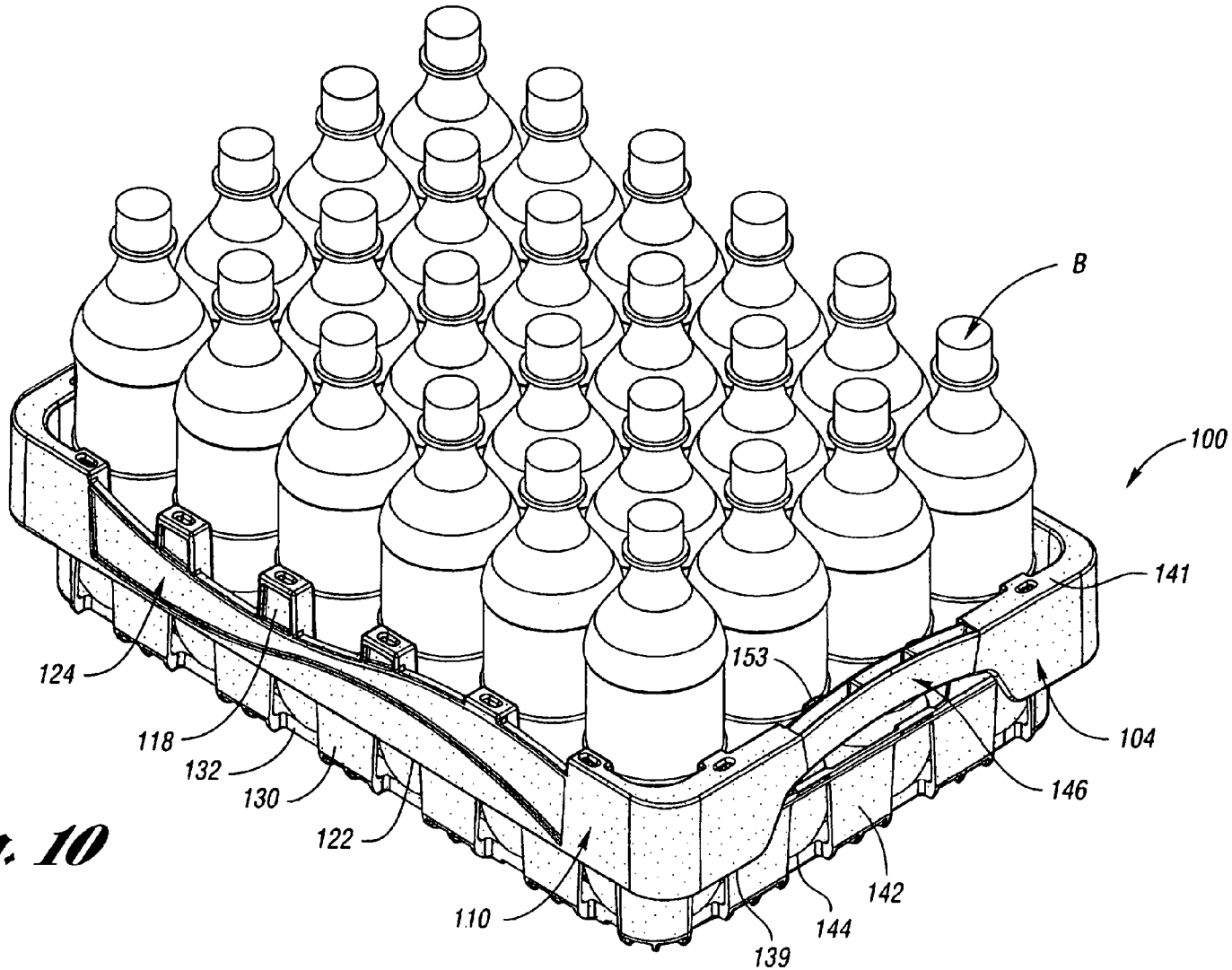
FIG. 10 is a perspective view of the embodiment of FIG. 1 shown filled with a 4×6 array of fluid containers.

FIGS. 1–10 illustrate a first embodiment of a low depth tray 100 according to the present invention. While tray 100 is suited for many uses, tray 100 is particularly suitable for storing and transporting fluid containers, such as bottles B (see FIG. 10). Referring first to the perspective view of FIG. 1, tray 100 includes a base 102 or floor member, a first pair of opposed walls 104, 106, and a second pair of opposed walls 108, 110. For convenience, and without additional limitation, first pair of opposed walls 104, 106 will be referred to herein as end walls, and second pair of opposed walls 108, 110 will be referred to herein as side walls. End walls 104, 106 and side walls 108, 110 are integrally joined with base 102 and extend upwardly therefrom. End walls 104, 106 and side walls 108, 110 are also integrally joined with each other such that end walls 104, 106, side walls 108, 110, and base 102 together form a storage area for bottles B, as shown in FIG. 10. The corners of base 102, end walls 104, 106, and side walls 108, 110 are preferably rounded on both the interior and exterior surfaces of tray 100.

Tray 100 is typically formed of various types of plastic or polymeric materials, such as high density polyethylene (HDPE), by an injection molding or other plastic molding process suitable to this application. Preferably, tray 100 is molded integrally as a single component. As is well understood in the art, the wall thickness of base 102, walls 104, 106, 108, 110, and other components illustrated and disclosed herein may vary depending on the intended usage and other characteristics desired from tray 100. Although a rectangular low depth tray 100 is shown and described herein, the present invention is not limited thereto and may include end walls 104, 106 and side walls 108, 110 of equal length forming a tray 100 of square dimensions. In addition, end walls 104, 106 and side walls 108, 110 are preferably tapered slightly inwardly from their uppermost surfaces to their lowermost surfaces in order to aid in placing trays 100 in a nested configuration and for facilitating handling by automated equipment as described below.

Figure 3:
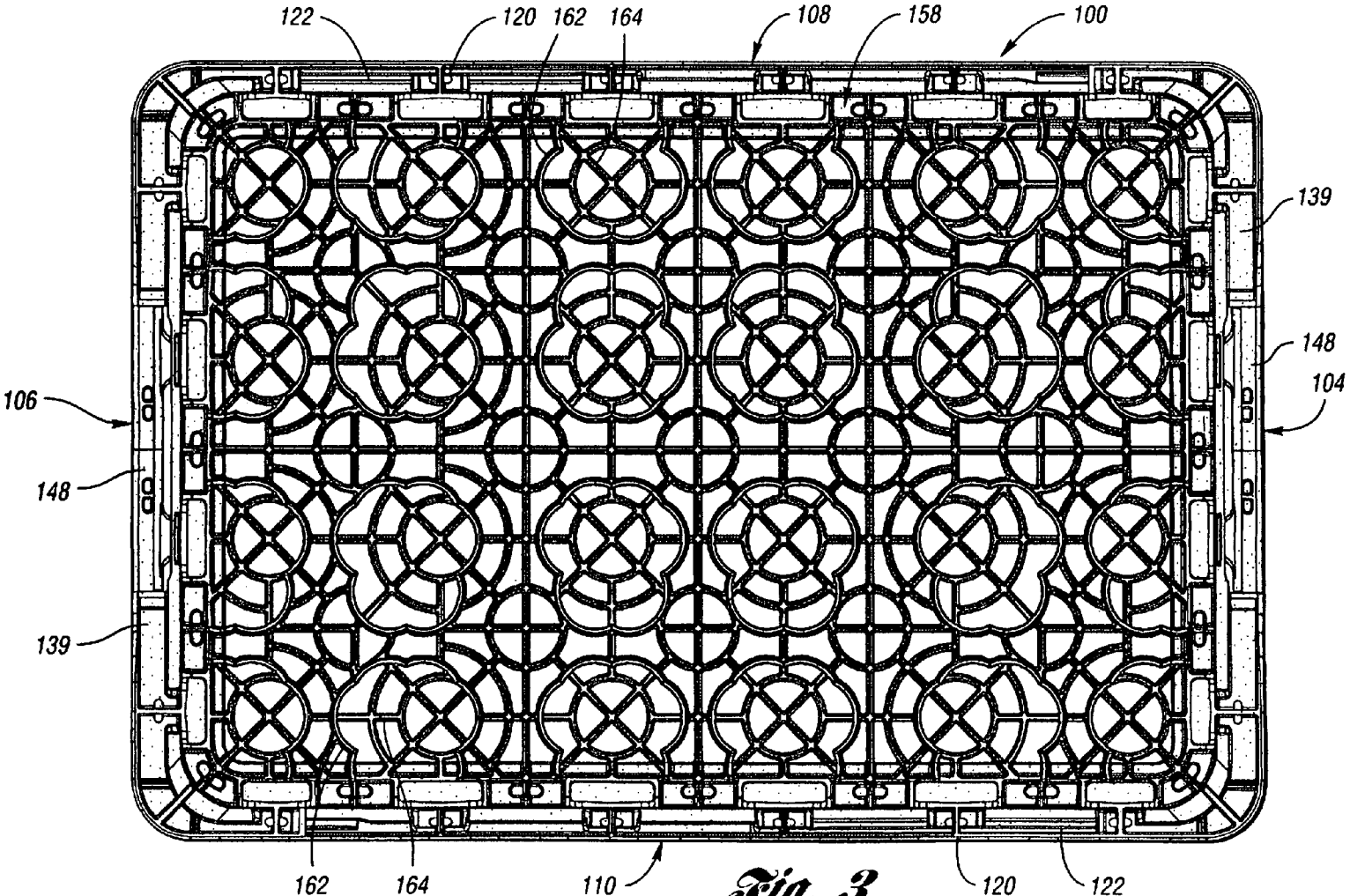
FIG. 3 is a bottom plan view of the tray of FIG. 1.
Figure 4:
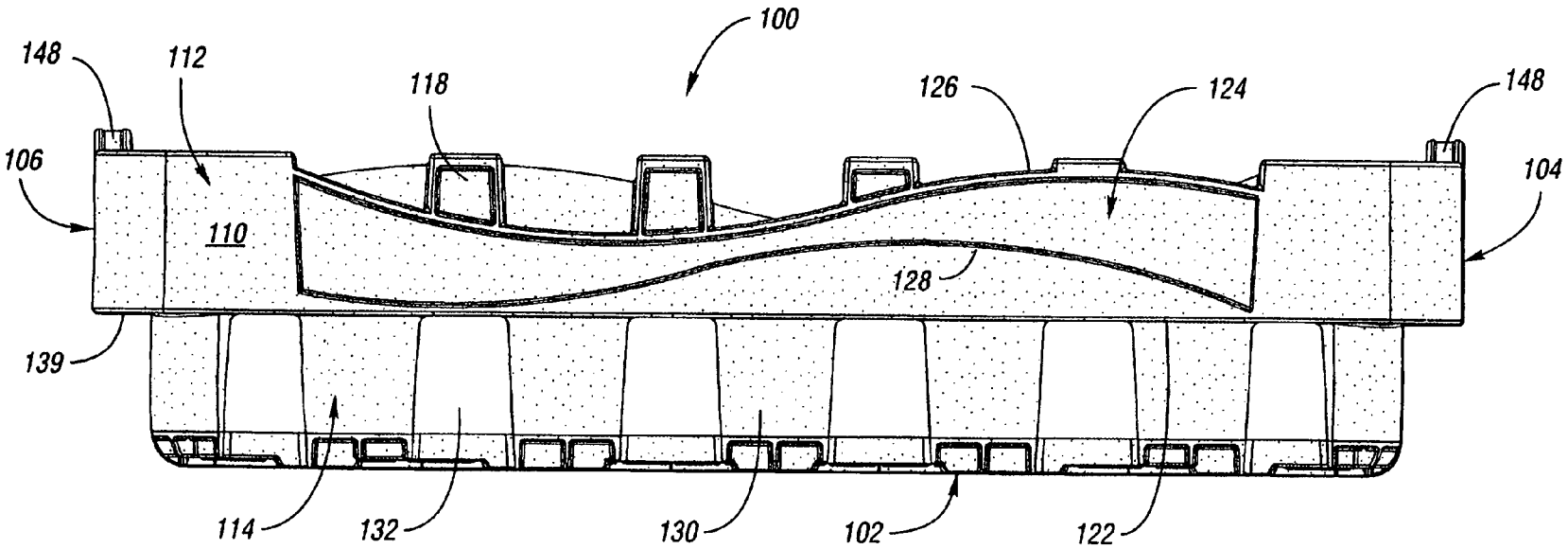
FIG. 4 is a front side elevational view of the tray of FIG. 1.
Figure 5:
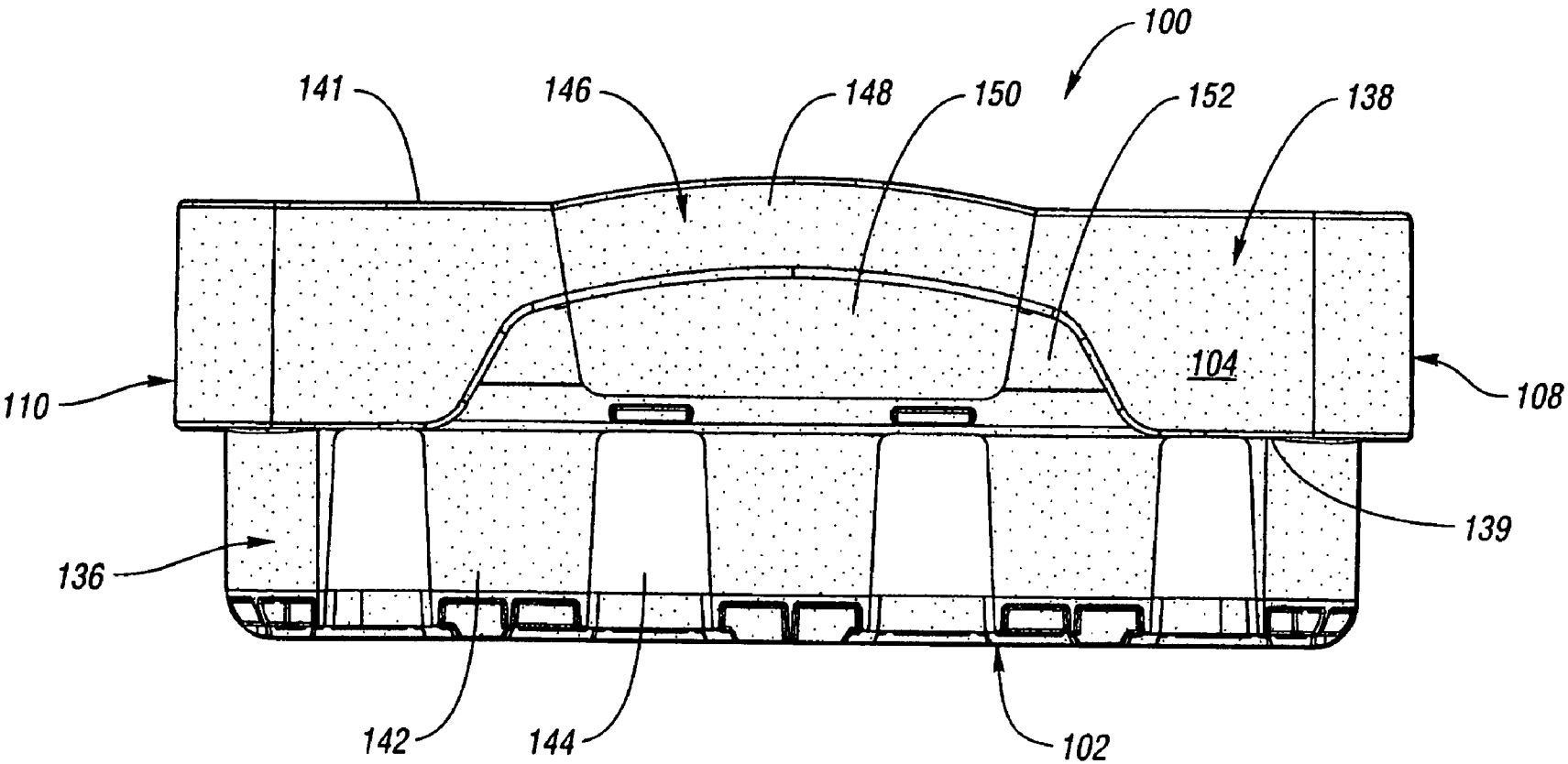
FIG. 5 is a right side elevational view of the tray of FIG. 1, the left side being a mirror image thereof.
Figure 21:
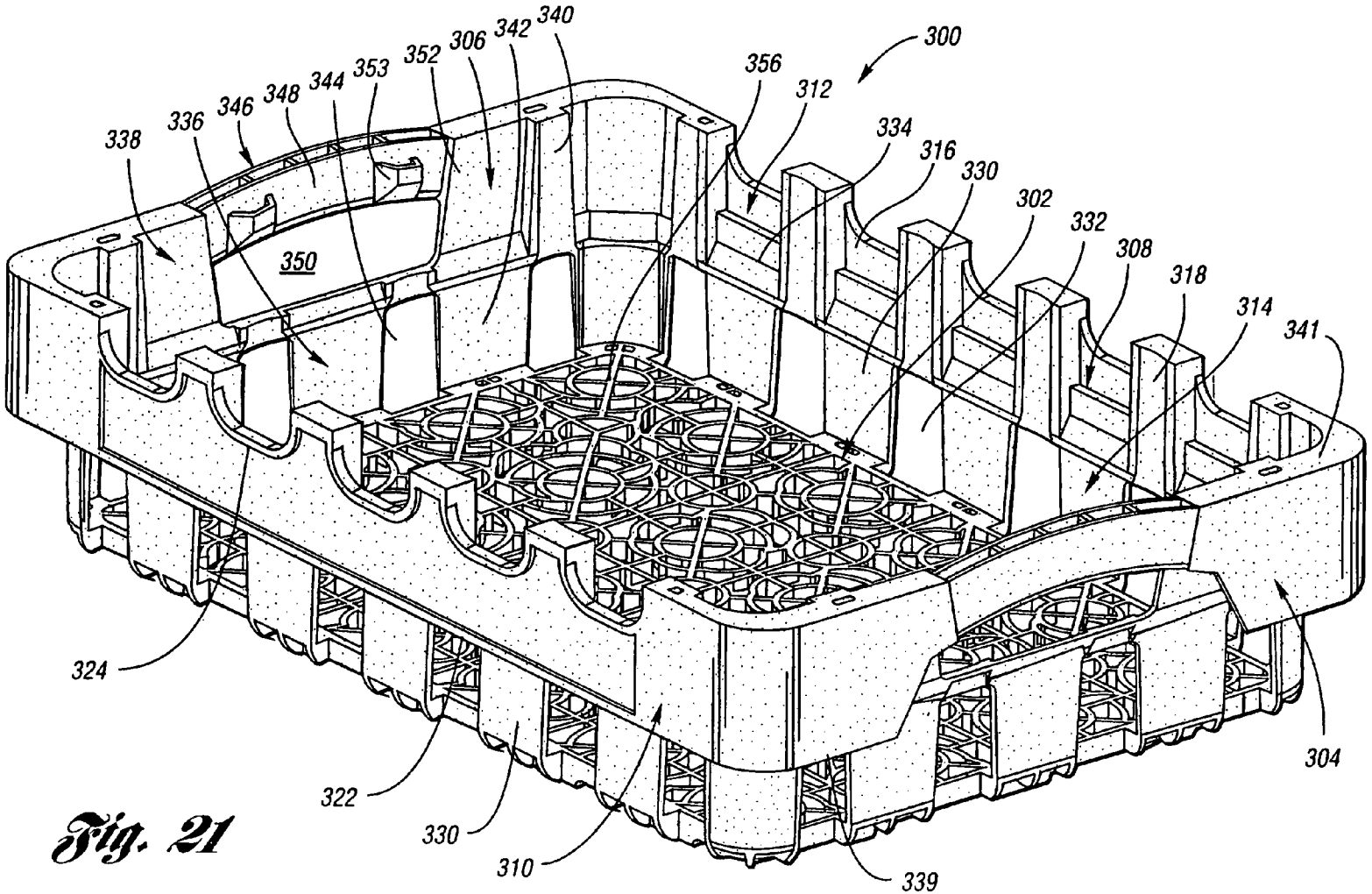
FIG. 21 is a perspective view of a third embodiment of a low depth nestable tray according to the present invention.
Figure 22:
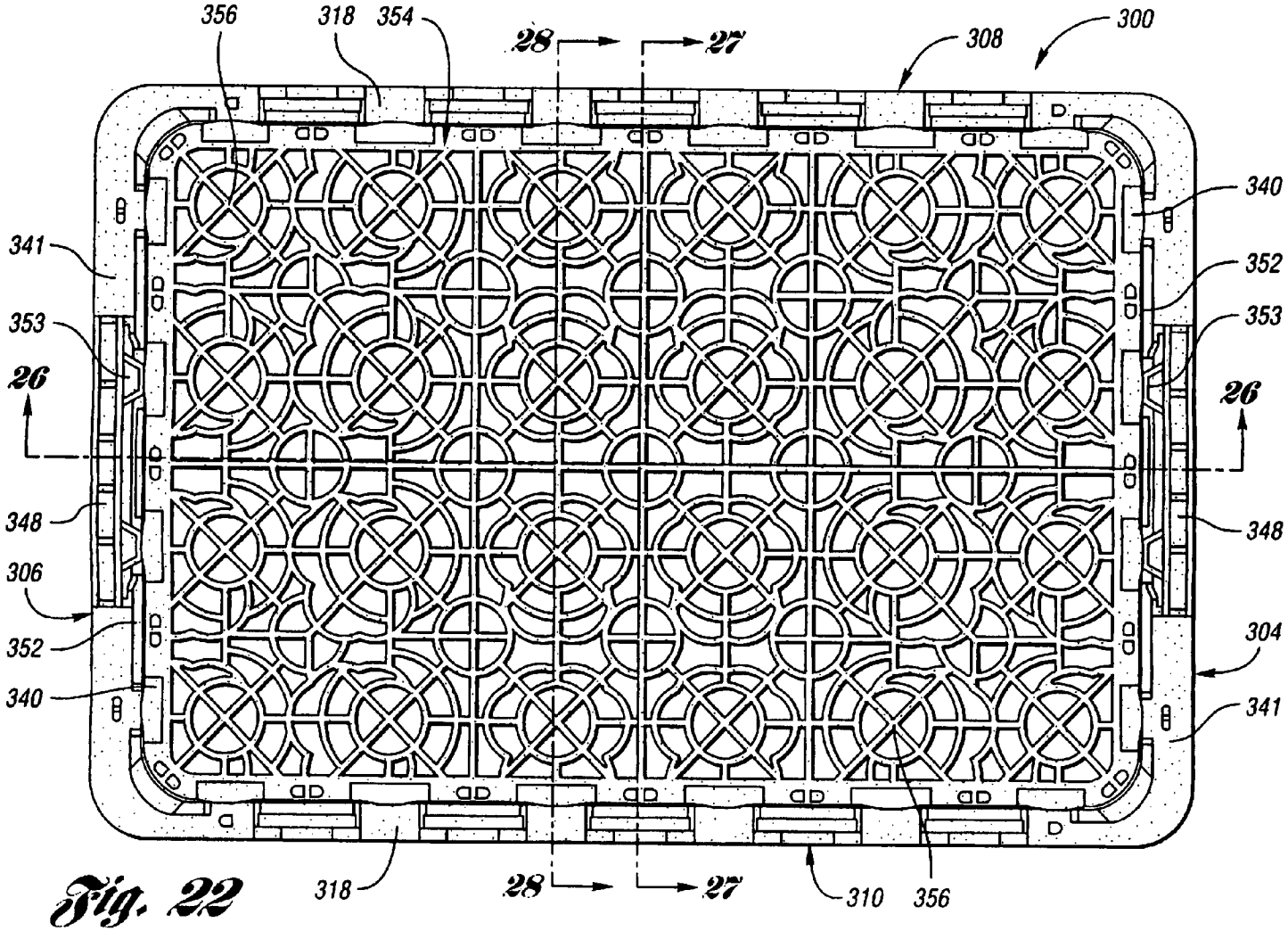
FIG. 22 is a top plan view of the tray of FIG. 21.
Figure 23:
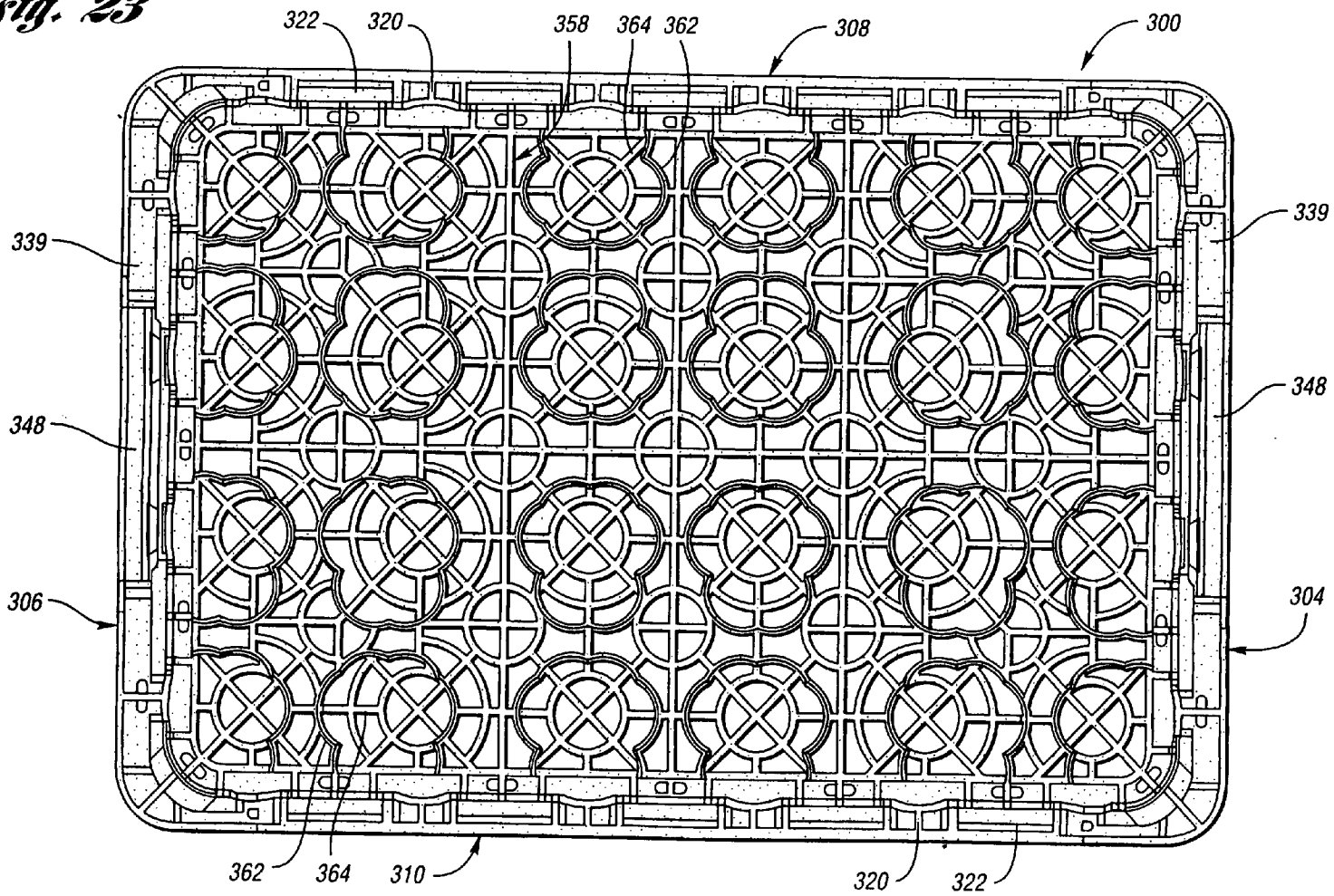
FIG. 23 is a bottom plan view of the tray of FIG. 21.
Figure 24:
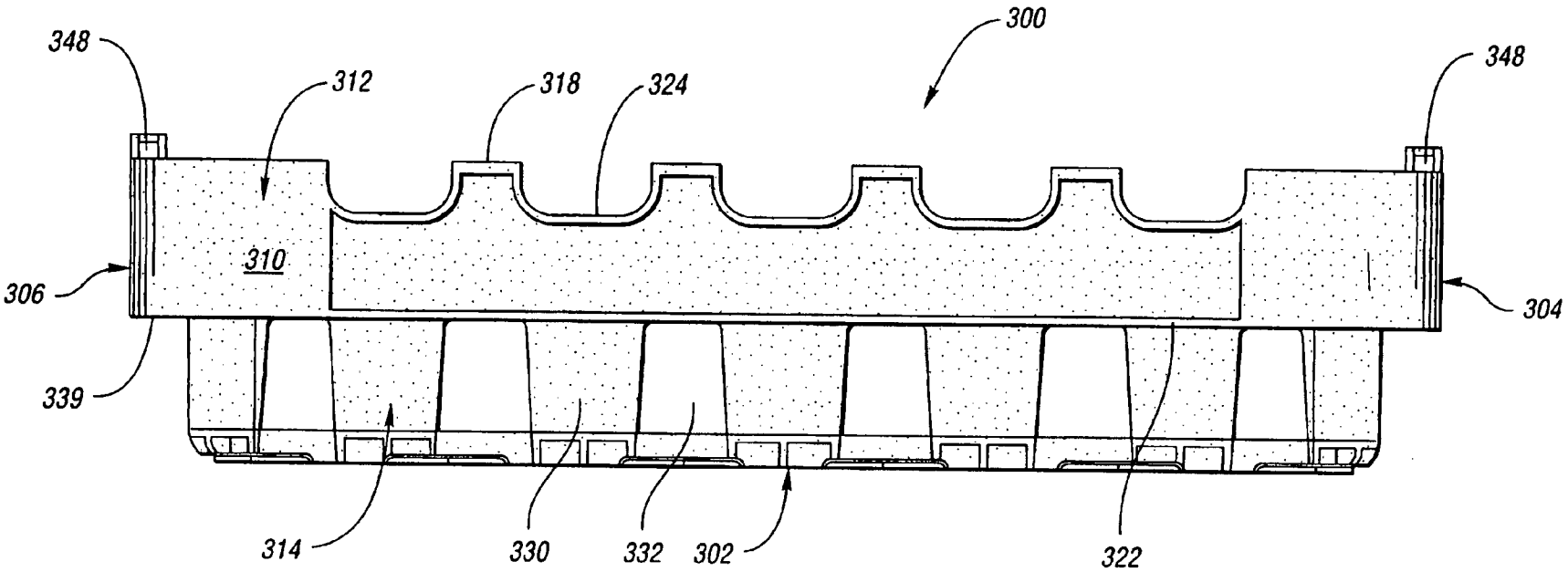
FIG. 24 is a front side elevational view of the tray of FIG. 21, the rear side elevational view being a mirror image thereof.
Figure 25:
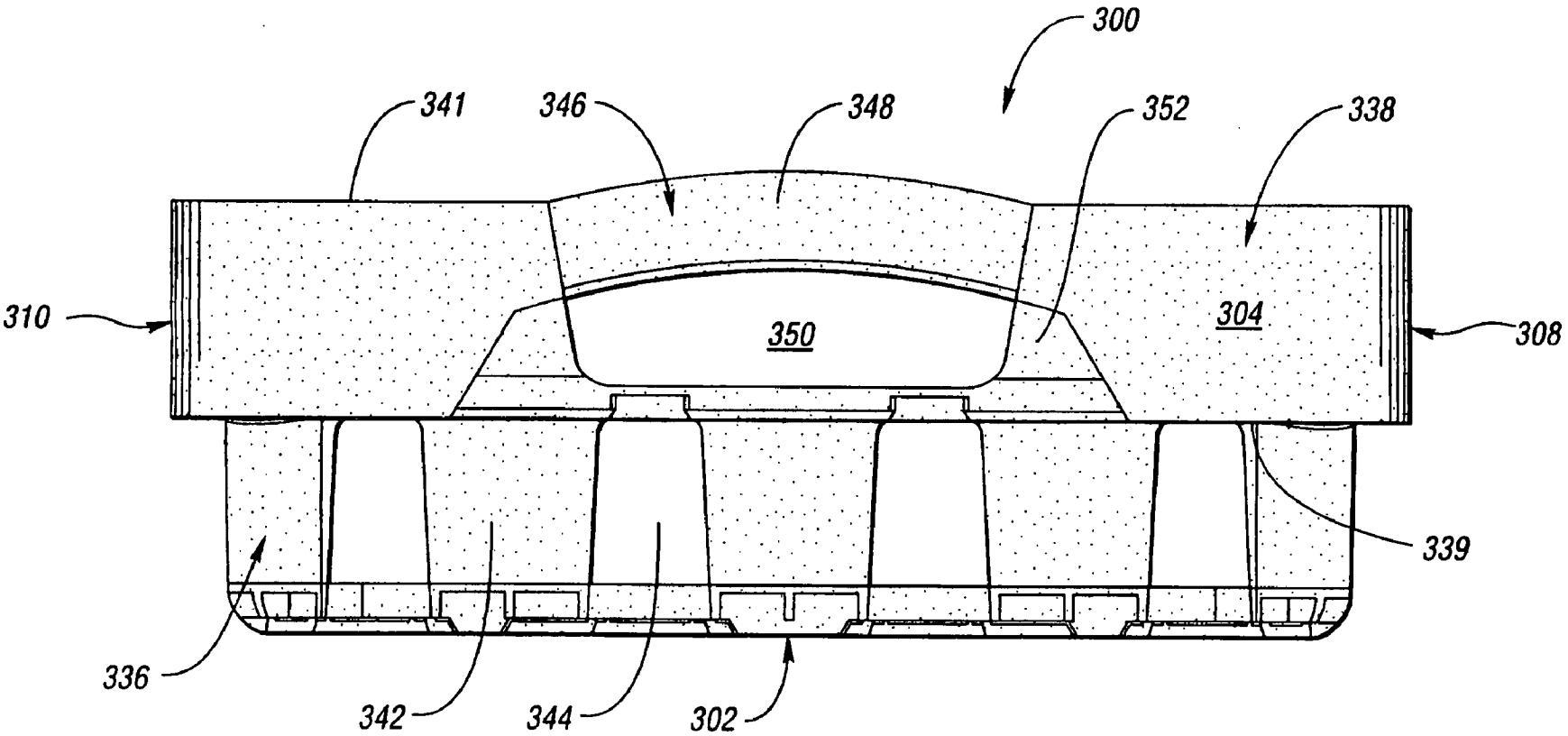
FIG. 25 is a right side elevational view of the tray of FIG. 21, the left side being a mirror image thereof.
Figure 26:
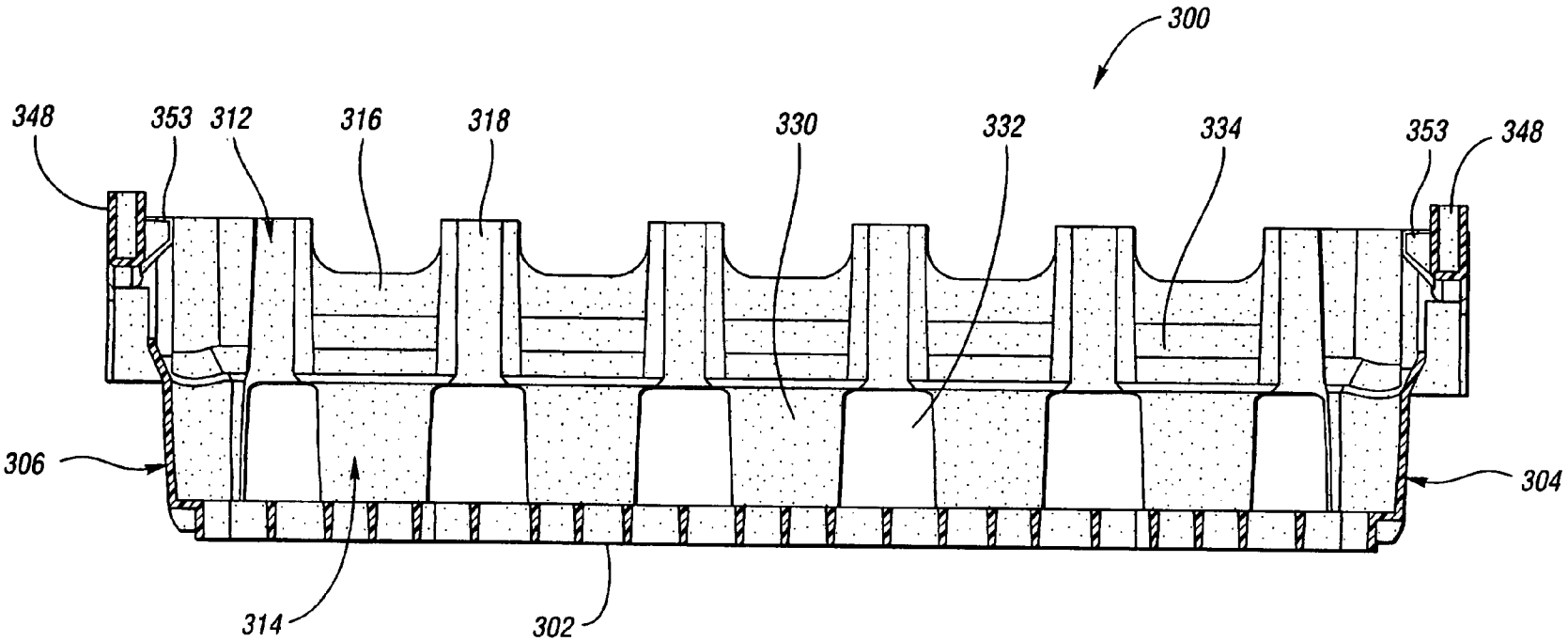
FIG. 26 is a cross-section of the tray taken along line 26—26 of FIG. 22.
Figure 27:
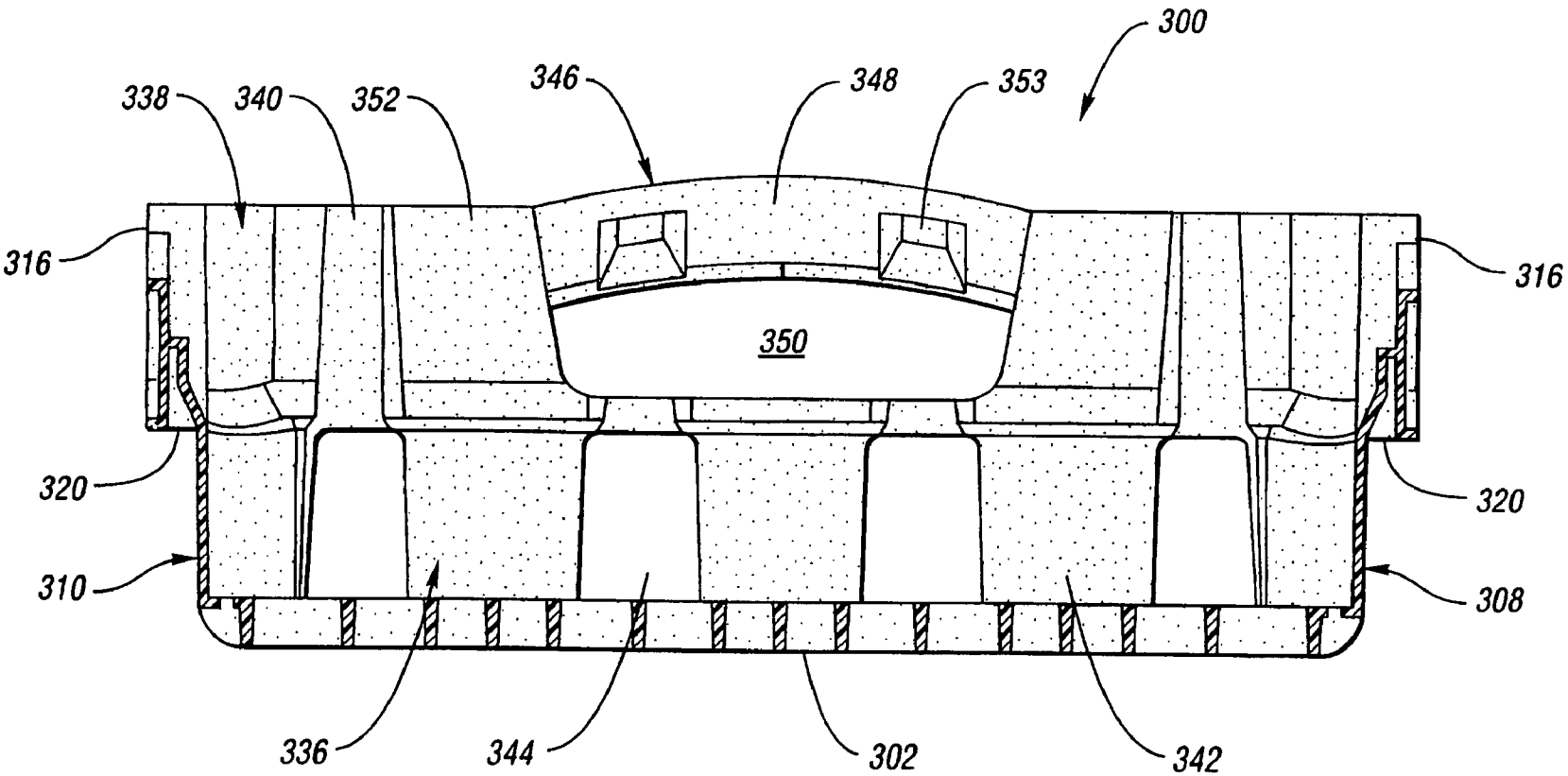
FIG. 27 is a cross-section of the tray taken along line 27—27 of FIG. 22.
Figure 28:
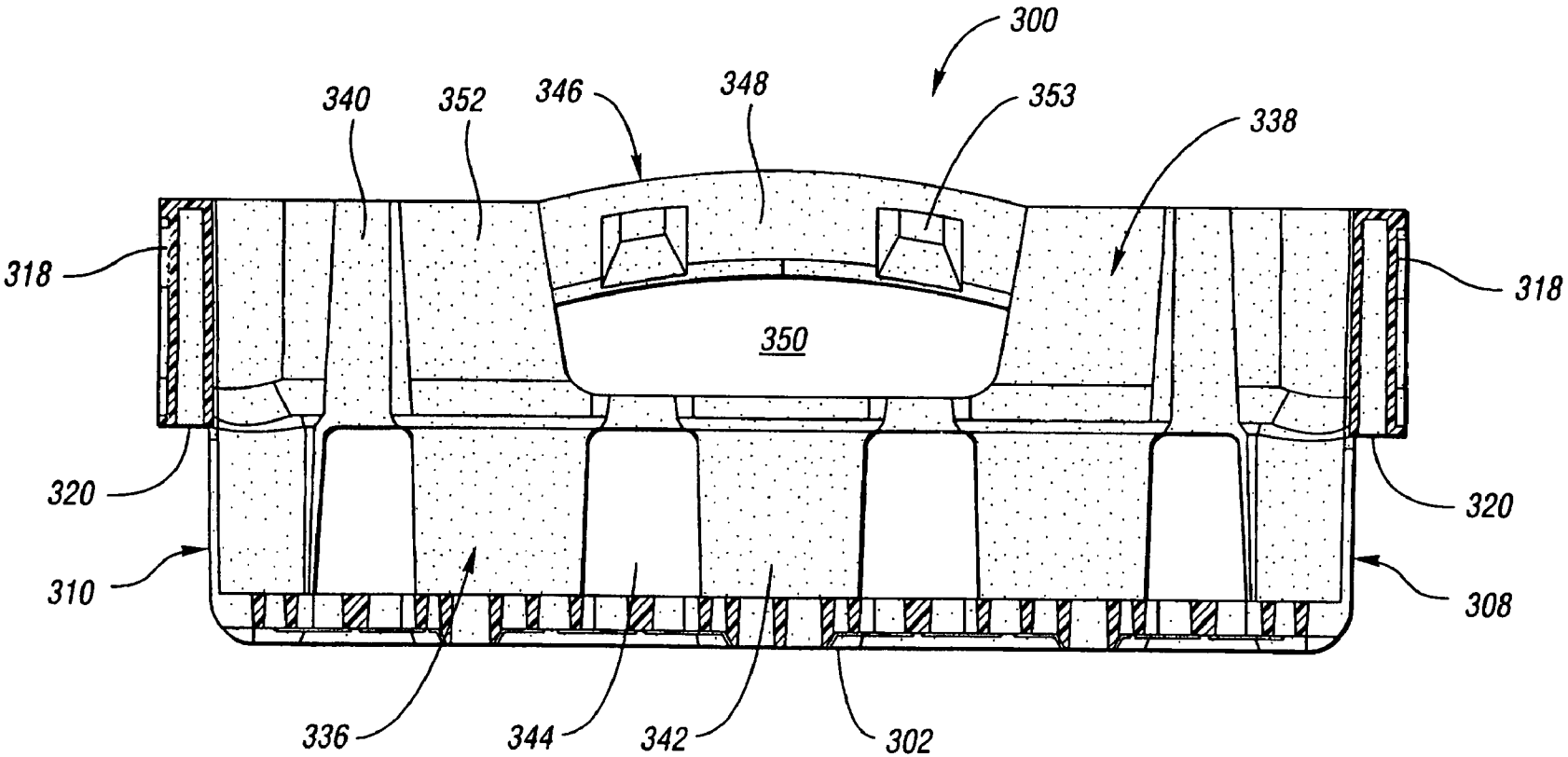
FIG. 28 is a cross-section of the tray taken along line 28—28 of FIG. 22.
Figure 29:
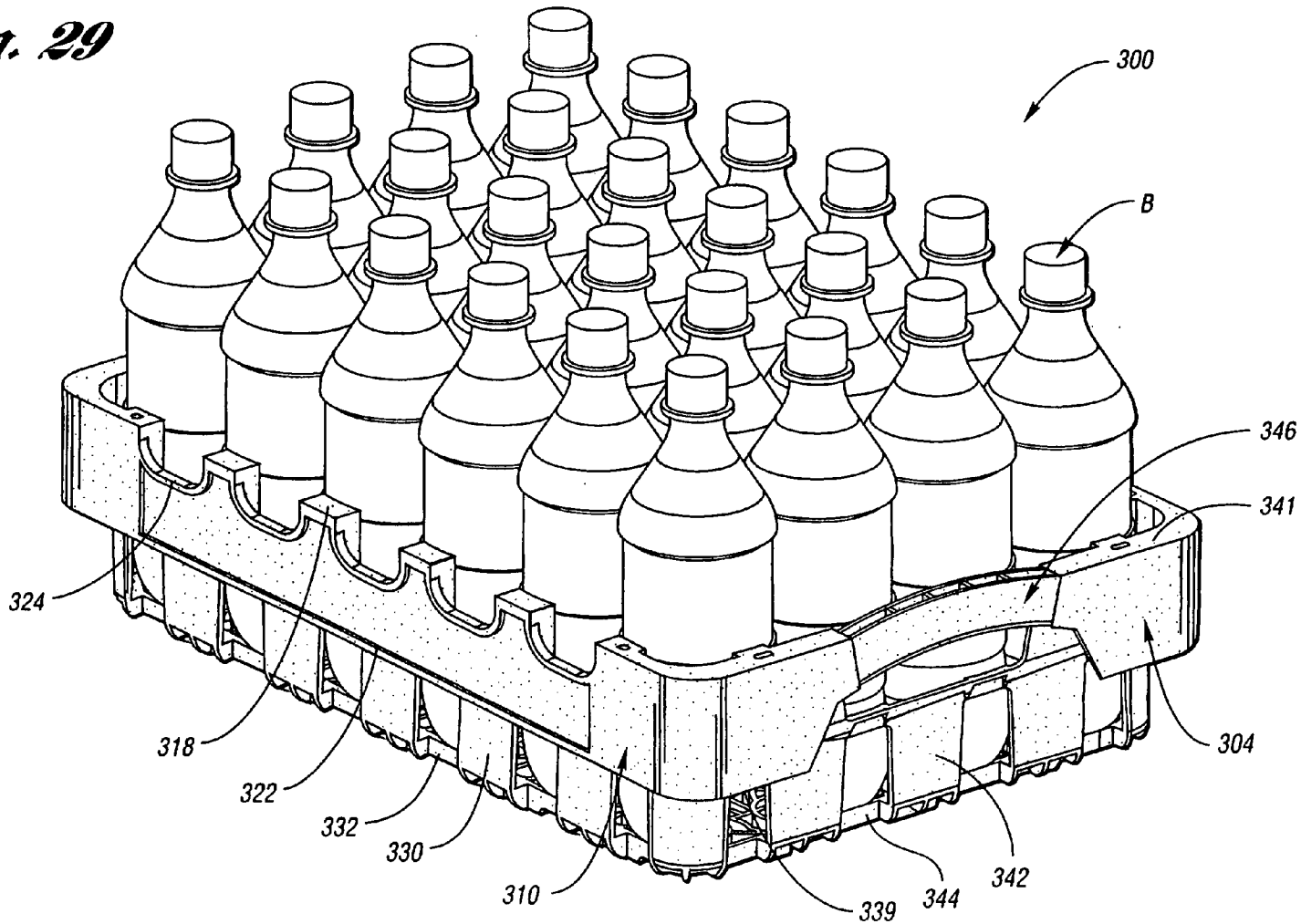
FIG. 29 is a perspective view of the tray of FIG. 21 shown filled with a 4×6 array of fluid containers.
Figure 30:
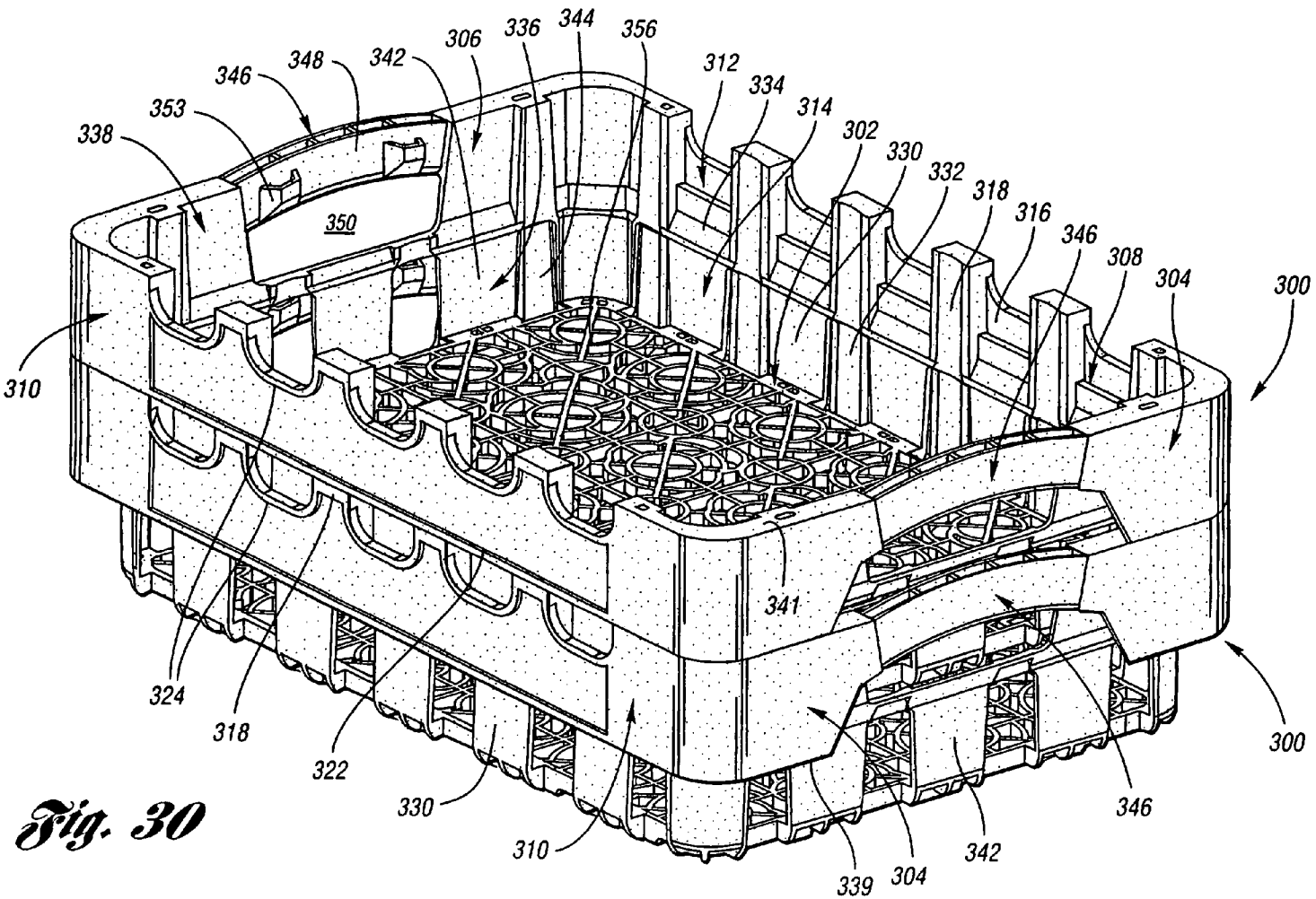
FIG. 30 is a perspective view of the tray of FIG. 21 shown in a nested position with a like tray.
Figure 31:
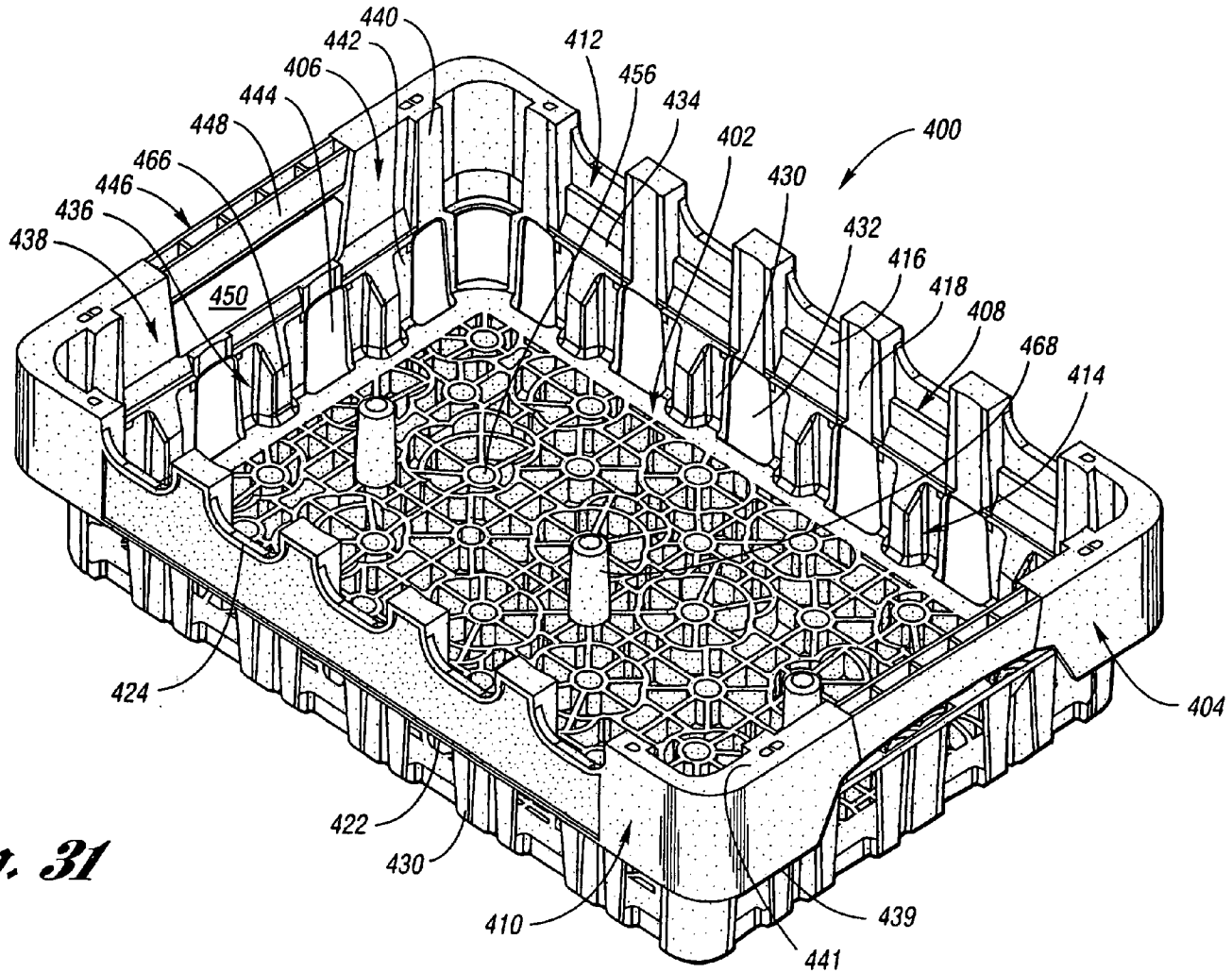
FIG. 31 is a perspective view of a fourth embodiment of a low depth nestable tray according to the present invention.
Figure 32:
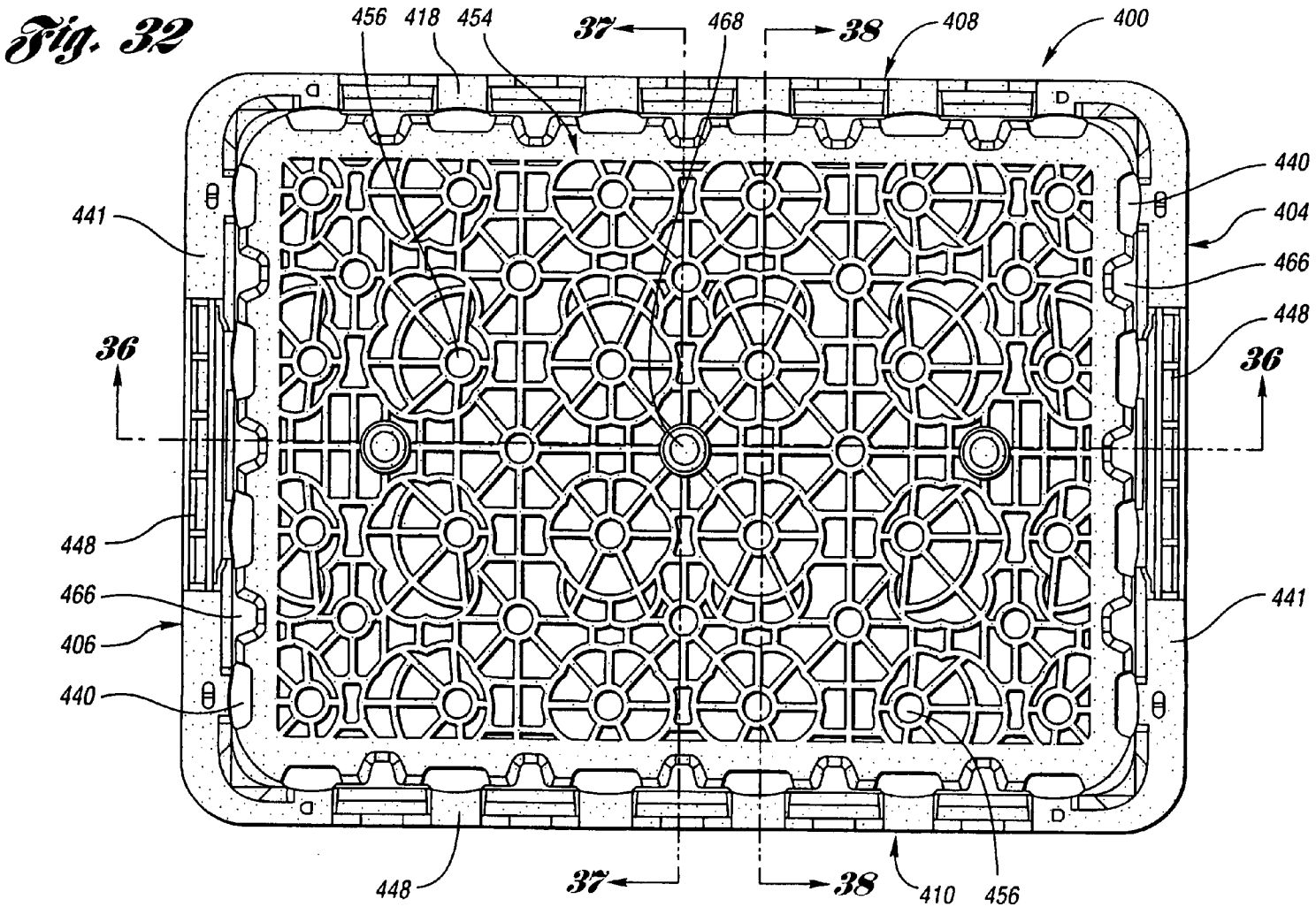
FIG. 32 is a top plan view of the tray of FIG. 31.
Figure 33:
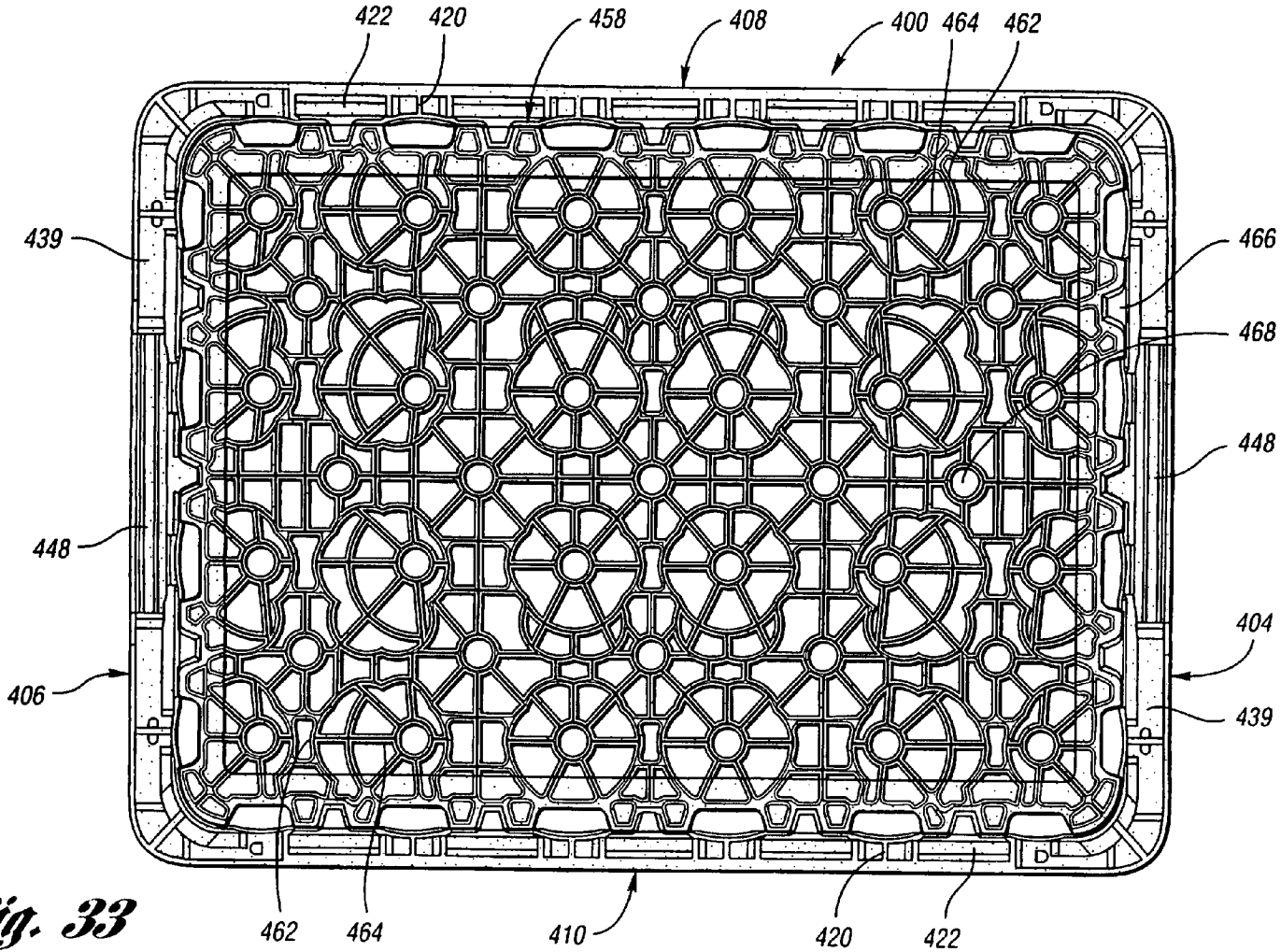
FIG. 33 is a bottom plan view of the tray of FIG. 31.
Figure 34:
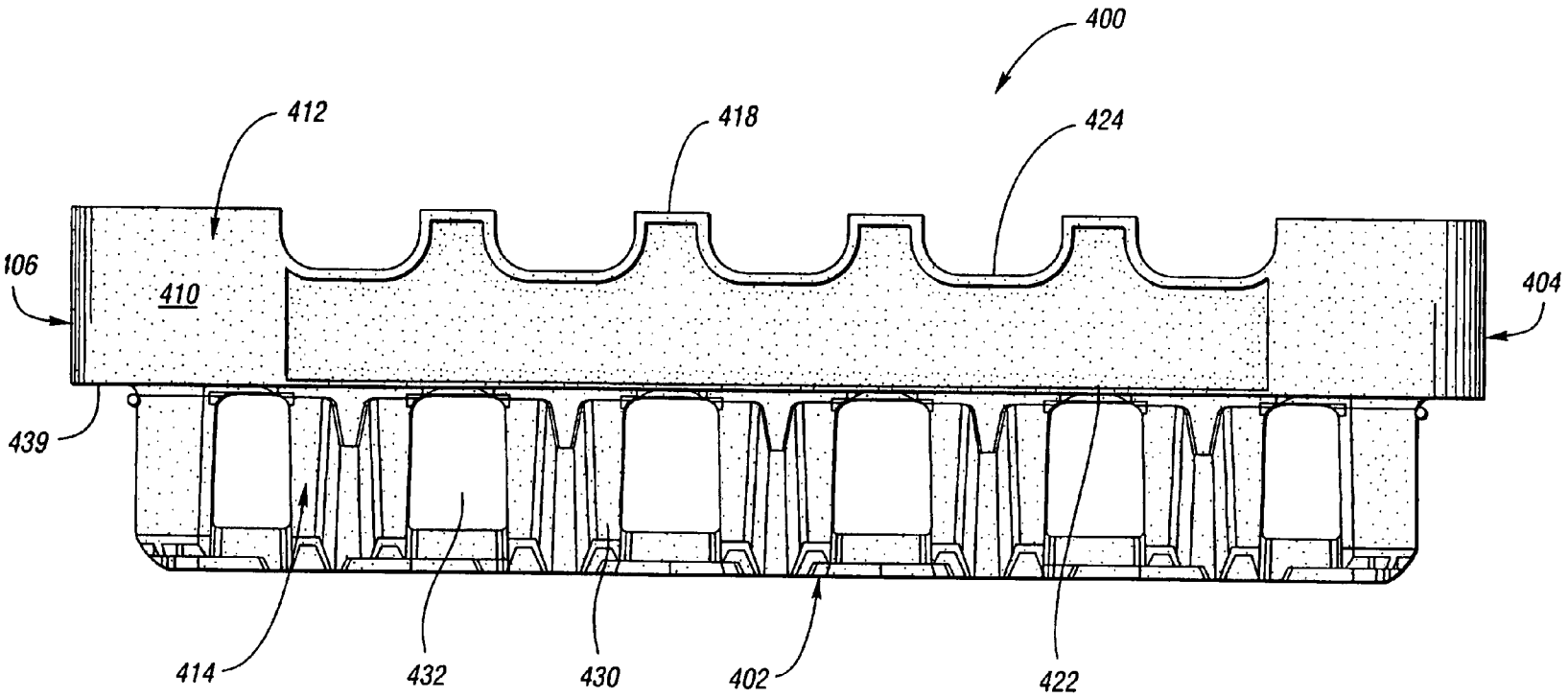
FIG. 34 is a front side elevational view of the tray of FIG. 31, the rear side view being a mirror image thereof.
Figure 35:
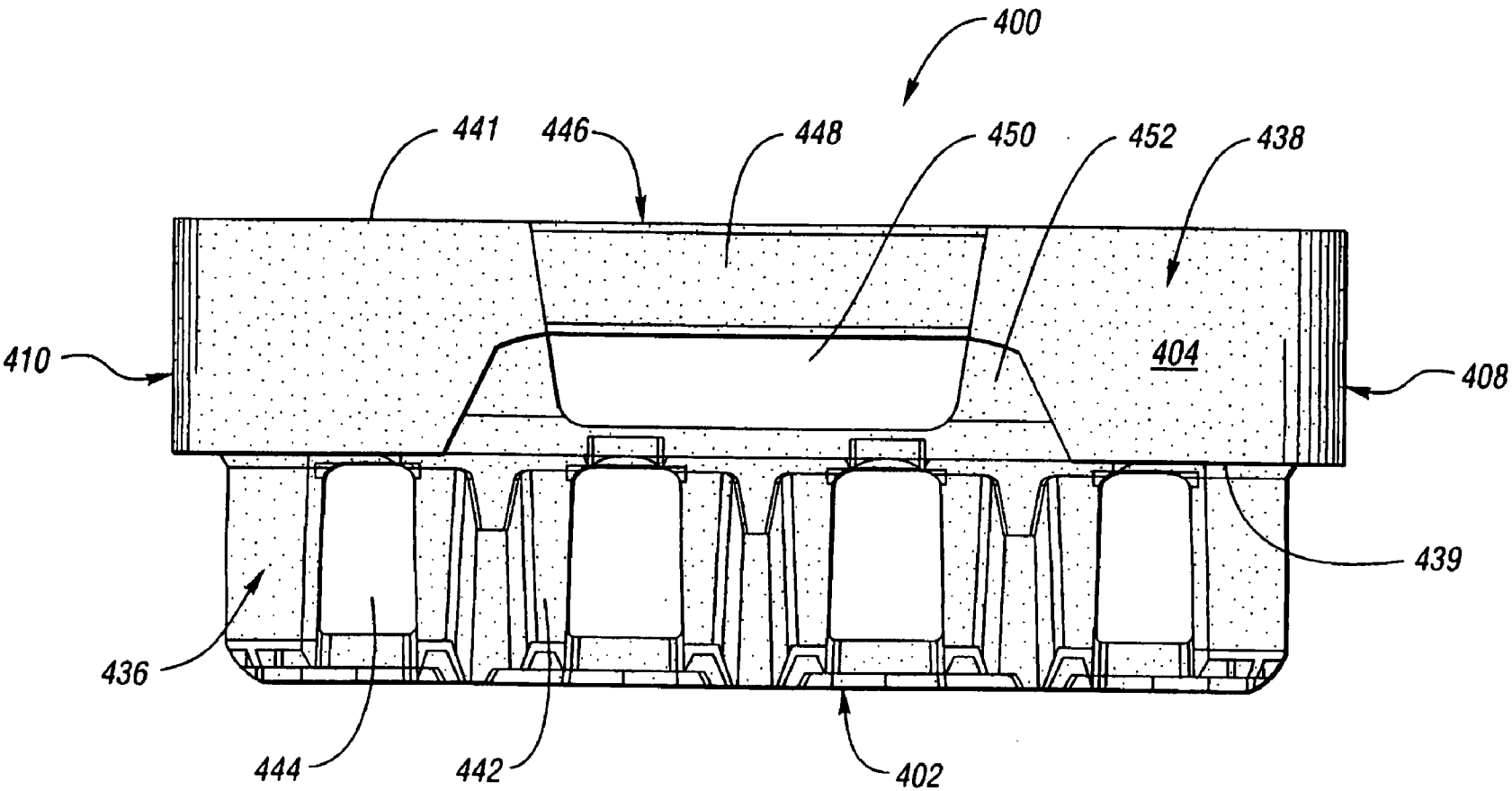
FIG. 35 is a right side elevational view of the tray of FIG. 31, the left side being a mirror image thereof.
Figure 36:
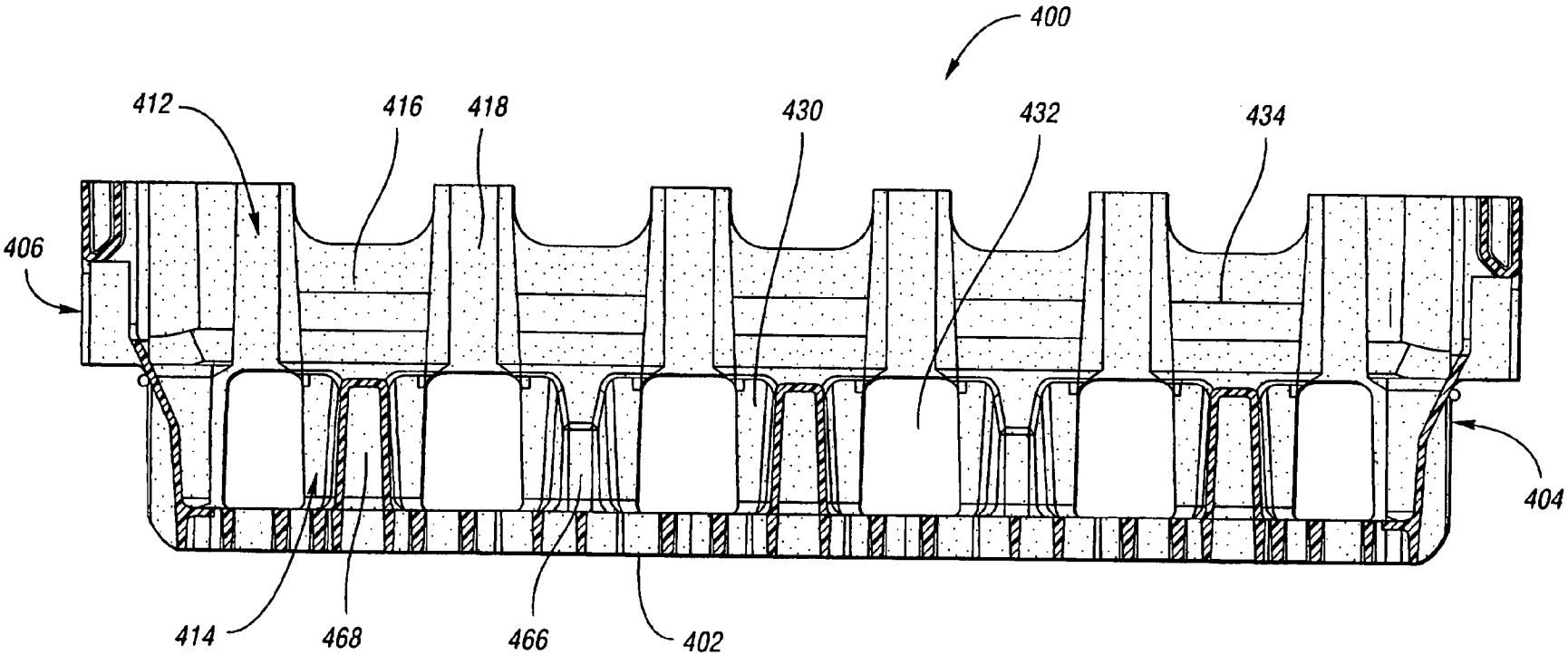
FIG. 36 is a cross-section of the tray taken along line 36—36 of FIG. 32.
Figure 37:
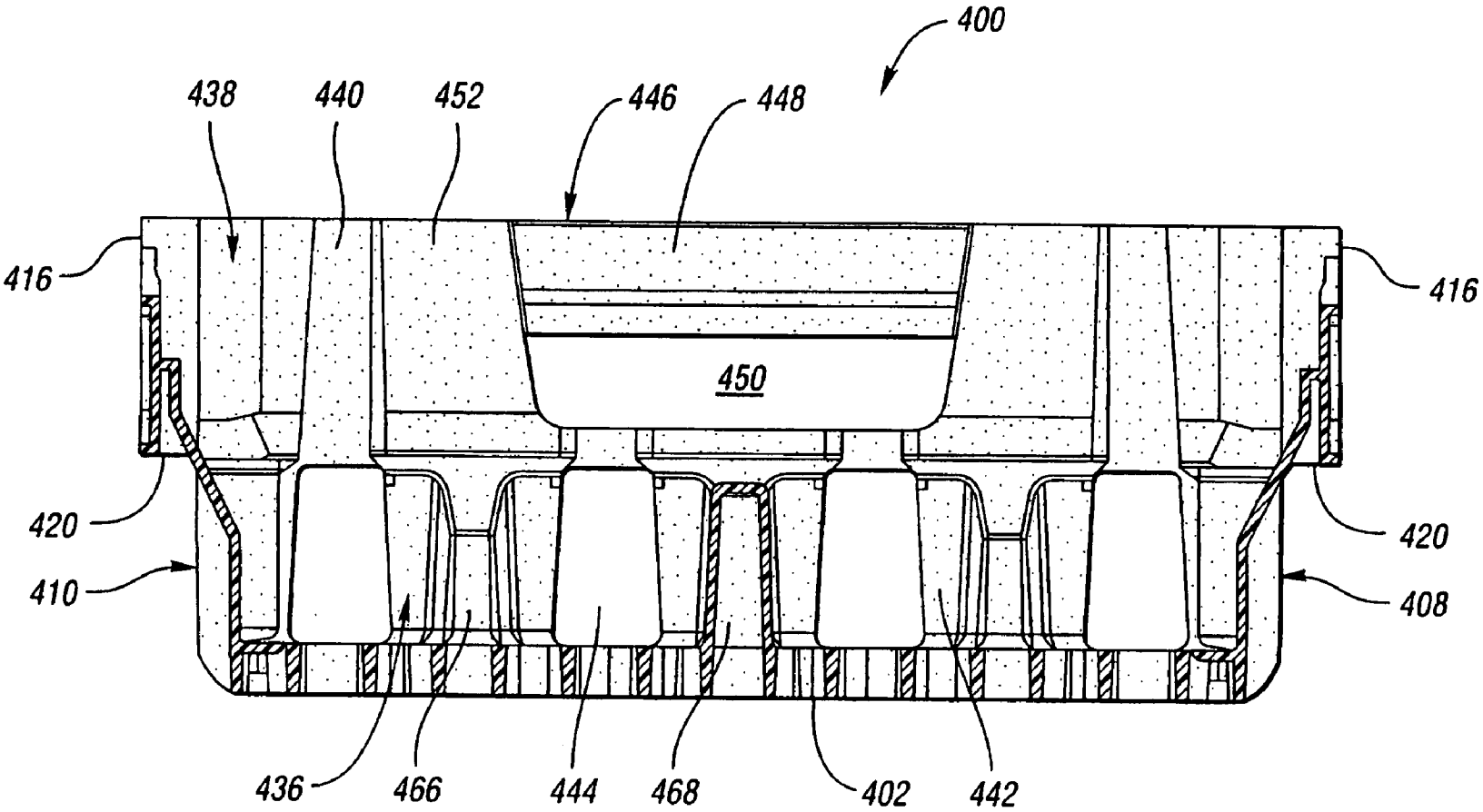
FIG. 37 is a cross-section of the tray taken along line 37—37 of FIG. 32.
Figure 38:
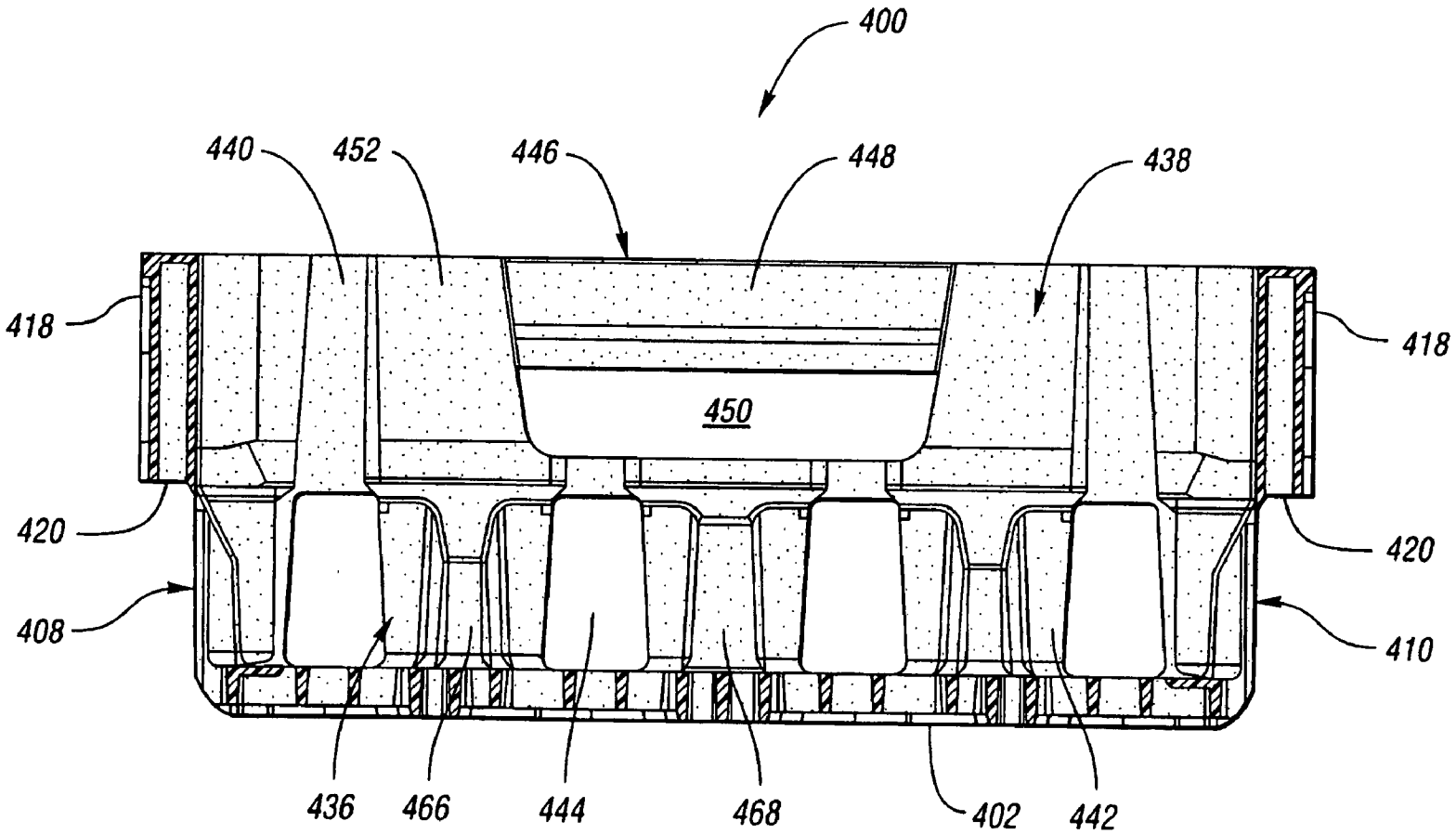
FIG. 38 is a cross-section of the tray taken along line 38—38 of FIG. 32.
Figure 39:
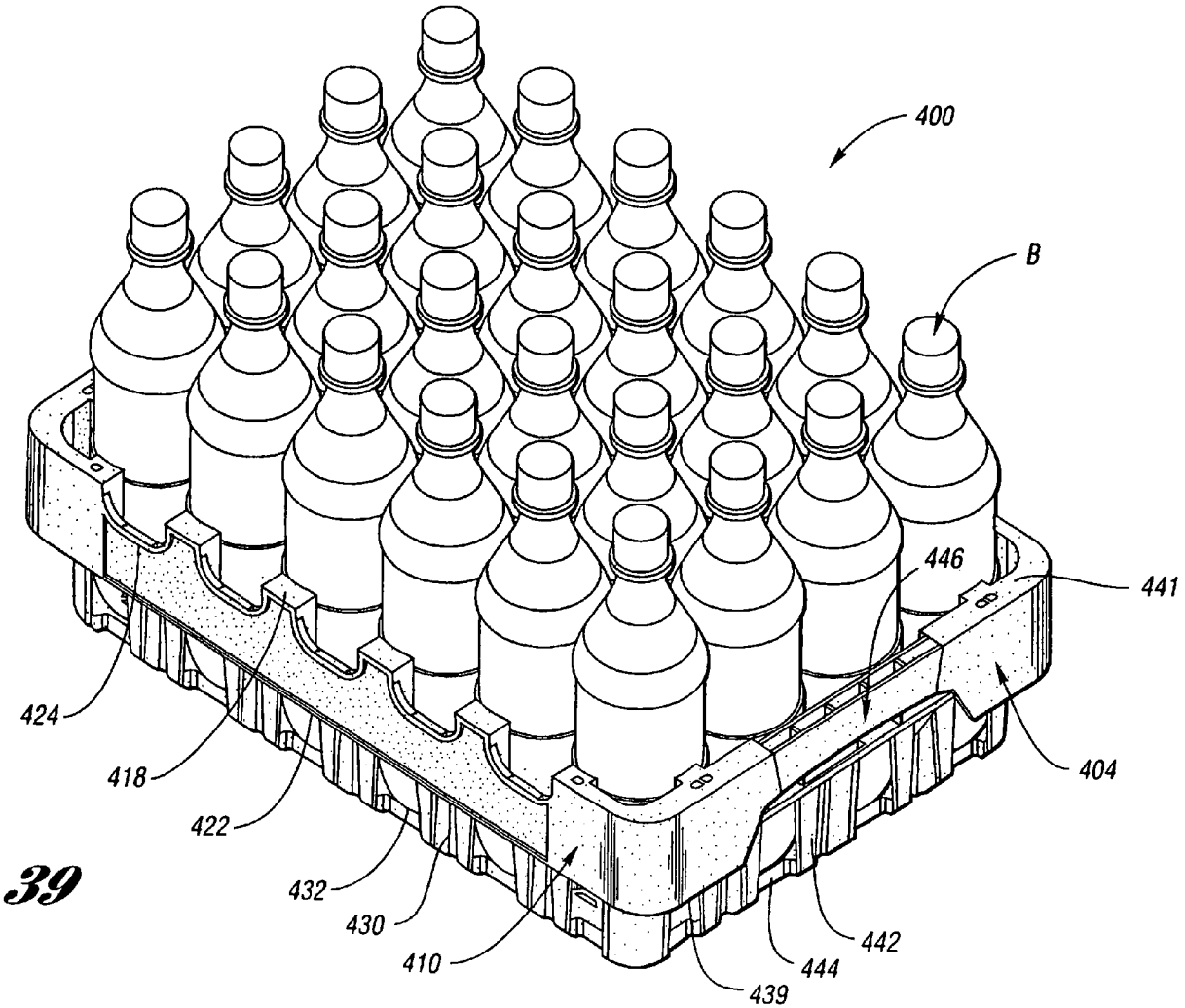
FIG. 39 is a perspective view of the tray of FIG. 31 shown filled with a 4×6 array of fluid containers.
Figure 40:
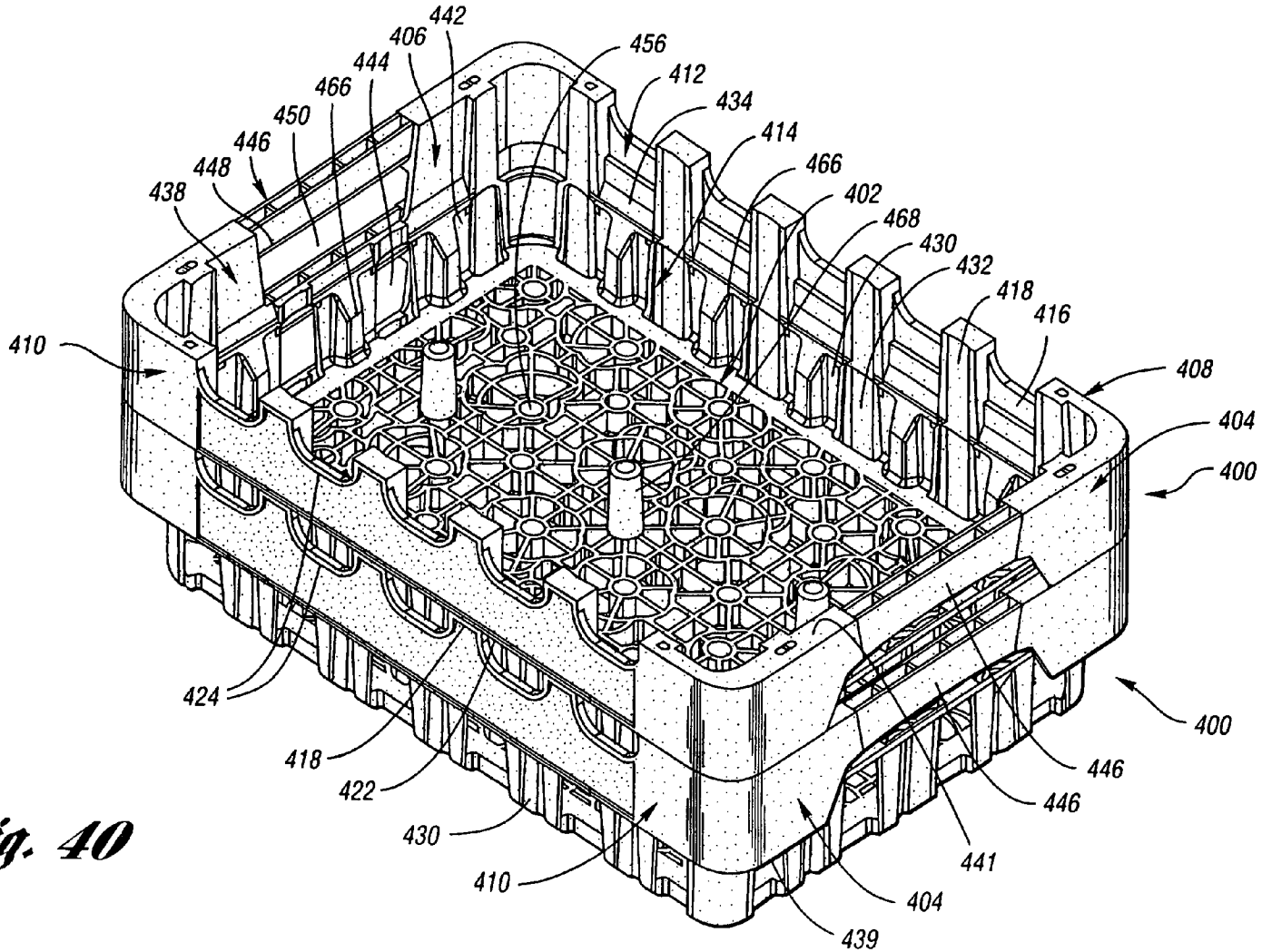
FIG. 40 is a perspective view of the tray of FIG. 31 shown in a nested position with a like tray.
Figure 41:
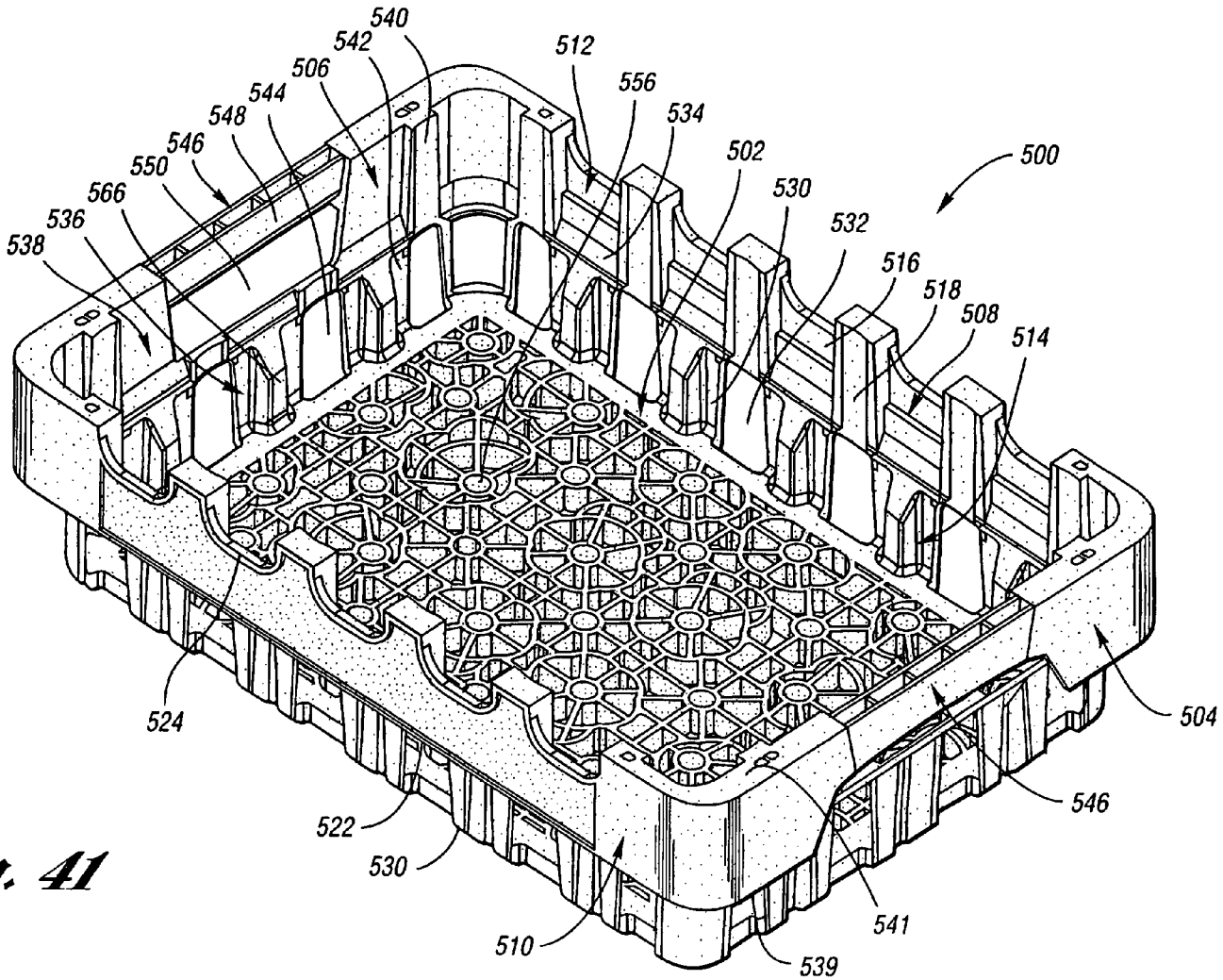
FIG. 41 is a perspective view of a fifth embodiment of a low depth nestable tray according to the present invention.
Figure 42:
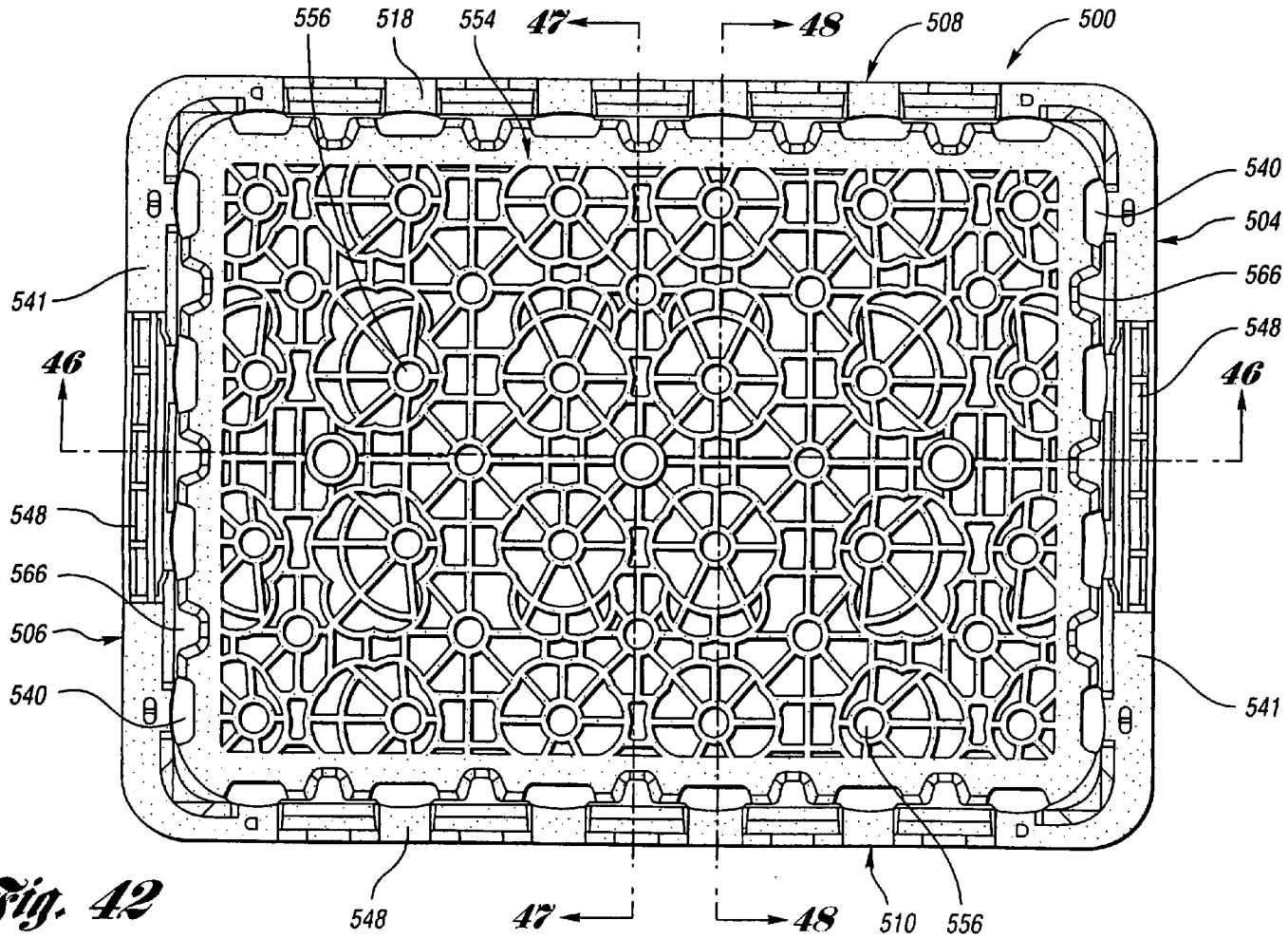
FIG. 42 is a top plan view of the tray of FIG. 41.
Figure 43:
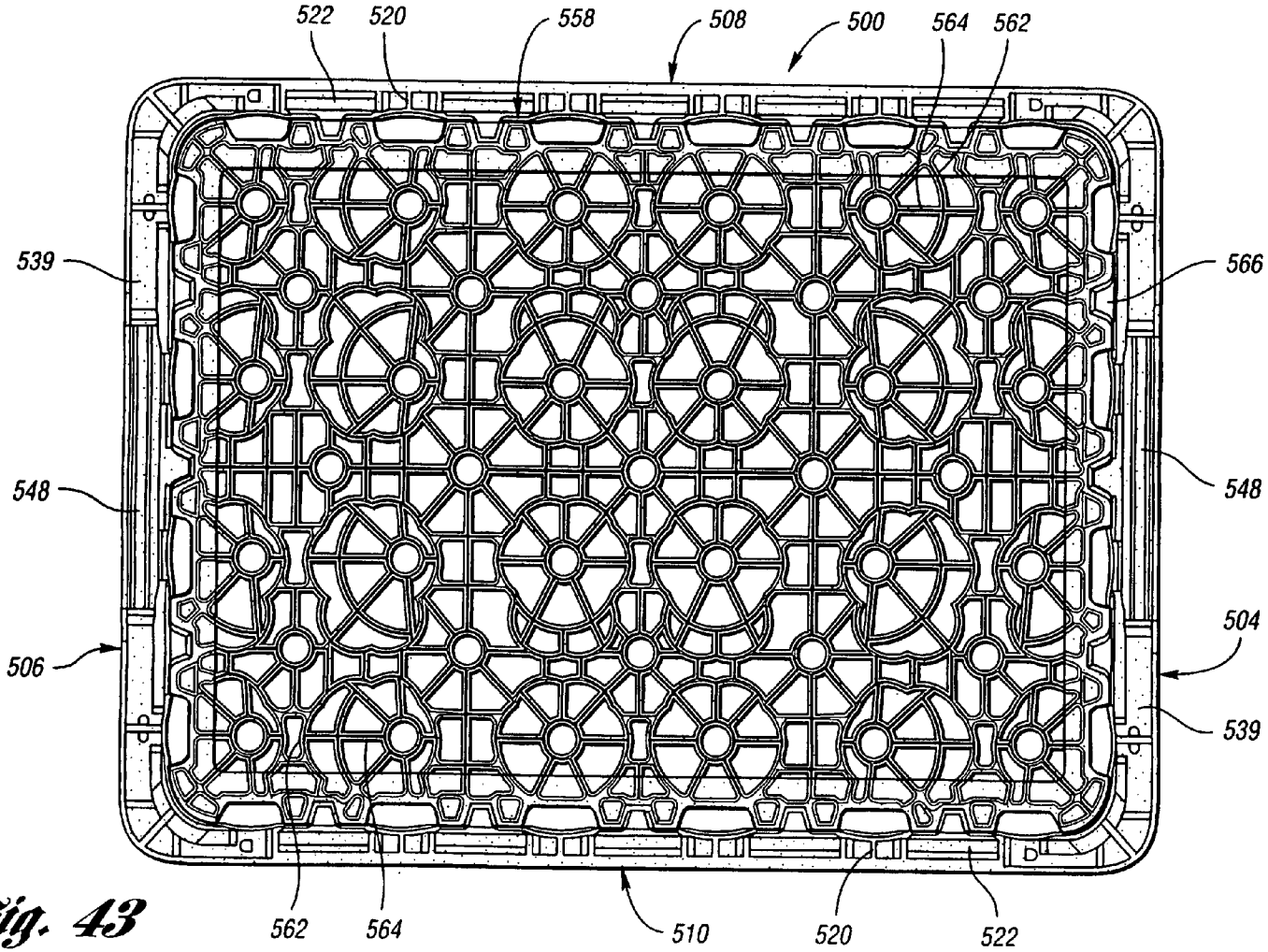
FIG. 43 is a bottom plan view of the tray of FIG. 41.
Figure 44:
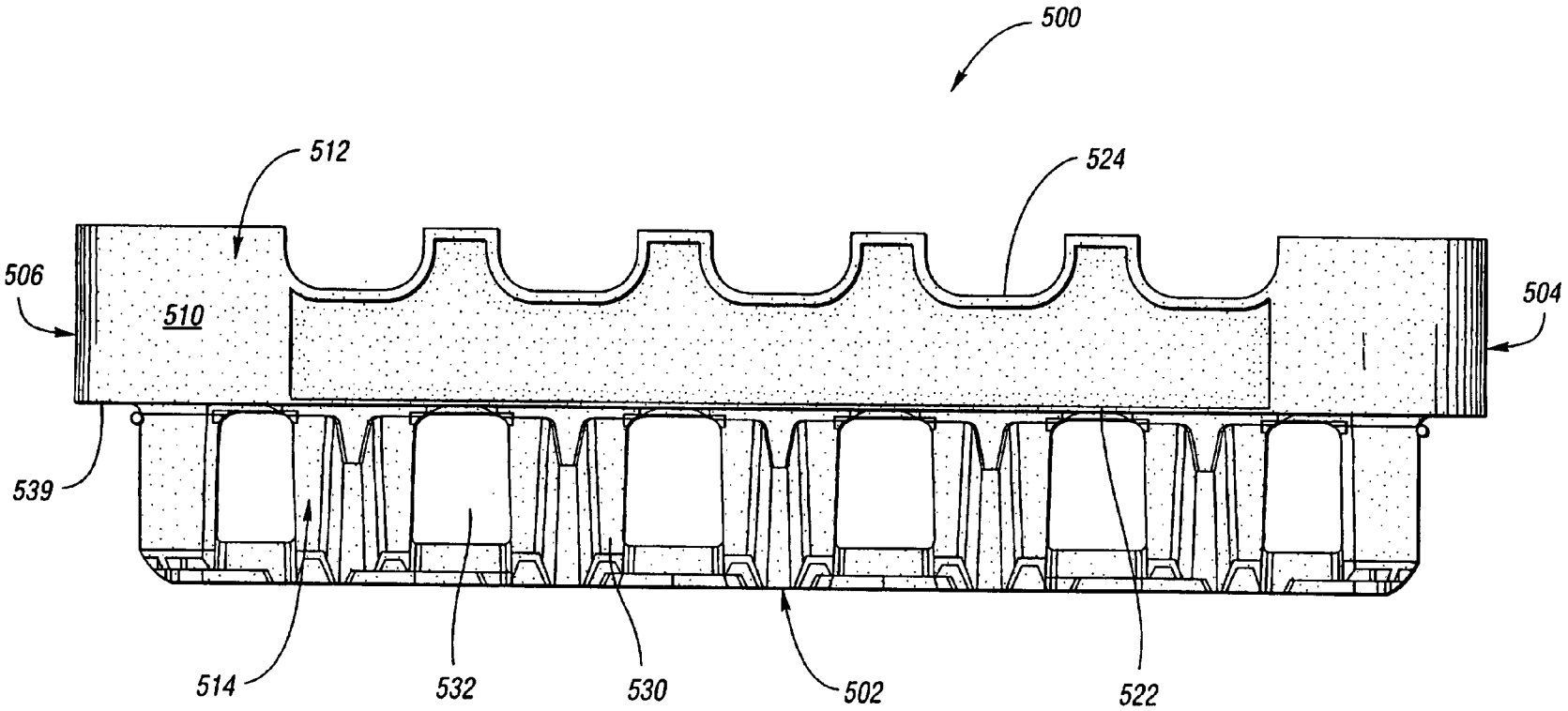
FIG. 44 is a front side elevational view of the tray of FIG. 41, the rear side view being a mirror image thereof.
Figure 45:
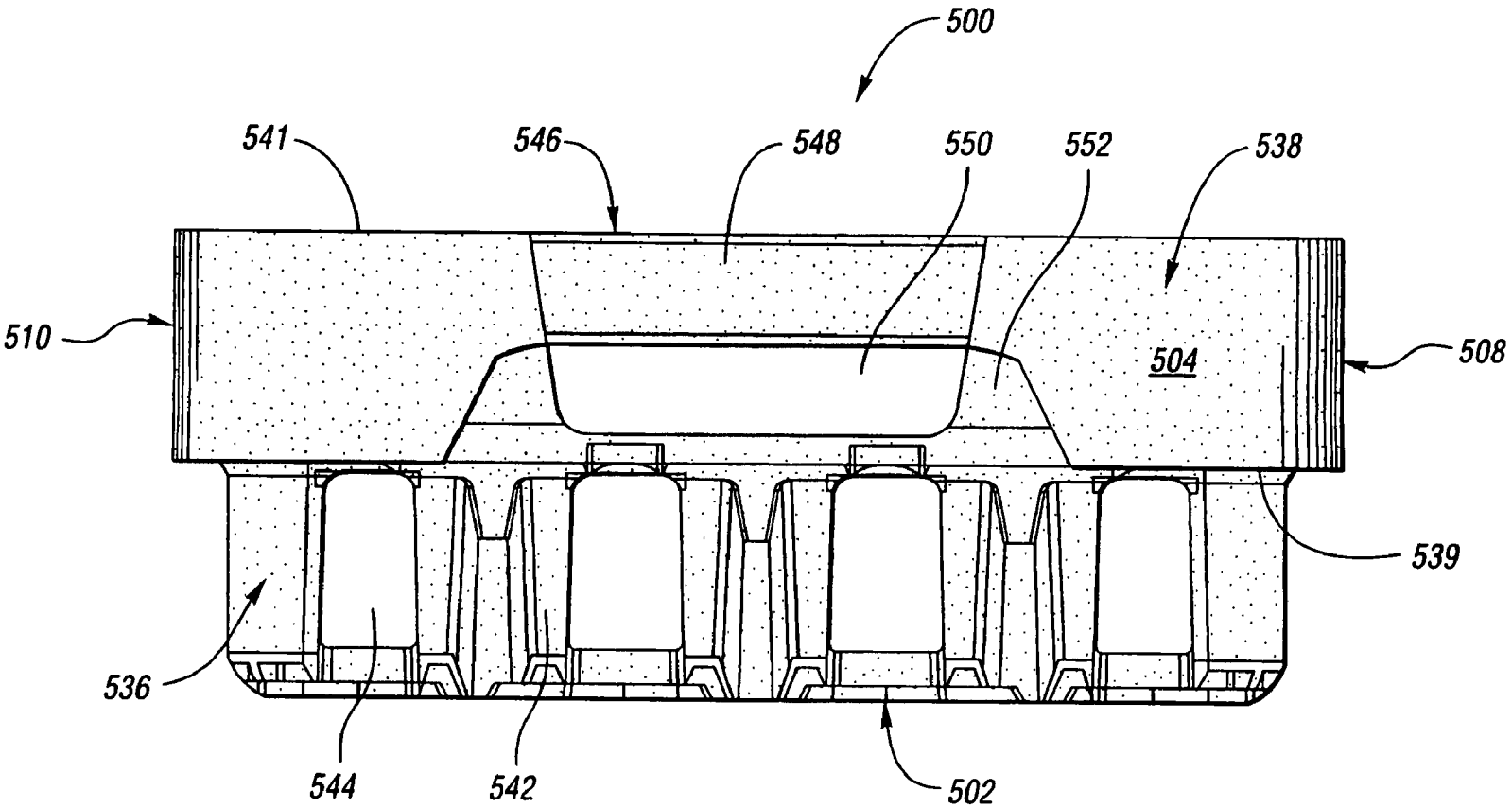
FIG. 45 is a right side elevational view of the tray of FIG. 41, the left side being a mirror image thereof.
Figure 46:
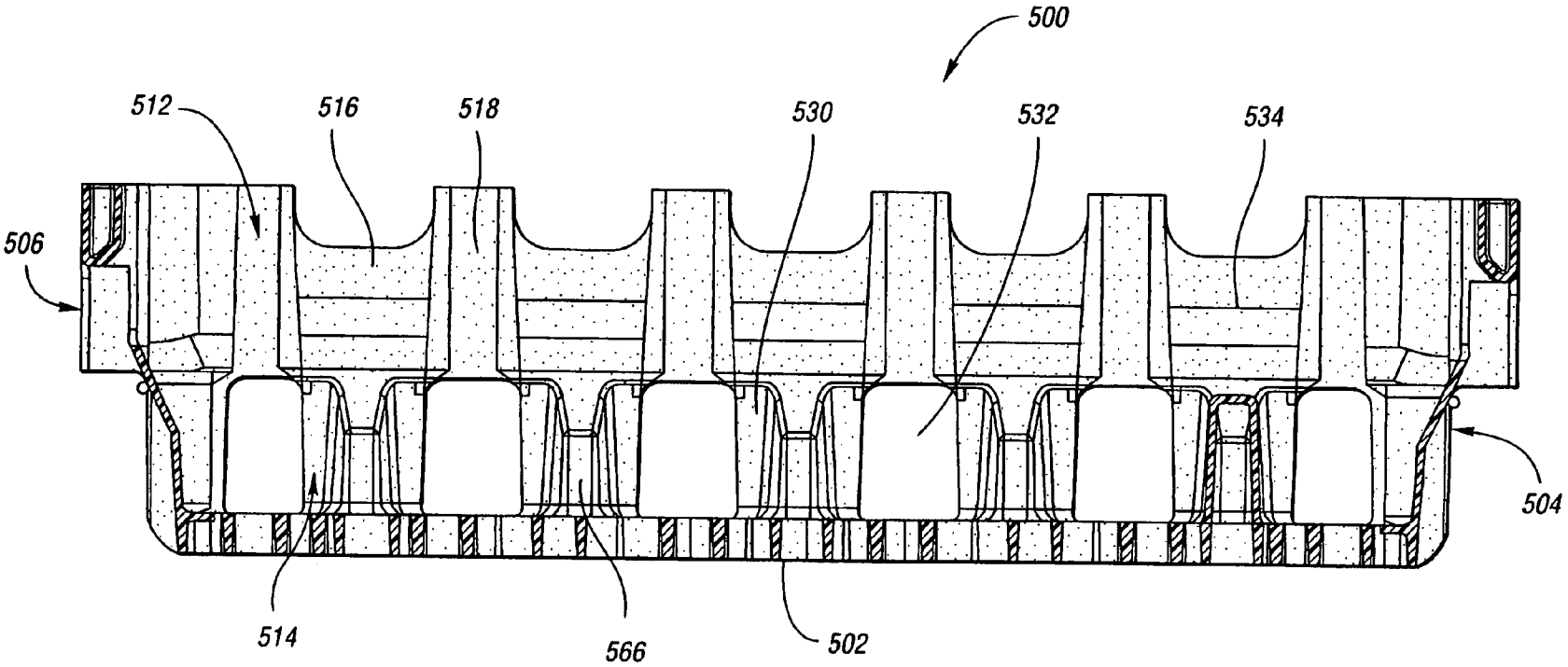
FIG. 46 is a cross-section of the tray taken along line 46—46 of FIG. 42.
Figure 47:
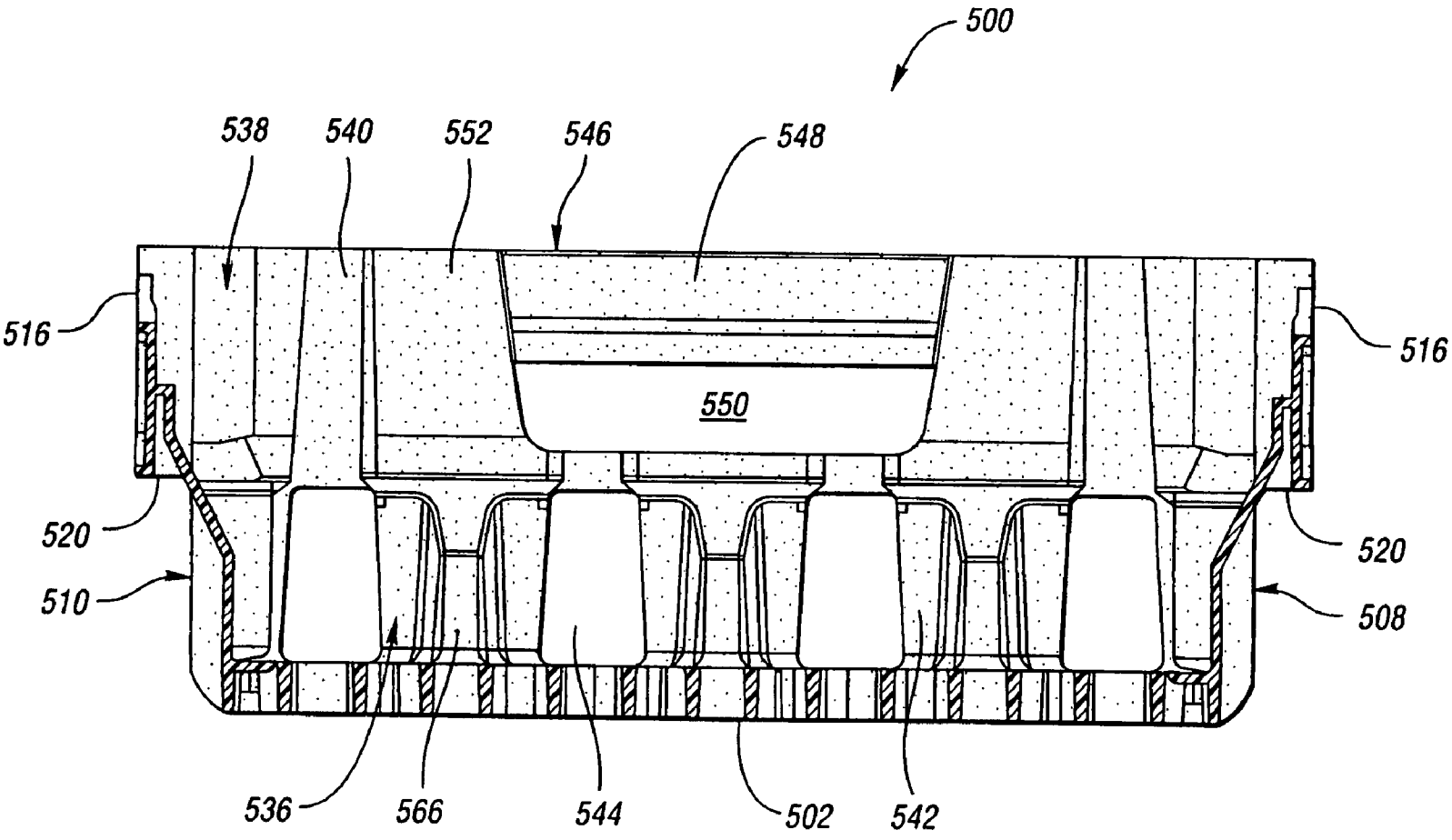
FIG. 47 is a cross-section of the tray taken along line 47—47 of FIG. 42.
Figure 48:
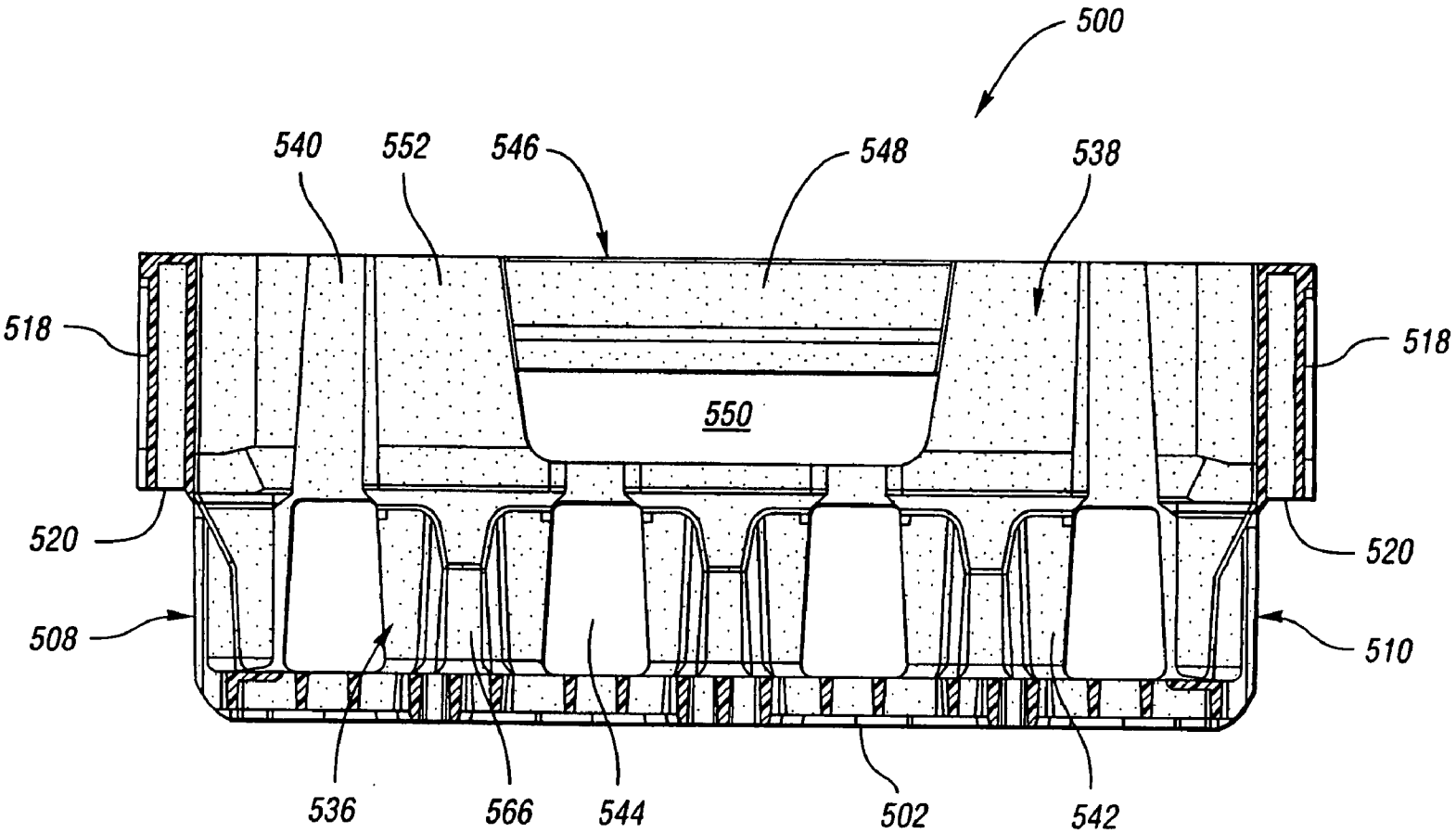
FIG. 48 is a cross-section of the tray taken along line 48—48 of FIG. 42.
Figure 49:
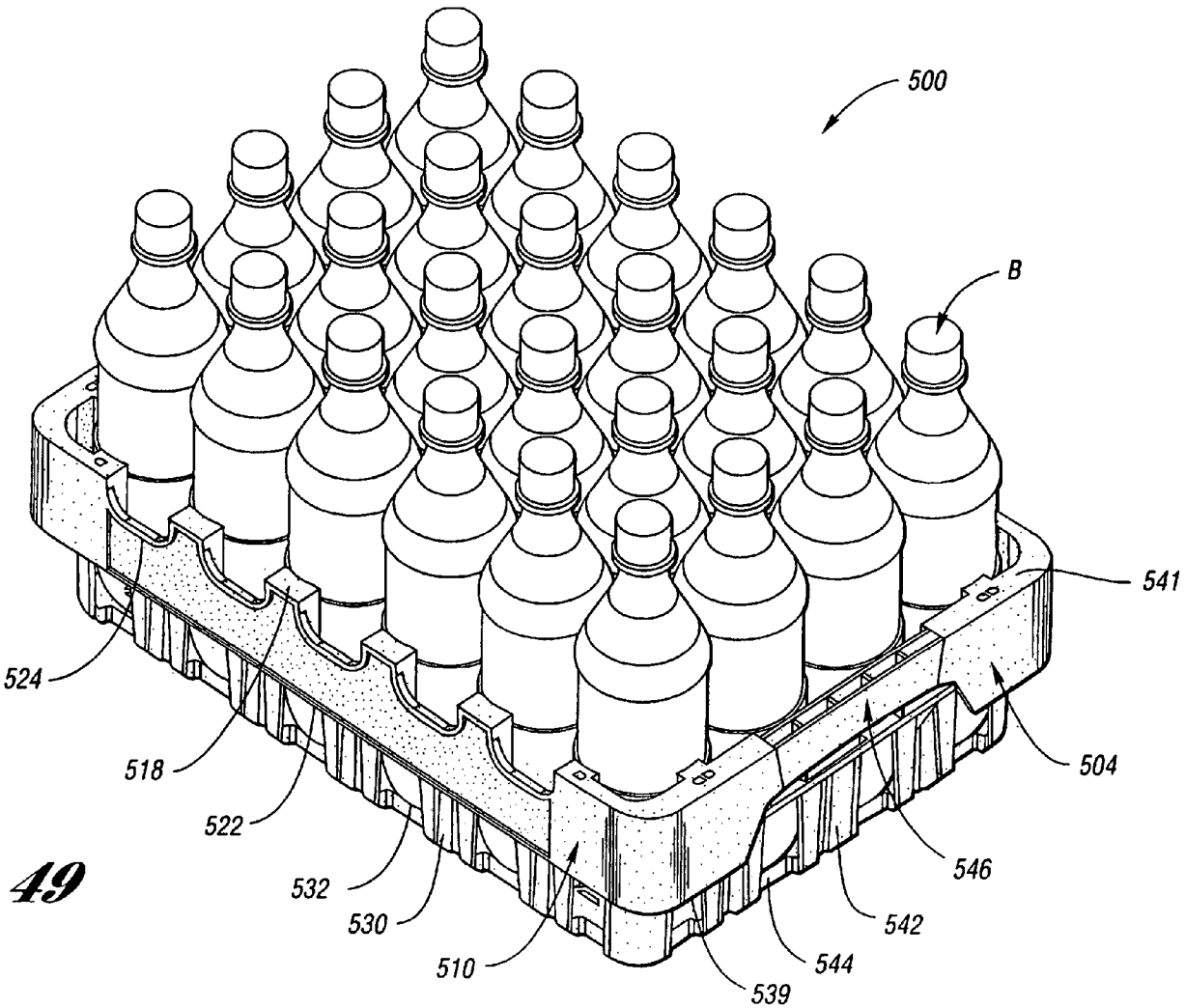
FIG. 49 is a perspective view of the tray of FIG. 41 shown filled with a 4×6 array of fluid containers.
Figure 50:
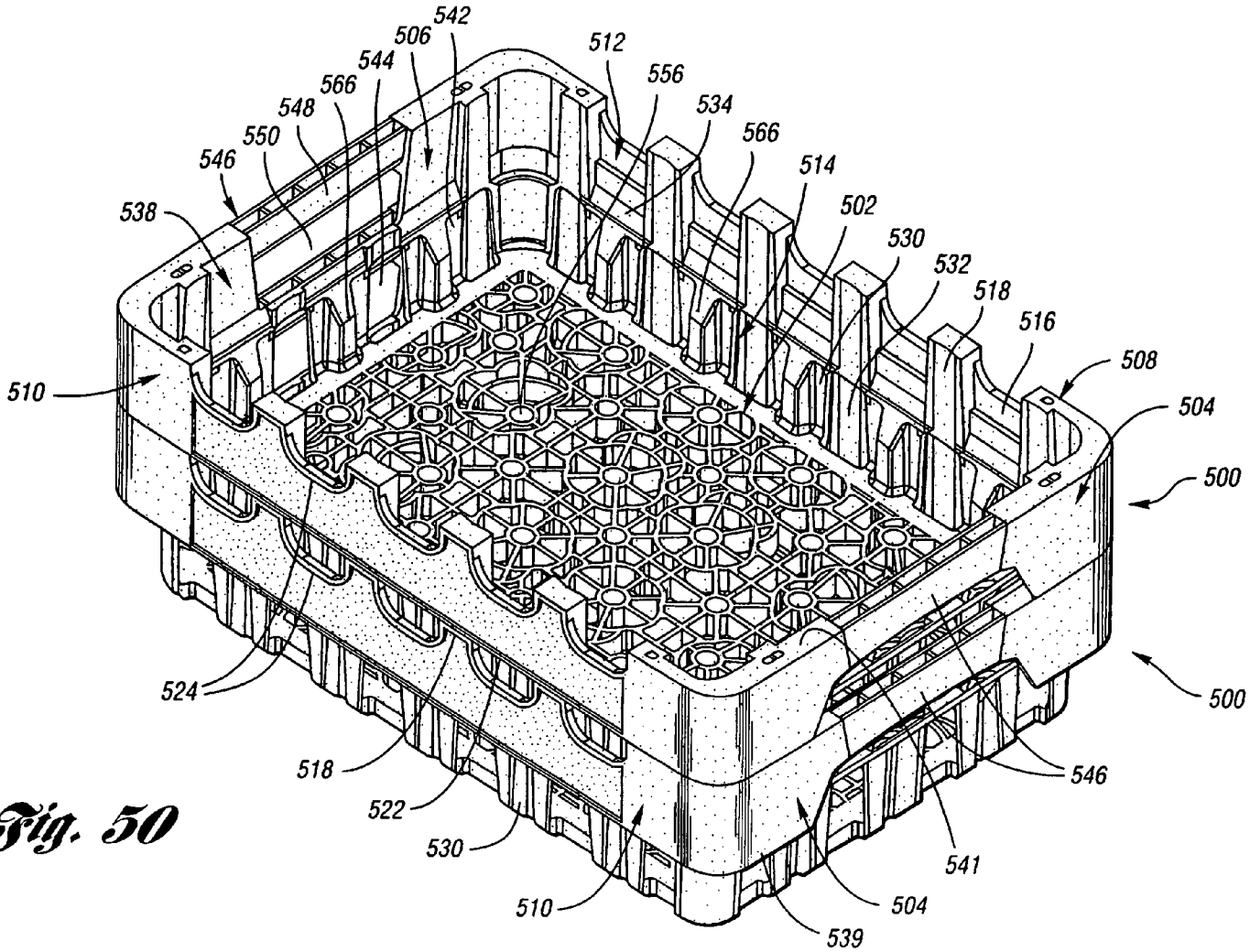
FIG. 50 is a perspective view of the tray of FIG. 41 shown in a nested position with a like tray.
Figure 51:
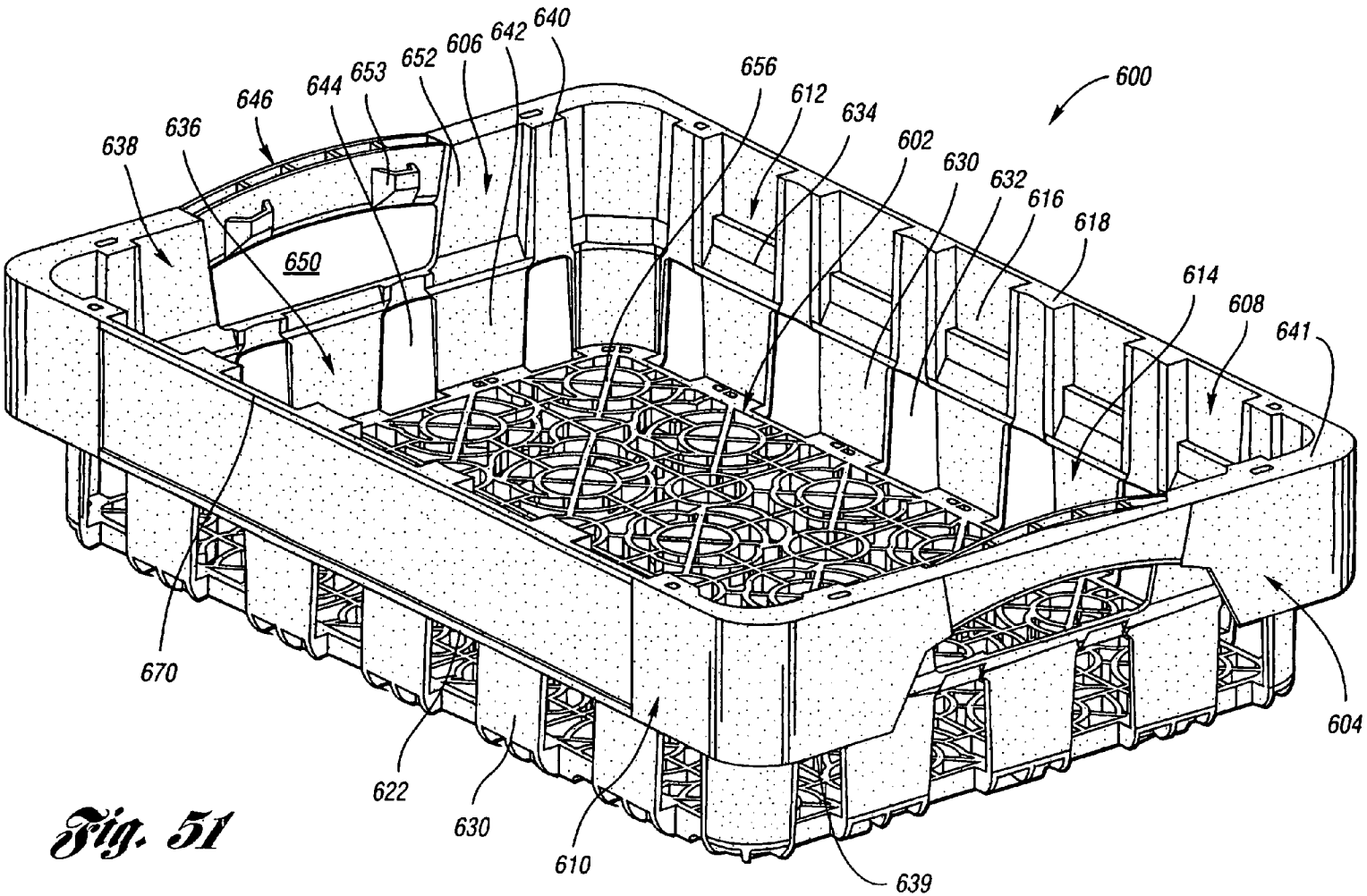
FIG. 51 is a perspective view of a sixth embodiment of a low depth nestable tray according to the present invention.
Figure 52:
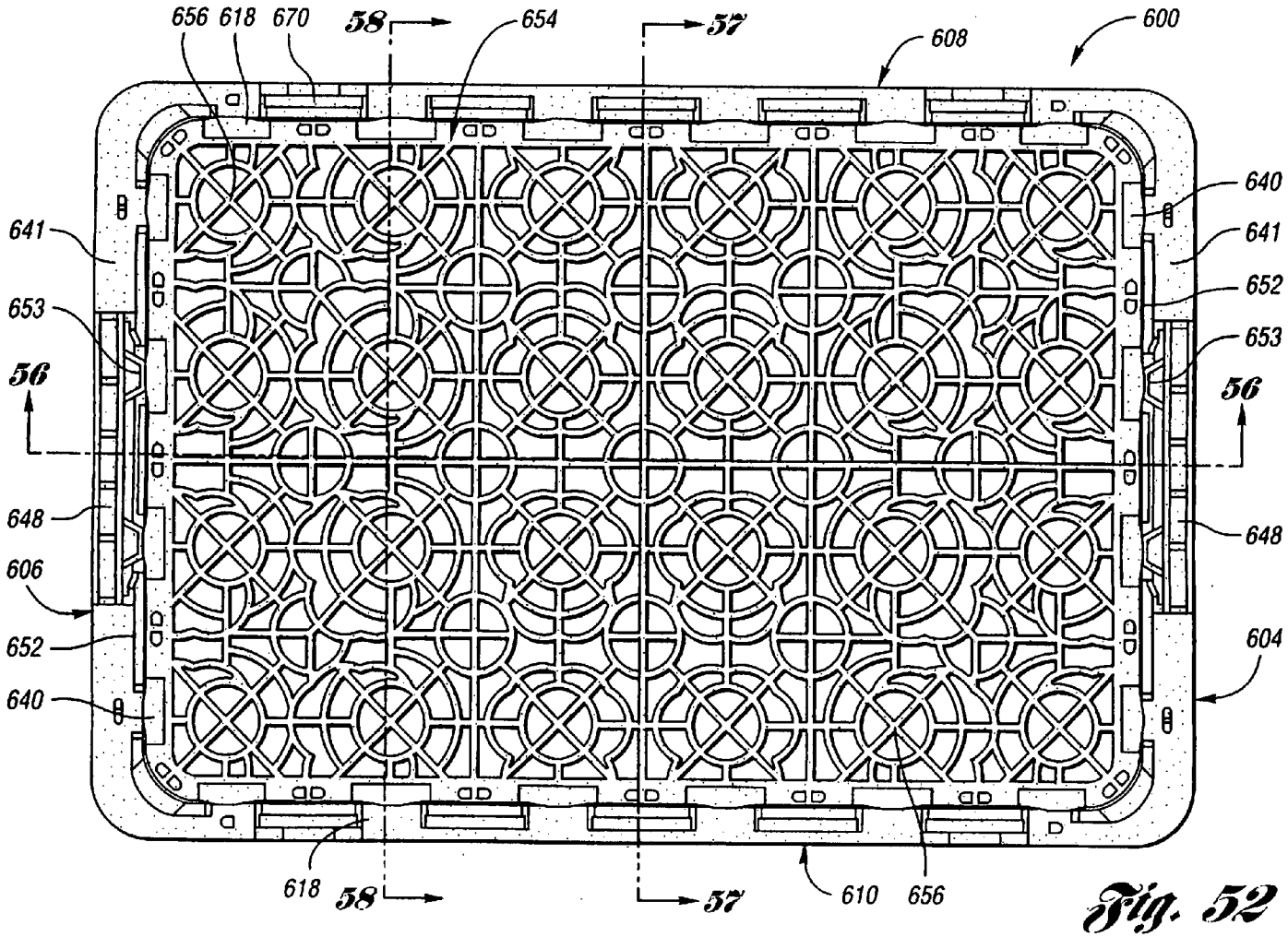
FIG. 52 is a top plan view of the tray of FIG. 51.
Figure 53:
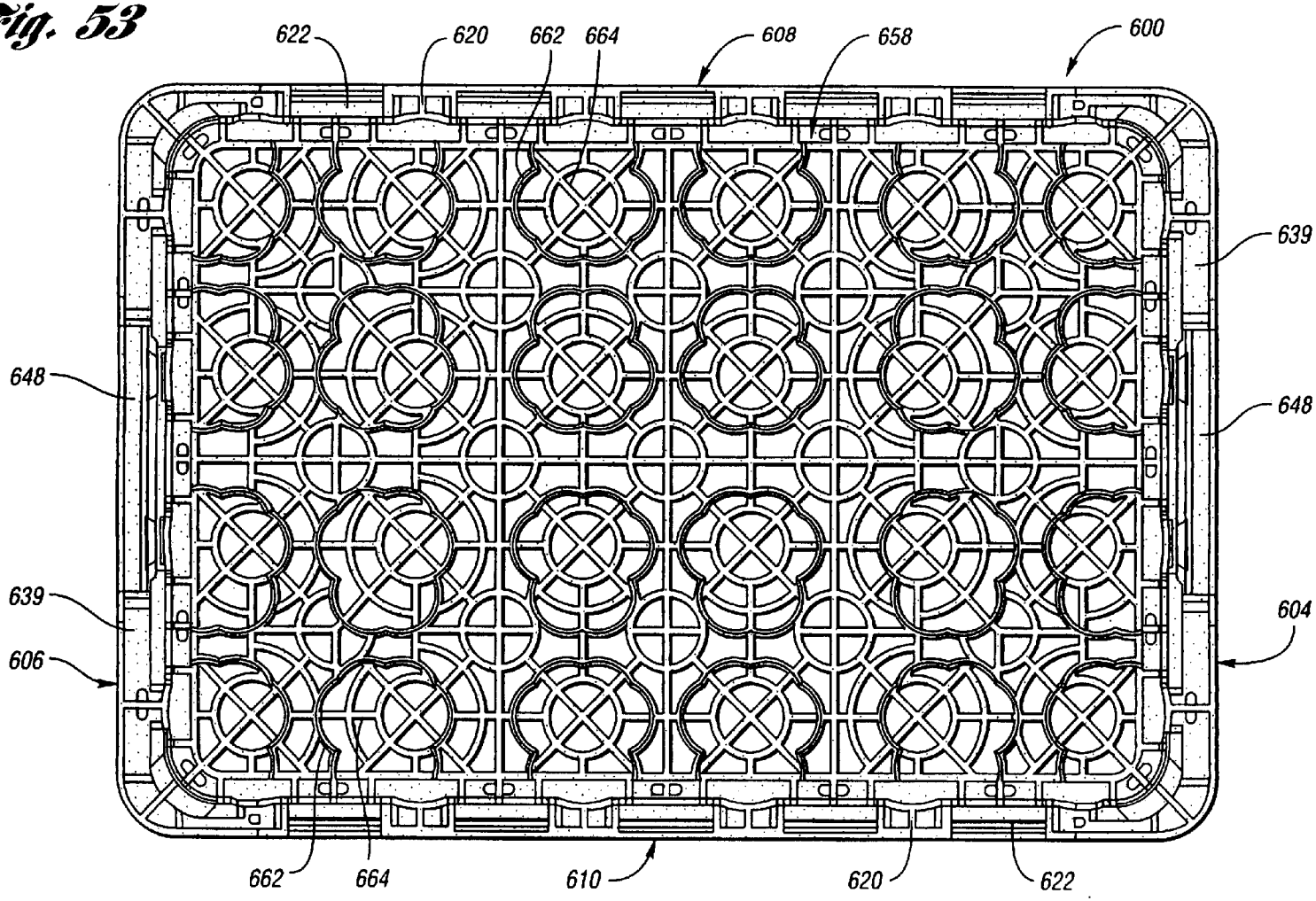
FIG. 53 is a bottom plan view of the tray of FIG. 51.
Figure 54:
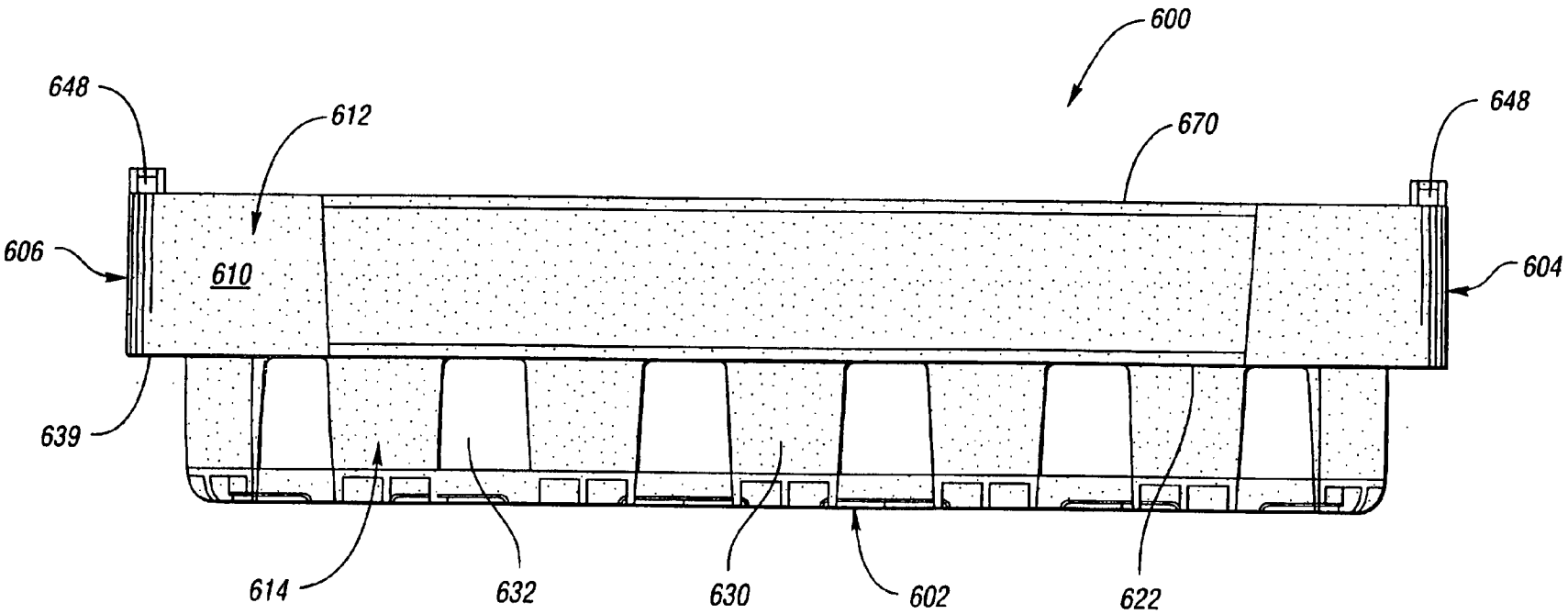
FIG. 54 is a front side elevational view of the tray of FIG. 51, the rear side view being a mirror image thereof.
Figure 55:
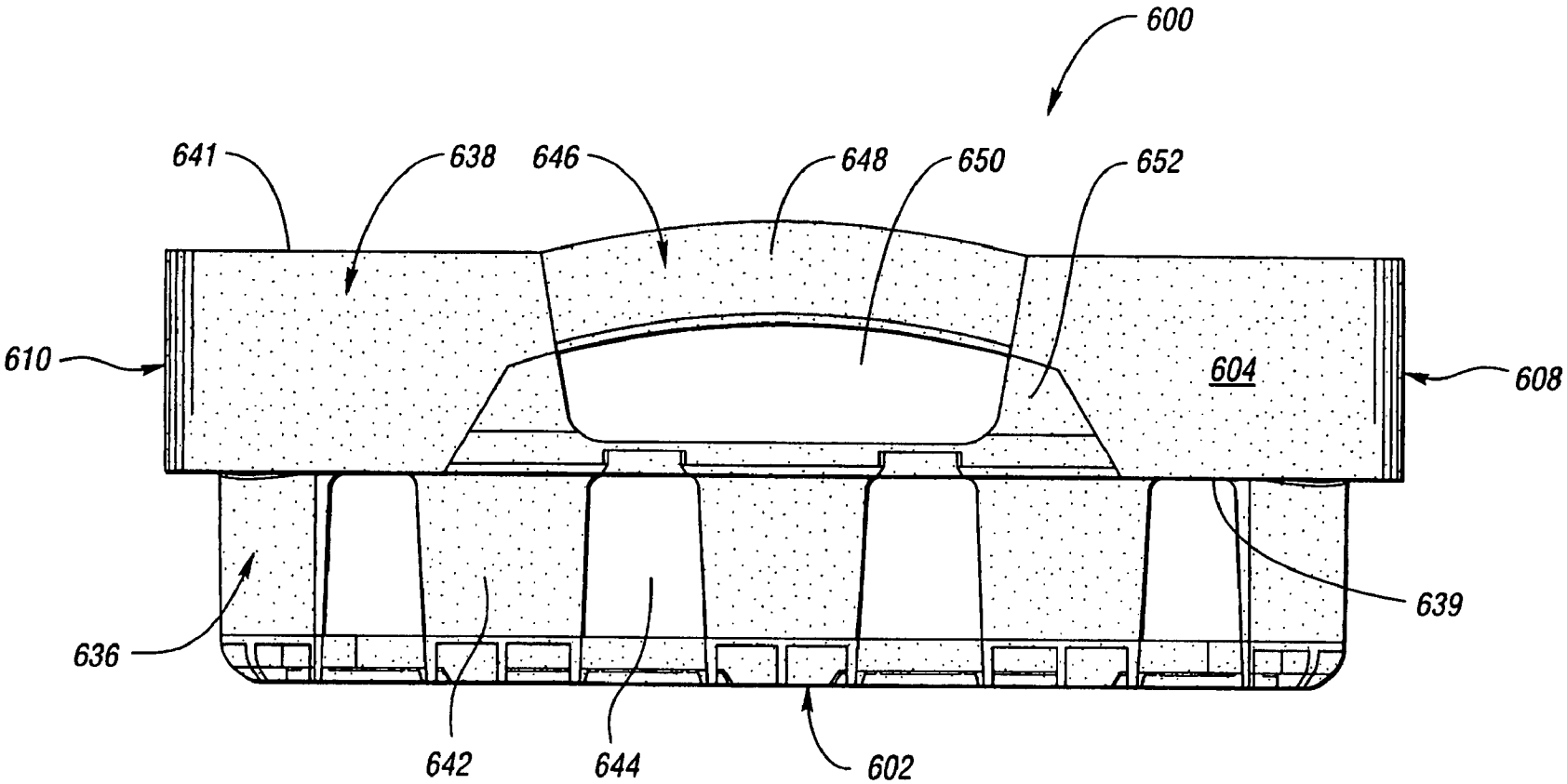
FIG. 55 is a right side elevational view of the tray of FIG. 51, the left side being a mirror image thereof.
Figure 56:
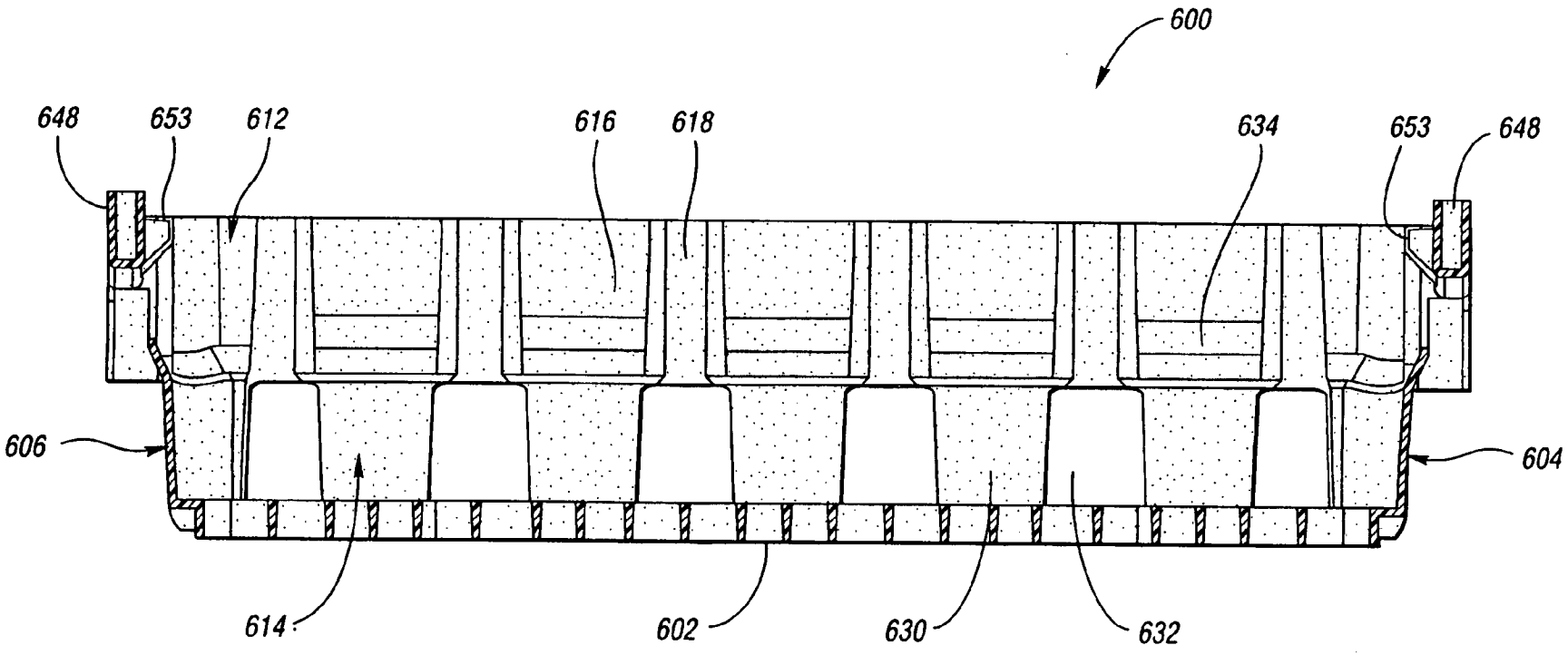
FIG. 56 is a cross-section of the tray taken along line 56—56 of FIG. 52.
Figure 57:
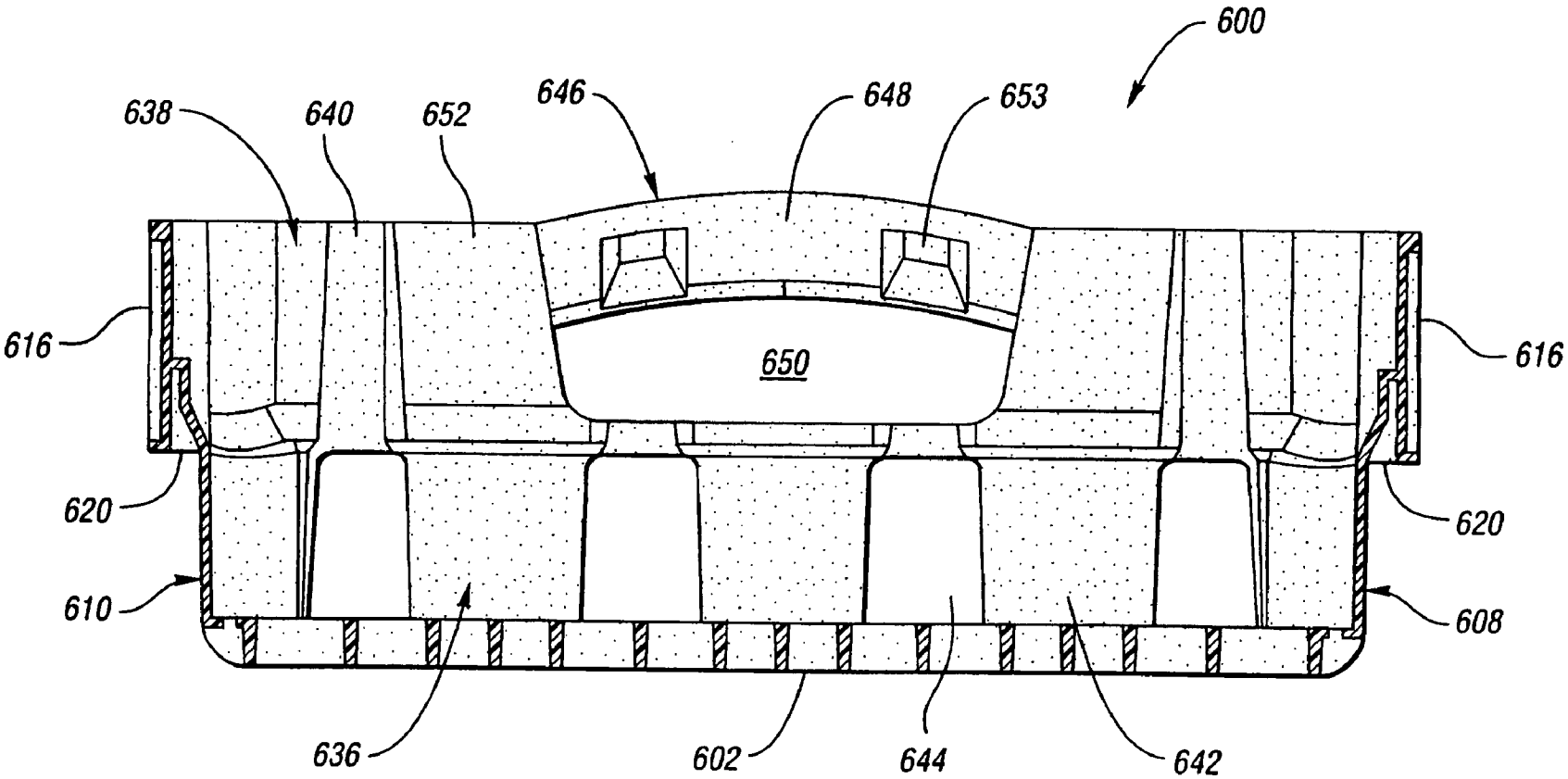
FIG. 57 is a cross-section of the tray taken along line 57—57 of FIG. 52.
Figure 58:
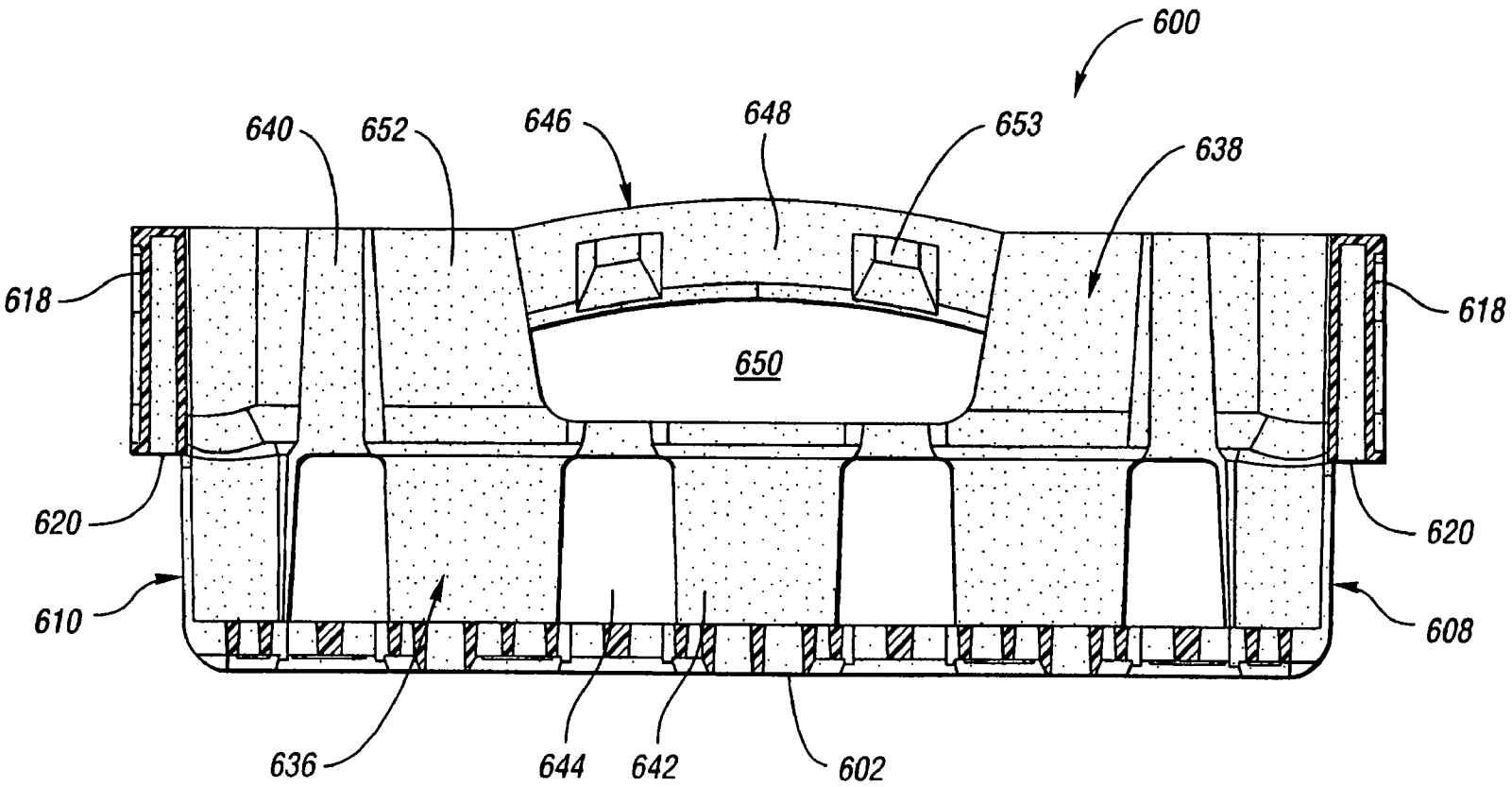
FIG. 58 is a cross-section of the tray taken along line 58—58 of FIG. 52.
Figure 59:
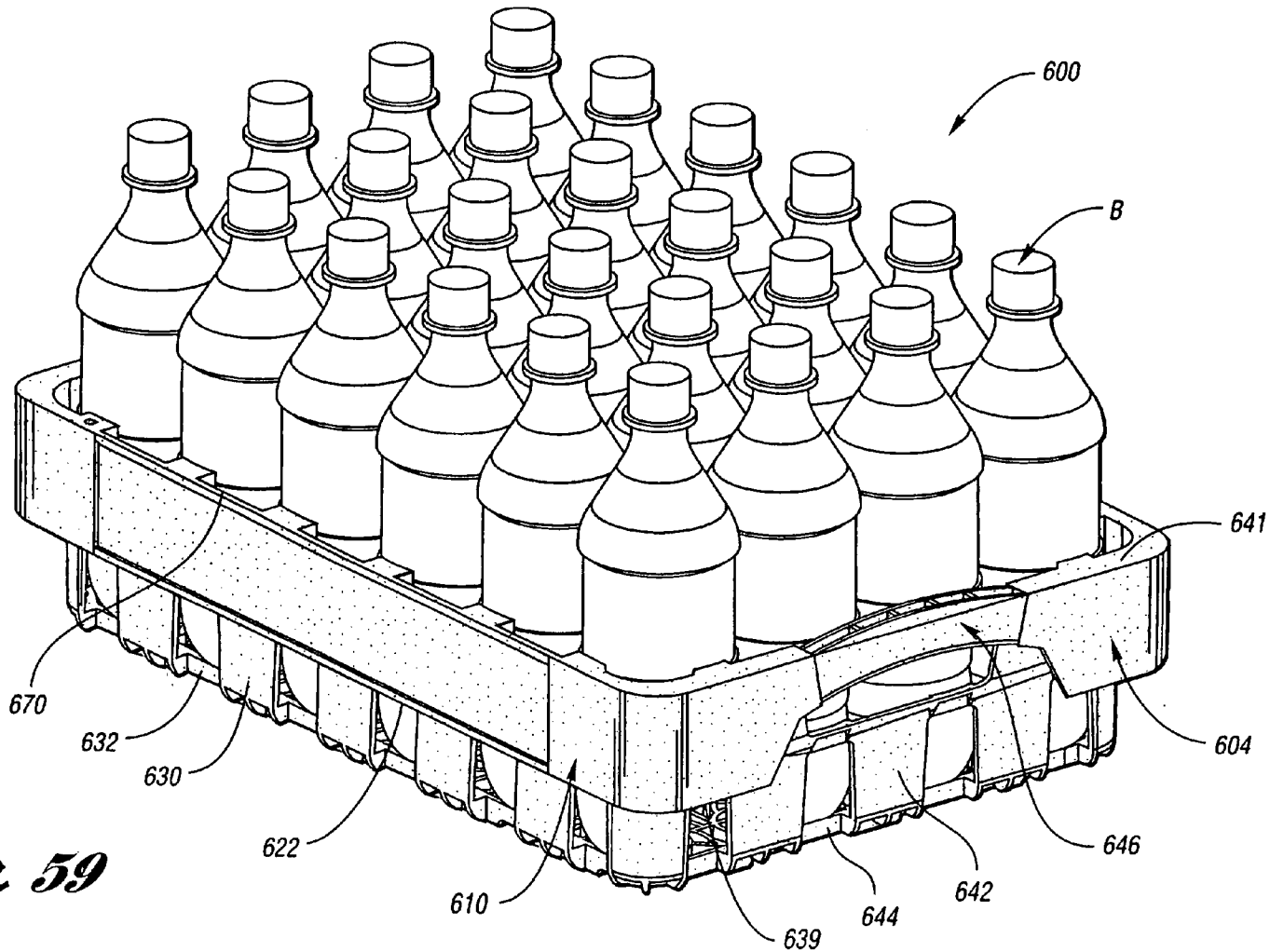
FIG. 59 is a perspective view of the tray of FIG. 51 shown filled with a 4×6 array of fluid containers.
Figure 60:
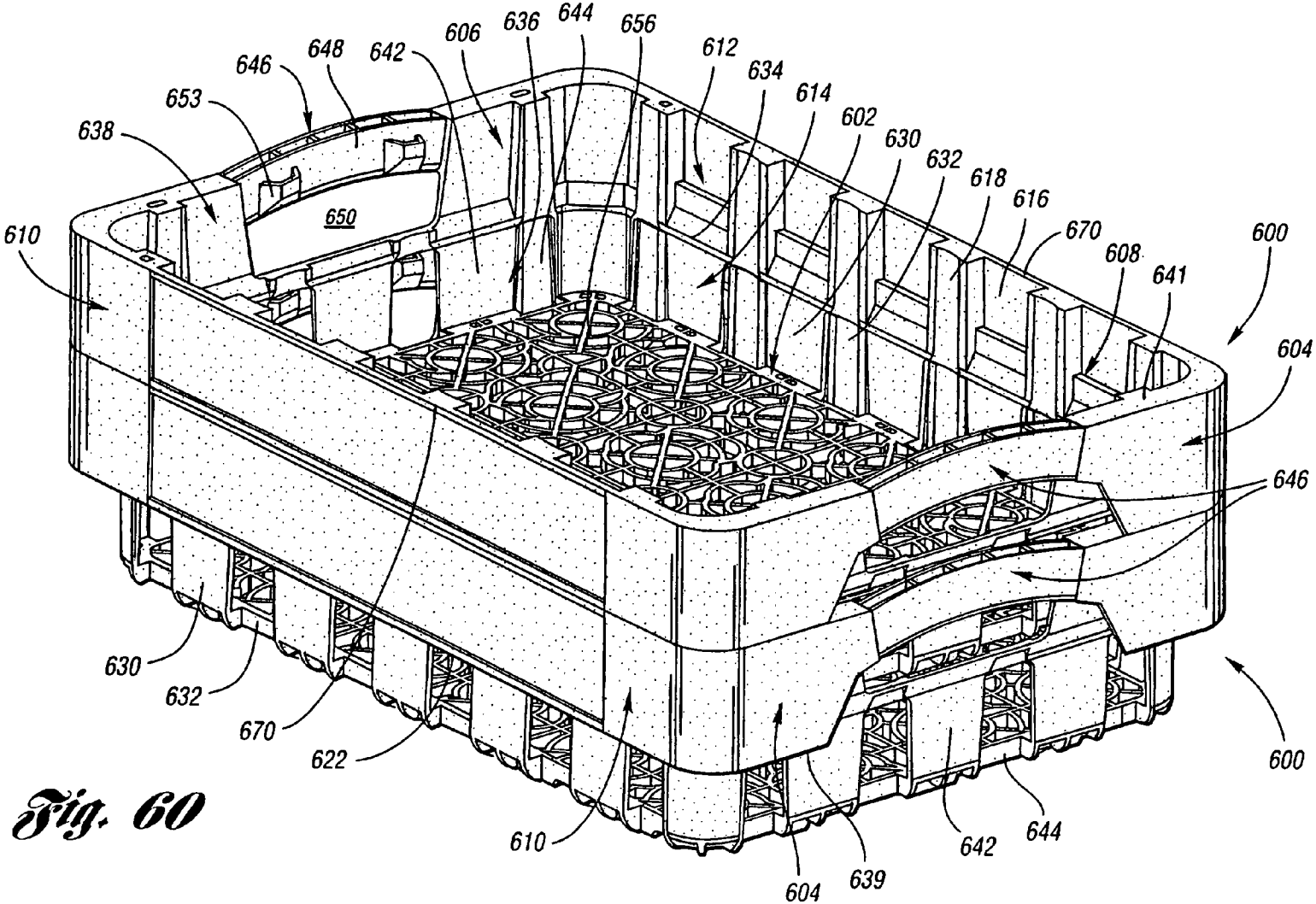
FIG. 60 is a perspective view of the tray of FIG. 51 shown in a nested position with a like tray.

With particular reference to FIGS. 1, 4, 6, and 7, side walls 108, 110 are described below in greater detail. Side walls 108, 110 each include an upper side wall portion 112 and a lower side wall portion 114. In contrast to prior art low depth trays, upper side wall portion 112 of tray 100 need not include a continuous double wall. Instead, upper side wall portion 112 includes first areas having a single-walled construction and second areas having a double-walled construction. In a preferred embodiment, the first areas include upper side wall panels 116 and the second areas include side wall columns 118 for providing lateral support to fluid containers loaded in tray 100 (as shown in FIG. 10). Side wall columns 118 are preferably hollow between exterior 119 and interior 121 column walls thereof. Interior column wall 121 can be generally concave, or can alternatively be substantially flat. Interior column wall 121 may also include inwardly extending portions (for example, see portions 323 of FIG. 21.) Of course, interior columns walls 121 may function to provide support to bottles B without including exterior column walls 119. In such an embodiment, upper side wall portion 112 would have a generally single-walled construction. Side wall columns 118 also include ribs 120 integrally formed therein which partially define a lower side edge 122 of side walls 108, 110, as best shown in FIGS. 3, 8, and 9.

Figure 1:
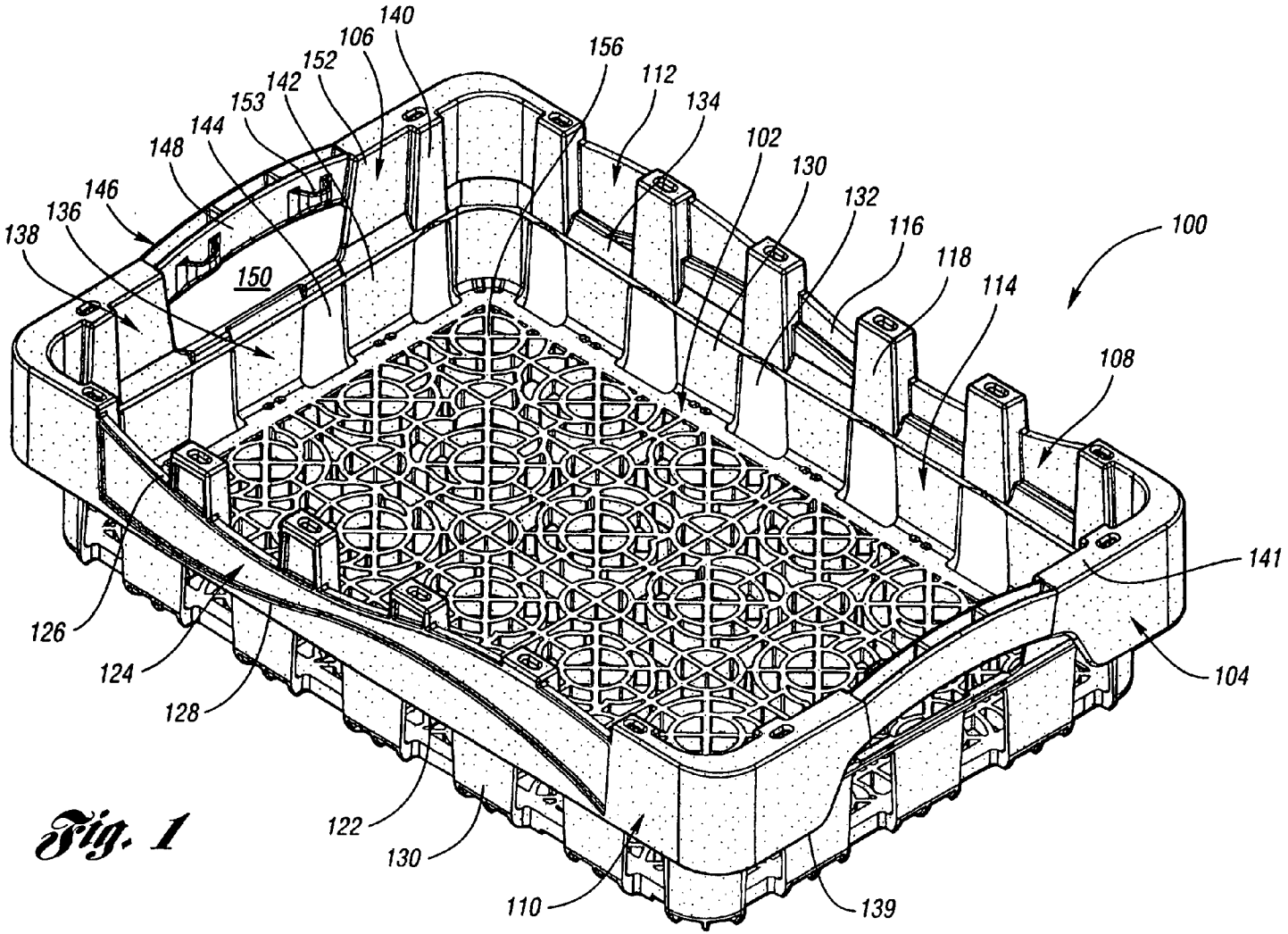
FIG. 1 of the drawings is a perspective view of a first embodiment of a low depth nestable tray according to the present invention.
Figure 6:
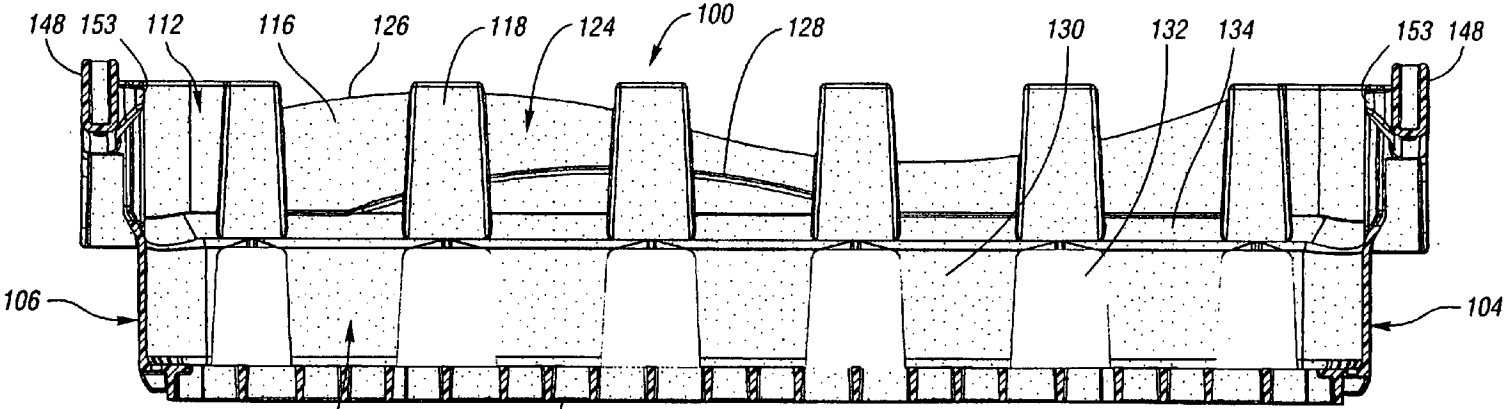
FIG. 6 is a cross-section of the tray taken along line 6—6 of FIG. 2.
Figure 7:
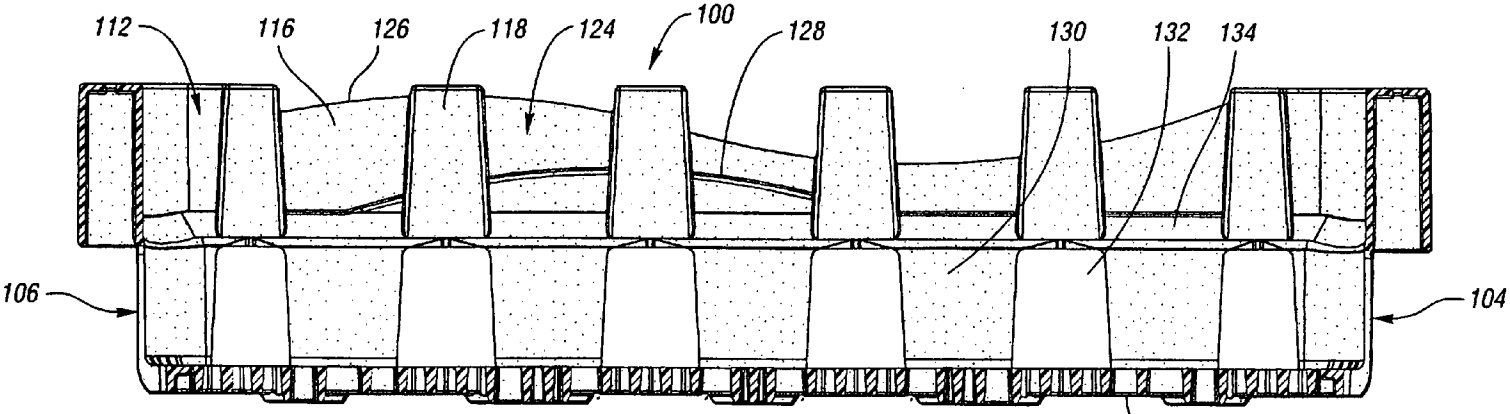
FIG. 7 is a cross-section of the tray taken along line 7—7 of FIG. 2.

Upper side wall portion 112 includes an alternating arrangement of upper side wall panels 116 and side wall columns 118, as best shown in the perspective view of FIG. 1 and the cross-sectional views of FIGS. 6 and 7. Upper side wall panels 116 are also lower in height than side wall columns 118. This configuration allows for greater display of bottles stored within tray 100. Advantageously, the single-walled construction of upper side wall panels 116 allows greater manufacturing tolerance for nesting with similar trays. In addition, this construction decreases the overall weight of tray 100. Since side wall columns 118 are of double walled construction, tray 100 maintains the requisite strength and rigidity for transport and handling.

Upper side wall portion 112 of at least one of side walls 108, 110 may include a contour 124. For the first embodiment of tray 100, contour 124 is wave-like in appearance, as best shown in FIGS. 1, 4, 6, and 7. Contour 124 forms a structural component of upper side wall portion 112 having an upper contour edge 126 and a lower contour edge 128. Contour 124 may be included on both the interior and exterior upper side wall portions 112, or alternatively just the exterior may be used.

For use of automated palletizing equipment, such as the Tygard Claw, it is beneficial to have the largest footprint dimension of a tray at its topmost edge. Side walls 118, 120 of tray 100 of the present invention taper from top to bottom, rather than from bottom to top as in some prior art trays. When the Tygard Claw attempts to pick of a layer of trays by engaging the outer trays, this downward taper prevents trays in the middle of a pallet layer from falling out. Therefore, the configuration of upper side wall portion 112 improves the transport and handling of tray 100 of the present invention by automated equipment.

Still referring to FIGS. 1, 4, 6, and 7, lower side wall portion 114 is integrally formed between upper side wall portion 112 and base 102. In the embodiment shown, lower side wall portion 114 includes an alternating arrangement of substantially flat lower side wall panels 130 extending upwardly from base 102 and cutout portions 132. In a preferred embodiment, upper side wall portion 112 includes a double-walled transition area 134 immediately above lower side wall panels 130, as best shown in FIGS. 1, 6, and 7. Cutout portions 132 are preferably disposed directly vertically beneath the corresponding side wall columns 118 such that the typically bulbous bottoms of the bottles can protrude through cutout portions 132, allowing for the tray dimensions to be optimized to the number of bottles carried. Cutout portions 132 also further reduce the weight of tray 100. Preferably, lower side wall panels 130 are single walled such that the weight of tray 100 is again minimized. Although not shown herein, lower side wall portions could alternatively be double-walled or have a continuous solid wall construction.

Referring now to FIGS. 1, 5, 8, and 9, end walls 104, 106 will now be described. End walls 104, 106 are generally symmetric and each include a lower end wall portion 136 and an upper end wall portion 138, wherein upper end wall portion 138 has a lower end edge 139 continuous with lower side edge 122. However, unlike upper side wall portions 112, upper end wall portions 138 preferably have a double-wall material thickness for added strength. Of course, upper end wall portion 138 could alternatively have a single-walled construction. Upper end wall portion 138 preferably includes end wall panels 152 provided adjacent to end wall columns 140 which provide lateral support to fluid containers loaded in tray 100. As shown, end wall panels 152 and end wall columns 140 are preferably of the same height to provide a continuous upper end edge 141. Lower end wall portion 136 preferably includes an alternating arrangement of lower end wall panels 142 extending upwardly from base 102 and cutout portions 144. The structure and function of end wall columns 140, lower end wall panels 142, and cutout portions 144 of end walls 104, 106 is substantially similar to side wall columns 118, lower side wall panels 130, and cutout portions 132, respectively, described above with reference to side walls 108, 110.

Referring again to FIGS. 1, 5, 8, and 9, end walls 104, 106 further include handle portions 146 which are integrally molded therein to facilitate carrying tray 100. Each handle portion 146 includes a top bar 148, which together with lower end wall portion 142 defines a handle opening or slot 150 through which a user can extend his/her hand. Top bar 148 is supported by end wall panels 152, and top bar 148 is preferably outwardly offset from end wall panels 152 to enhance hand clearance when the tray is filled with bottles. In the embodiment of tray 100 shown in FIGS. 1–10, top bar 148 has an arcuate shape and protrudes above upper end edge 141. With this design, top bar 148 prohibit tray 100 from lying flat if turned upside down, thereby deterring the misuse of trays 100. Furthermore, top bar 148 includes at least one inwardly extending projection 153 to provide additional lateral support to fluid containers loaded in tray 100. Still further, supports 155 are located beneath slot 150 on lower end wall portion 142 in general alignment with projections 153 to further support bottles B. Both projections 153 and supports 155 can be either substantially flat or, alternatively, be generally concave. Handle portions 146 or an alternate handle configuration may be provided on side walls 108, 110 in addition to end walls 104, 106 such that a gripping structure is disposed on each side of tray 100.

In handling a loaded tray, the palm-up position refers to the position of a user's hands when the fingers are wrapped under top bar 148 from the outside of tray 100. The palm-down position refers to the position of a user's hands when the fingers are wrapped over top bar 148 from the outside of tray 100. The height of top bar 148 and the width of slot 150 ensure that a user's hand has sufficient clearance to grasp top bar 148 in either the palm-up or palm-down positions. Providing a user with the option of handling tray 100 in either hand position helps alleviate fatigue and prevent hand-wrist injuries since a natural grasping motion can be used. The importance of this feature can be appreciated when tray 100 is loaded with bottles B, as shown in FIG. 10.

When trays 100 are nested, lower side edge 122 of an upper tray rests against the top surfaces of side wall columns 118 of a lower tray (see FIGS. 30, 40, 50, and 60). Furthermore, lower end edge 139 of an upper tray rests against upper end edge 141 of a lower tray. Side wall columns 118 are generally aligned with cutout portions 132 of an upper tray, and end wall columns 140 are generally aligned with cutout portions 144 of an upper tray. Therefore, lower side wall panels 130 of an upper tray are received generally between side wall columns 118 of a lower tray to nest within the corresponding upper side walls panels 116.

Figure 2:
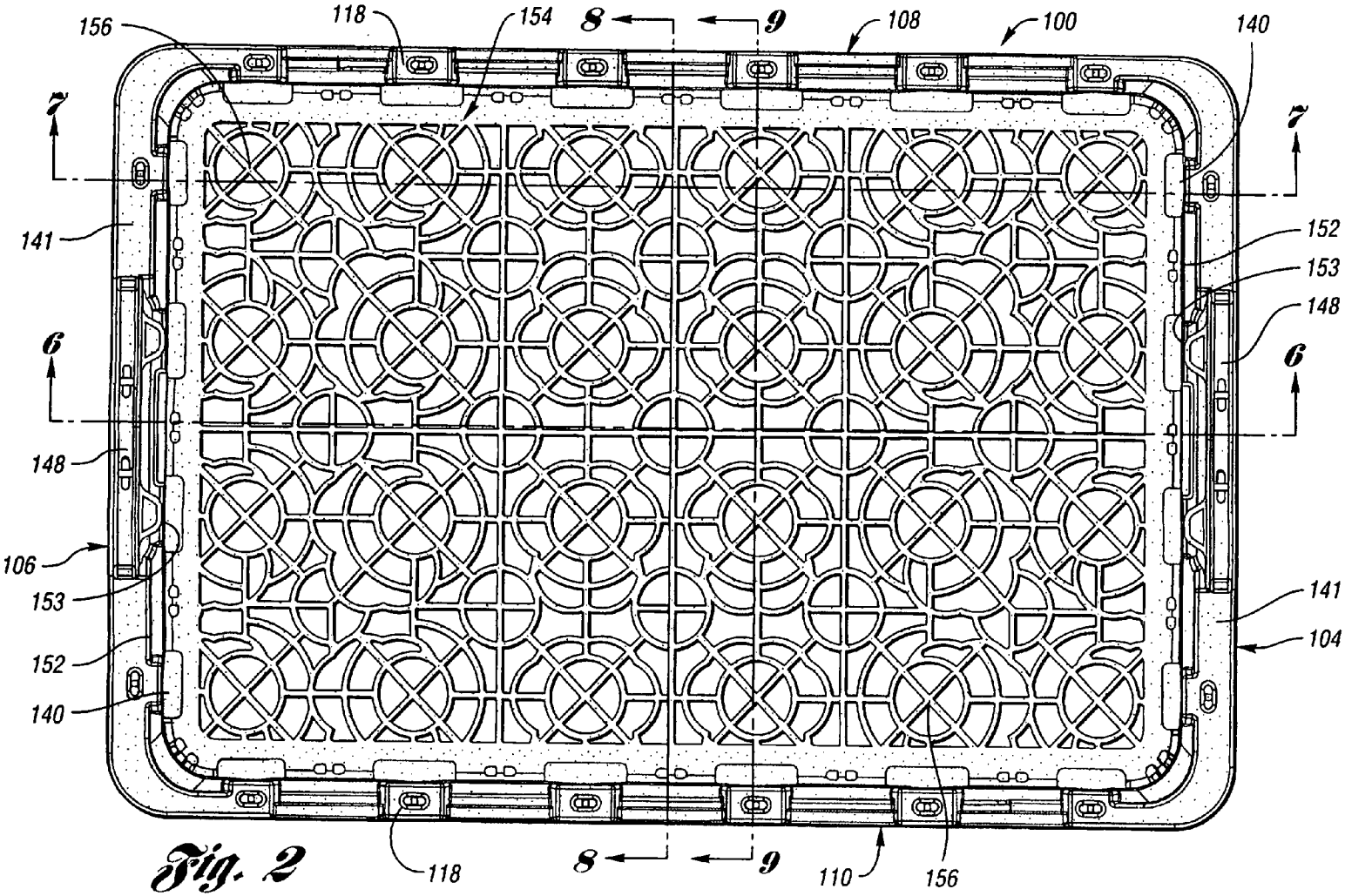
FIG. 2 is a top plan view of the tray of FIG. 1.

As best shown in the top and bottom plan view of FIGS. 2 and 3, respectively, base 102 is preferably constructed to have a lattice-like configuration having a pattern of open spaces. This open gridwork design of base 102 provides a lightweight tray 100, and is practical for allowing any liquids to drain through base 102. Of course, base 102 could include any design suitable for supporting fluid containers.

With reference to FIGS. 1 and 2, base 102 has a top surface 154 which includes a plurality of fluid container support areas 156 for supporting bottles thereon. Support areas 156 are configured so that bottles are retained in relatively close relation to provide lateral support to one another and to prevent jostling of the bottles during handling. Excess movement of the bottles is to be avoided in order to ensure that the bottles remain in a vertically upright position to most advantageously bear the load of bottles stacked or cross-stacked above. Support areas 156 are arranged in rows and columns to thereby define one or more arrays. In tray 100, a four-by-six array of support areas 156 accommodates twenty-four individual twenty-ounce bottles. Of course, depending on the desired container size/volume, trays according to the present invention may be designed to hold arrays of varying sizes.

As shown in FIGS. 1 and 2, base top surface 154 is preferably substantially flat in order to accommodate a variety of bottles. More particularly, a flat top surface 154 permits retention of bottles regardless of the configuration of their lower surface, and also allows bottles of all types to be rotated with respect to fluid container support areas 156 to facilitate display of the product. Alternatively, base top surface 154 can be formed with small depressions (not shown) corresponding to the locations and configurations of the bottoms of the bottles to be supported at each of the support areas 156.

As best shown in the bottom plan view of FIG. 3, base 102 has a bottom surface 158 which is configured to allow for stacking and cross-stacking (not shown) of loaded trays 100. Cross-stacking is done by rotating a top tray 90 degrees about a vertical axis and lowering it onto a bottom tray or trays. Base bottom surface 158 is formed as a plurality of upwardly recessed receiving areas 160 sized to receive the bottle top of a bottle which is disposed in a lower tray. Receiving areas 160 are defined by a downwardly extending periphery 162 and a plurality of interconnected ribs 164. Each periphery 162 is positioned to provide a range within which the bottle tops in a loaded lower tray may reside and still provide safe stacking and cross-stacking. Therefore, receiving areas 160 retain the loaded trays in a stacked arrangement without free sliding along the tops of the bottles in the lower trays. Once the bottle tops are disengaged from receiving areas 160 (i.e., their stacked or cross-stacked positions), an upper tray 100 may slide along the bottles tops in a similar, lower tray to facilitate handling.

Figure 11:
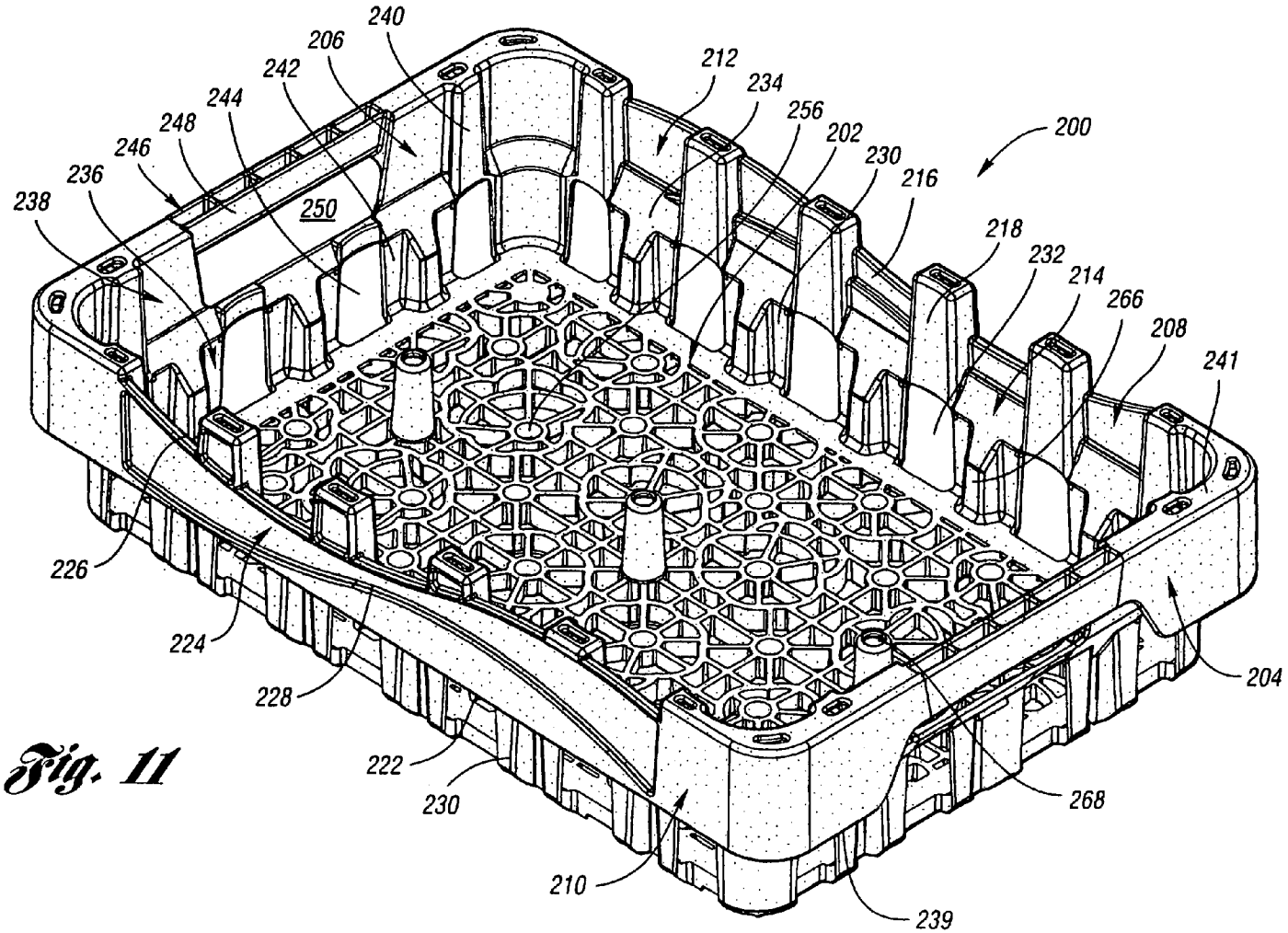
FIG. 11 is a perspective view of a second embodiment of a low depth nestable tray according to the present invention.
Figure 12:
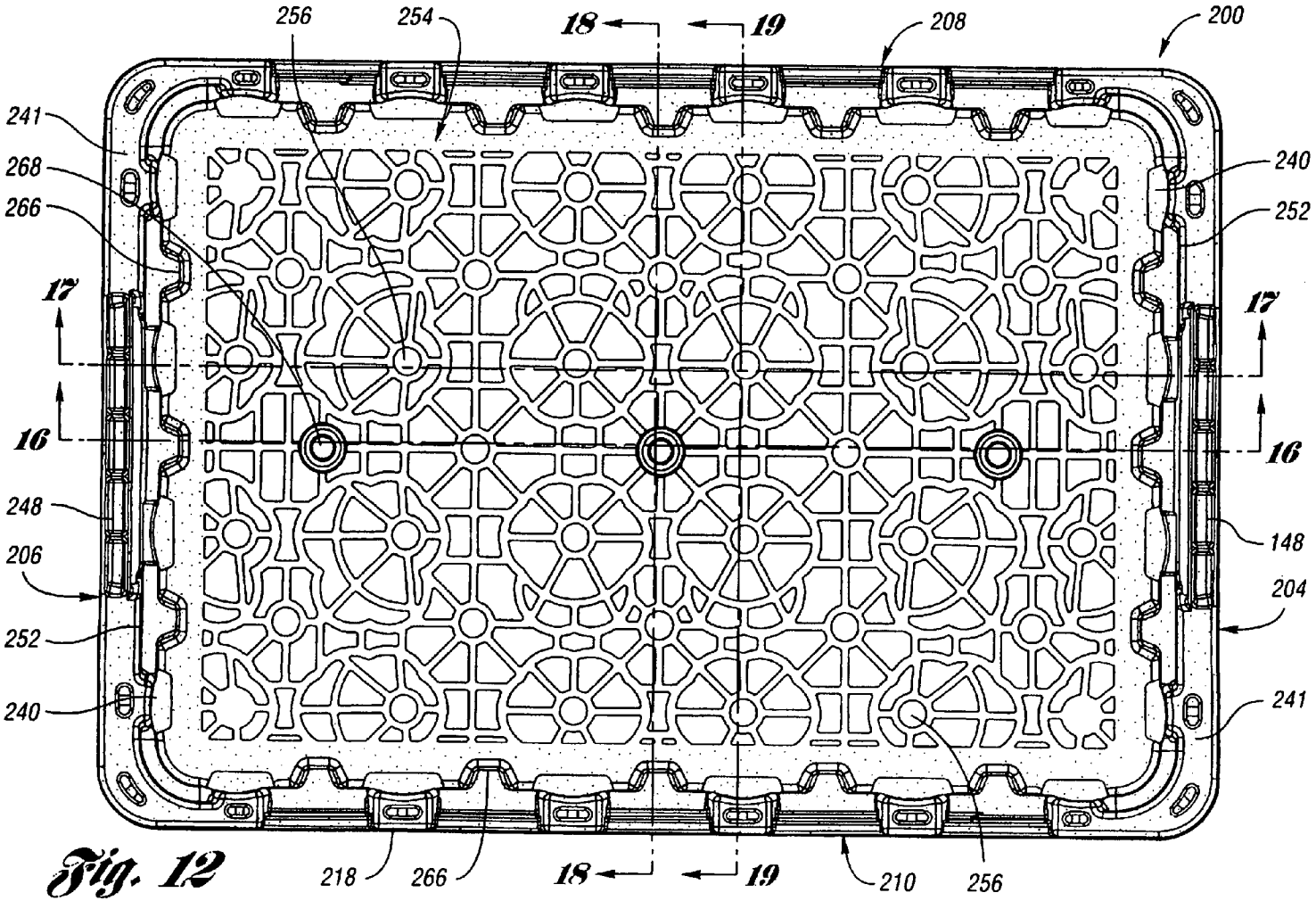
FIG. 12 is a top plan view of the tray of FIG. 11.
Figure 13:
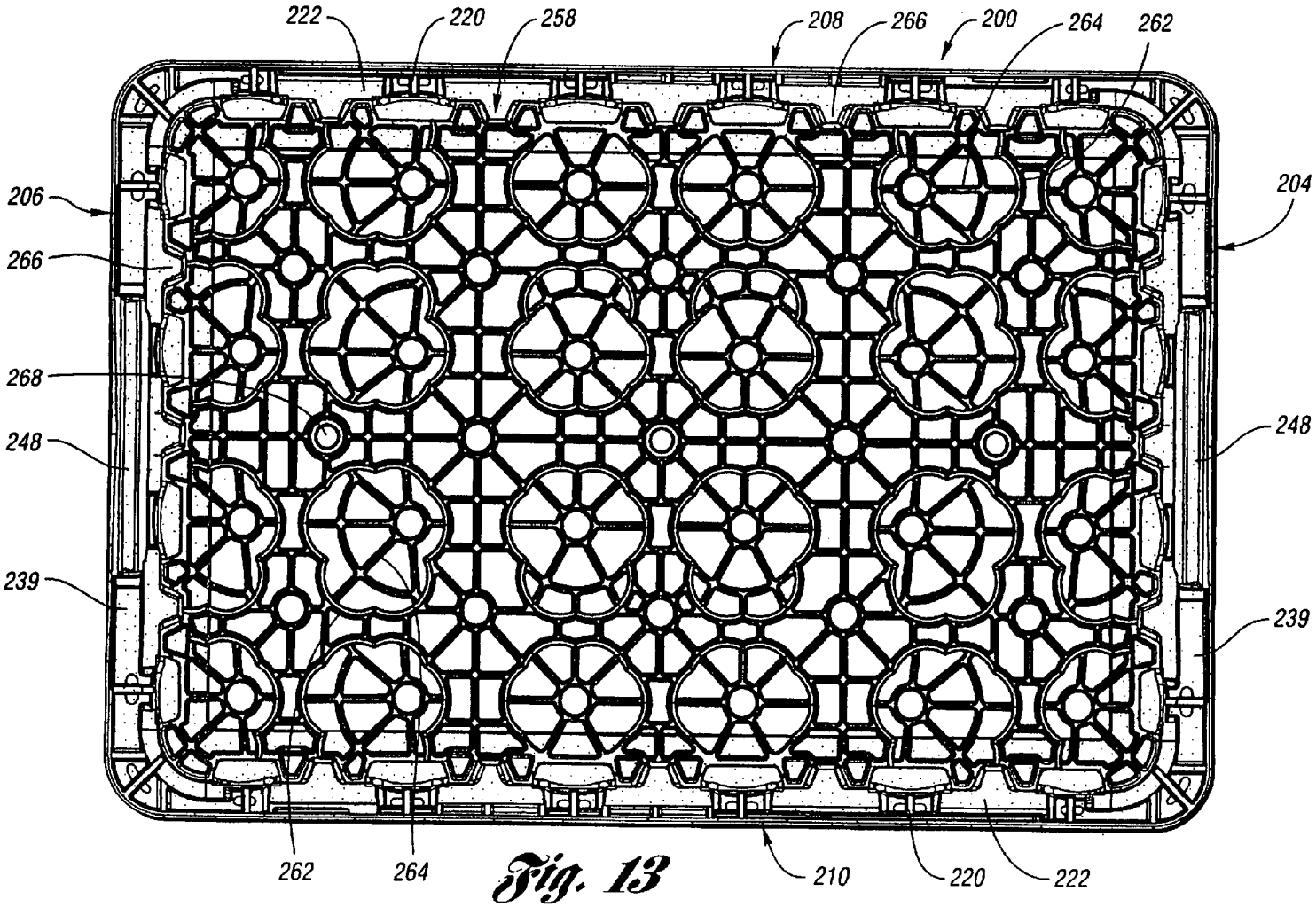
FIG. 13 is a bottom plan view of the tray of FIG. 11.
Figure 14:
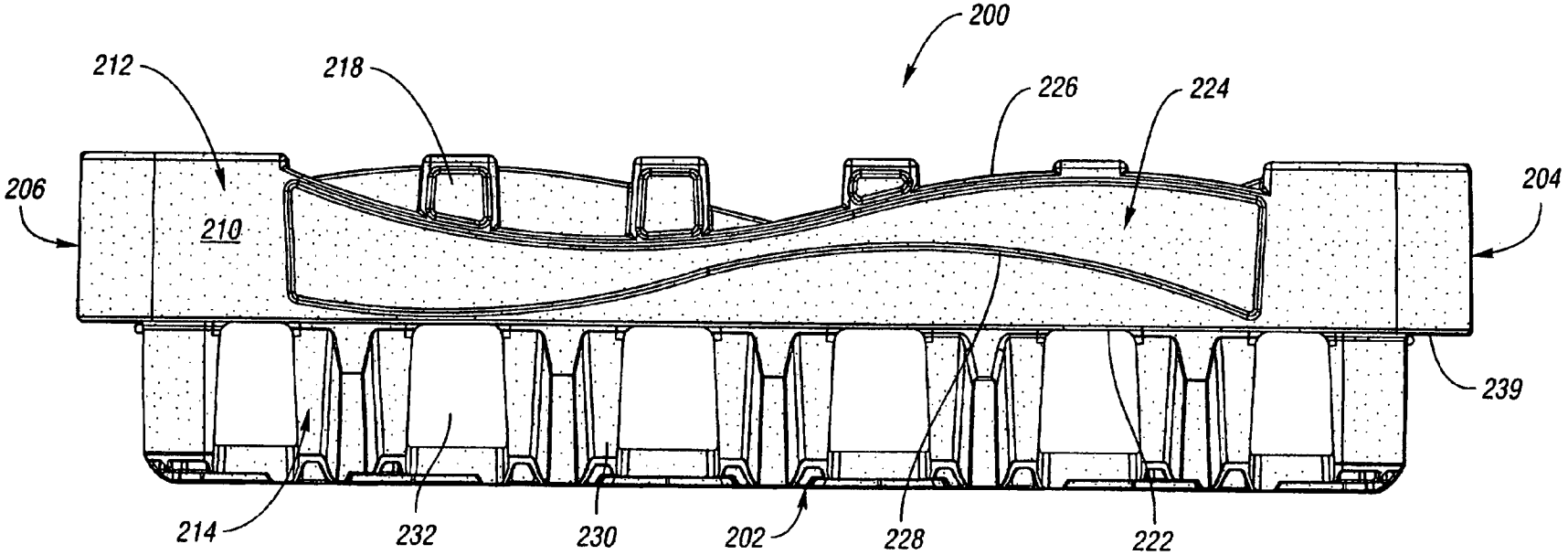
FIG. 14 is a front side elevational view of the tray of FIG. 11.
Figure 15:
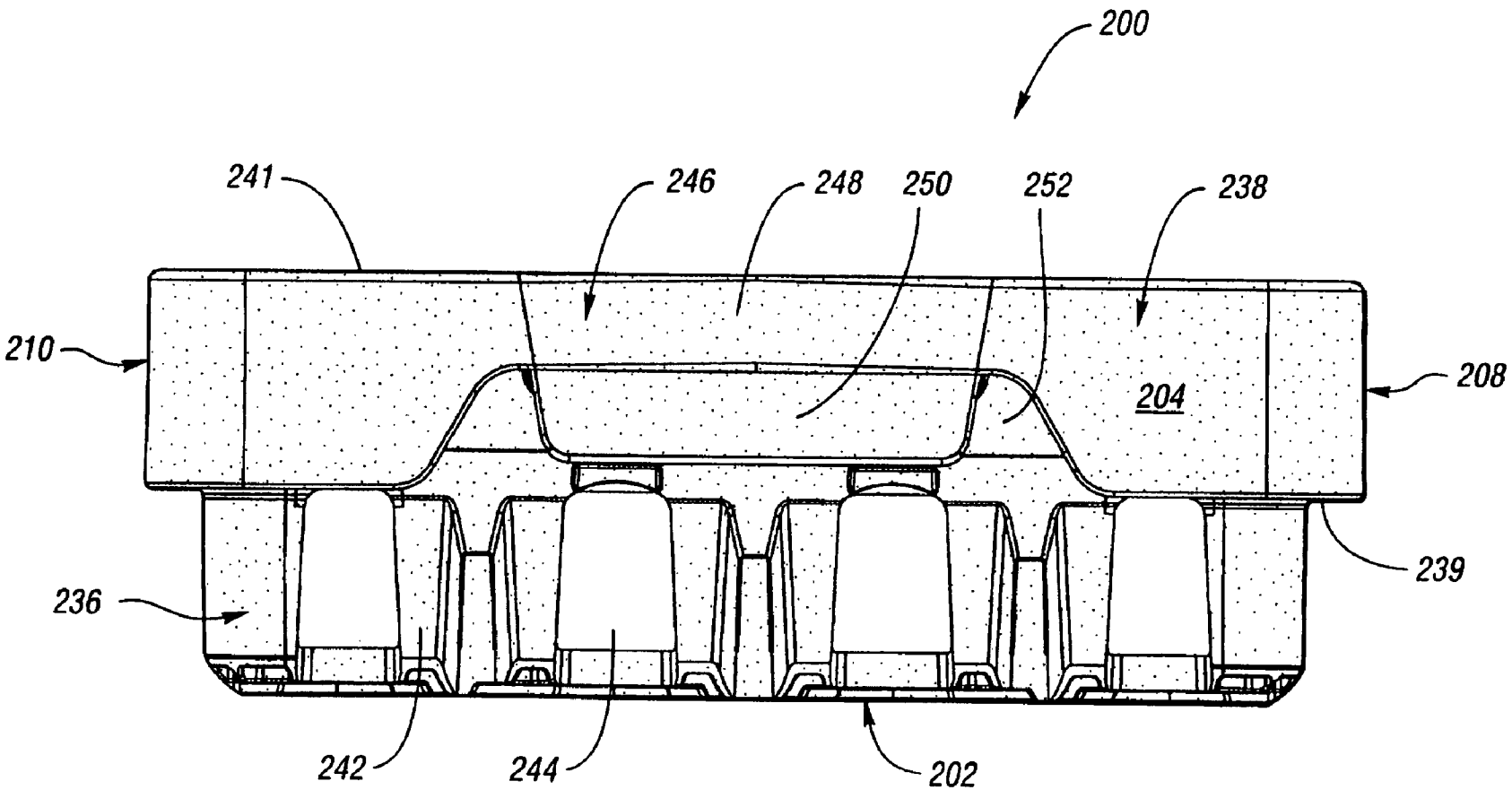
FIG. 15 is a right side elevational view of the tray of FIG. 11, the left side being a mirror image thereof.
Figure 16:
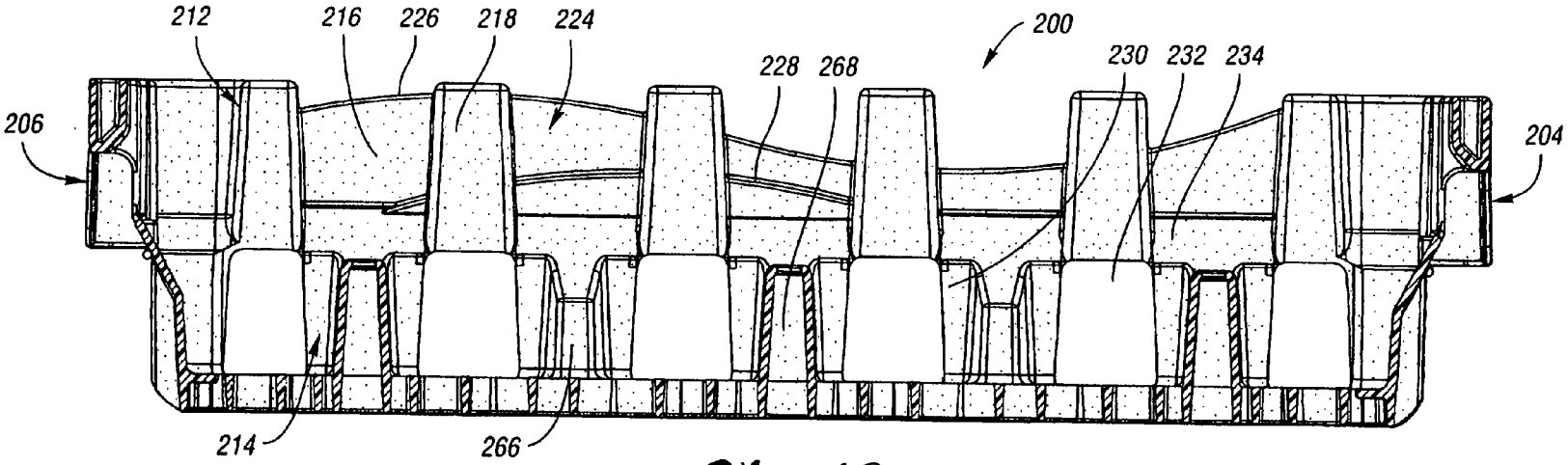
FIG. 16 is a cross-section of the tray taken along line 16—16 of FIG. 12.
Figure 17:
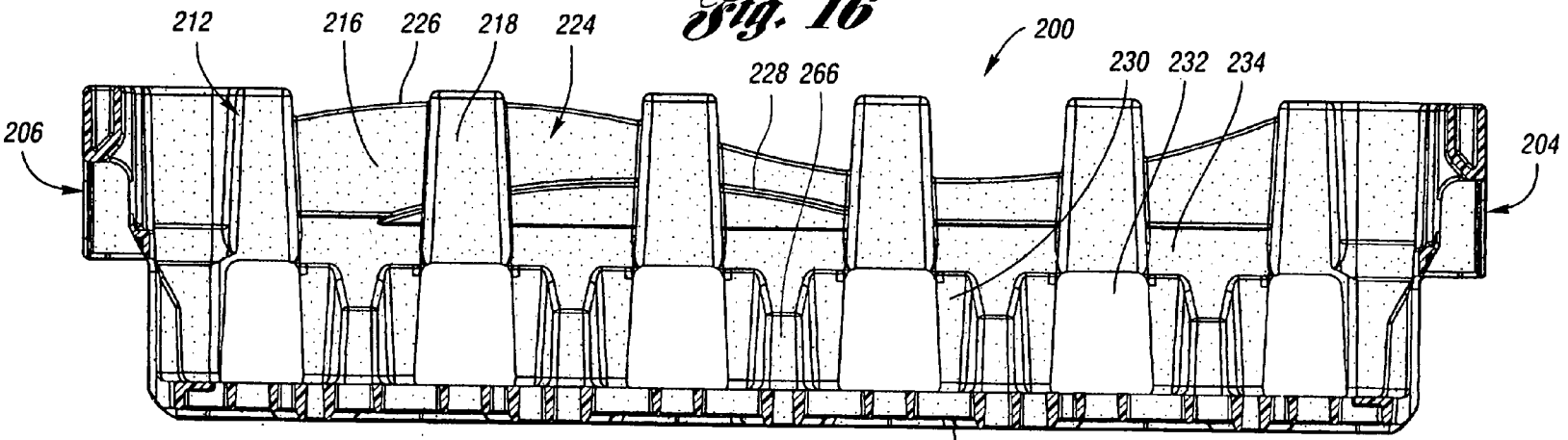
FIG. 17 is a cross-section of the tray taken along line 17—17 of FIG. 12.
Figure 18:
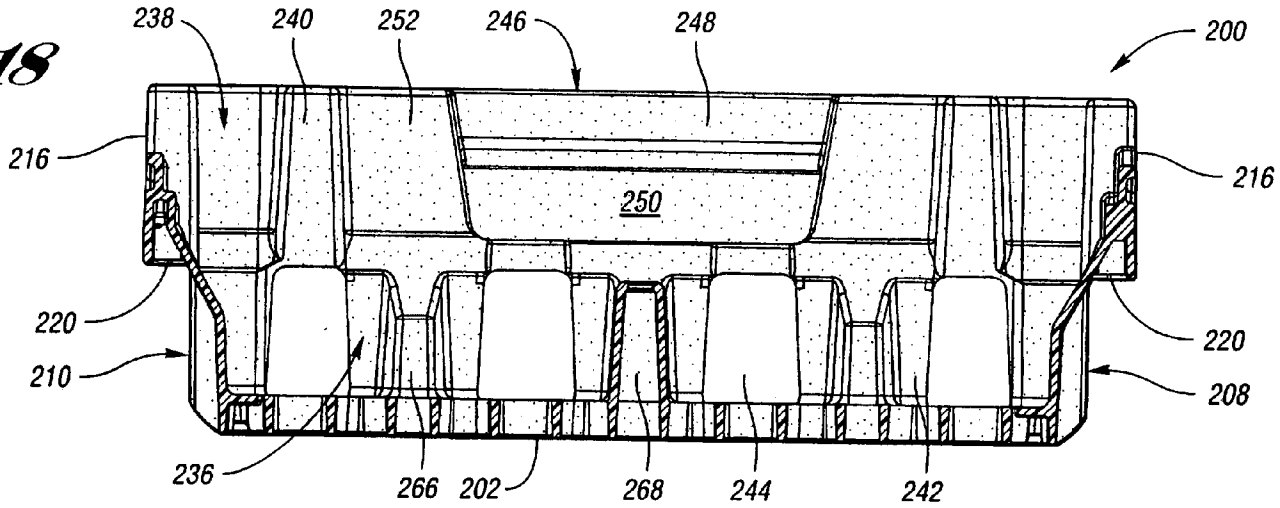
FIG. 18 is a cross-section of the tray taken along line 18—18 of FIG. 12.
Figure 19:
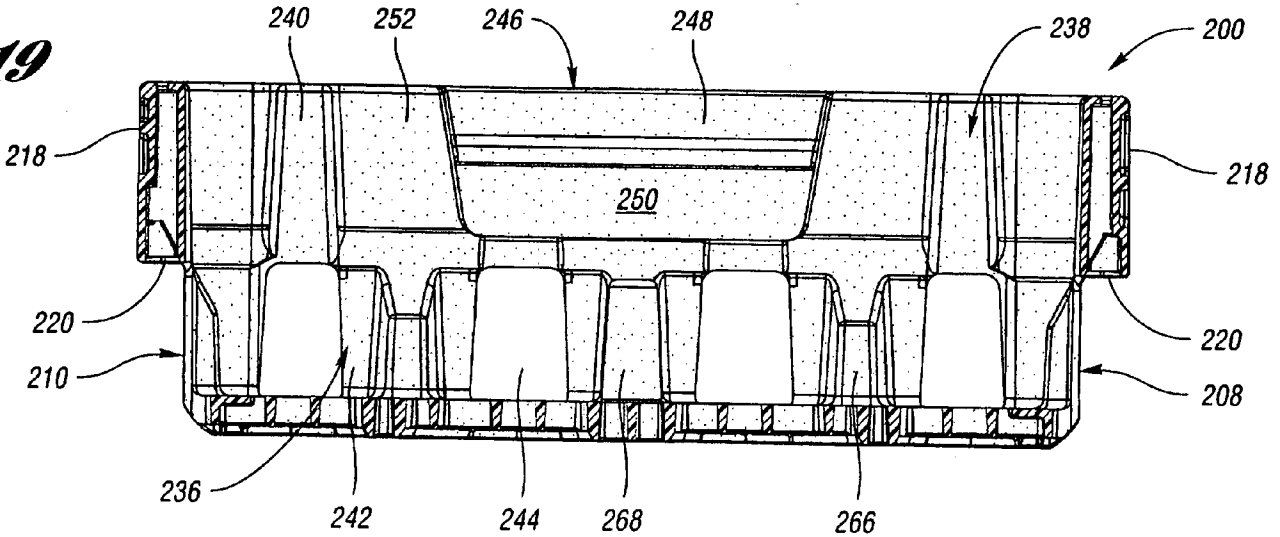
FIG. 19 is a cross-section of the tray taken along line 19—19 of FIG. 12.
Figure 20:
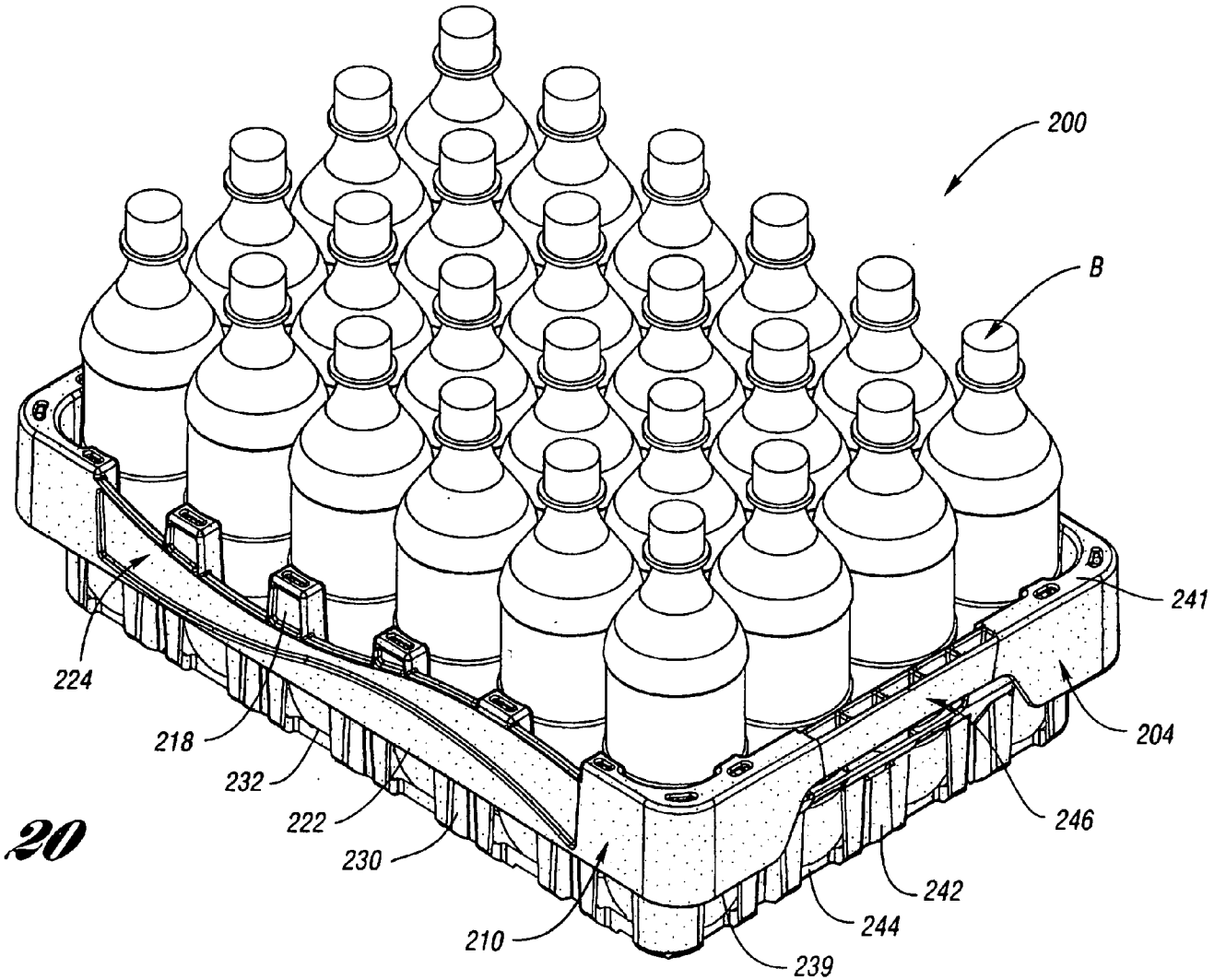
FIG. 20 is a perspective view of the tray of FIG. 11 shown filled with a 4×6 array of fluid containers.

Turning now to FIGS. 11–20, a second embodiment of the tray according to the present invention is illustrated. The reference numerals for FIGS. 11–20 correspond generally with the reference numerals for FIGS. 1–10 except for the change from a "1" to a "2" prefix. While similar in construction to tray 100, tray 200 includes several additional features. First; lower side wall panels 230 and lower end wall panels 242 of tray 200 are not substantially flat, but rather include inwardly extending protrusions 266 positioned to extend between and separate adjacent fluid containers loaded in tray 200. Protrusions 266 provide considerable additional strength for side walls 208, 210 and end walls 204, 206 and reduce wall warpage. Second, one or more members 268 are provided which extend upwardly from an interior portion of base 202. In particular, as best shown in FIGS. 11 and 12, each member 268 is preferably disposed between four adjacent fluid container support areas 256 as illustrated herein. Members 268 are generally cylindrical in shape and are of a height sufficient to support the bottles while not interfering with the nesting capability of trays 200, as shown in the cross-sectional view of FIGS. 16 and 18. By eliminating the flat surface of base 202, members 268 also help to prevent the use of tray 200 for other than its intended function of holding bottles B. Members 268 can also be used for providing additional lateral support to fluid containers loaded in tray 200. Lastly, in the embodiment of tray 200 shown in FIGS. 11–20, top bars 248 of handle portions 246 are generally coplanar with the upper edge of end walls 204, 206.

FIGS. 21–30 illustrate a third embodiment of the tray of the present invention, wherein reference numerals correspond to those of the first embodiment, except with a "3" prefix. Tray 300 is similar to tray 100 in many respects, however, tray 300 includes a different structure for upper side wall panels 316. More particularly, contour 324 of upper side wall panels 316 is scalloped in design. Advantageously, upper side wall panels 316 are still lower in height than side wall columns 318, allowing for enhanced display of bottles stored within tray 300 as well as a decrease in the weight of tray 300.

A fourth embodiment of the tray of the present invention is shown in FIGS. 31–40, wherein reference numerals correspond to those of the second embodiment except for the change to a "4" prefix. Tray 400 includes the scalloped contour 424 upper side panels 416 described above with reference to tray 300, as well as the lower side panel protrusions 466, members 468, and flush top bar 448 described with reference to tray 200.

A fifth embodiment of the tray of the present invention is shown in FIGS. 41–50, wherein reference numerals correspond to those of the fourth embodiment except for the change to a "5" prefix. Tray 500 is substantially similar in design to tray 400 but omit members 468.

Turning finally to FIGS. 51–60, a sixth embodiment of the tray of the present invention is depicted, wherein reference numerals correspond to those of the first embodiment except for the change to a "6" prefix. Tray 600 is similar to both tray 100 and tray 300 except for the structure of upper side wall panels 616. In this embodiment, upper side wall panels 616 are substantially equal in height to side wall columns 618, such that upper side wall panels 616 and side wall columns 618 define a continuous upper edge 670 of upper side wall portion 612.

Of course, it is understood that the features shown and described for any of these six embodiments of the low depth nestable tray of the present invention are interchangeable, such that trays incorporating features in combinations other than the particular embodiments discussed herein are fully contemplated.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A low depth tray for fluid containers, comprising:

a base;

a first pair of opposed walls extending upwardly from the base; and a second pair of opposed walls extending upwardly from the base and integrally joined with the first pair of opposed walls to form a storage area, each of the second pair of opposed walls including an upper wall portion and a lower wall portion, the upper wall portion including an alternating arrangement of first areas having a single-walled construction and second areas for contacting the fluid containers, the first areas having an outer surface co-planar with an outer surface of the second areas, wherein at least one of the first areas has an upper edge which is lower in height than an upper edge of the second areas and the first areas vary in height to form a non-symmetrical contour along the upper wall portion.

2. The tray according to claim 1, wherein the second areas have a double-walled construction.

3. The tray according to claim 1, wherein the first areas include upper wall panels, and the second areas include column portions.

4. The tray according to claim 1, wherein an interior surface of each second area is substantially flat.

5. The tray according to claim 1, wherein the second areas include portions extending into the storage area.

6. The tray according to claim 1, wherein the upper wall portion is slightly tapered in a downward direction.

7. The tray according to claim 1, wherein the lower wall portion includes an alternating arrangement of lower wall panels extending upwardly from the base and cutout portions.

8. The tray according to claim 7, wherein the lower wall panels have a single-walled construction.

9. The tray according to claim 7, wherein the upper wall portion includes a transition area immediately above the lower wall panels.

10. The tray according to claim 9, wherein the transition area has a double-walled construction.

11. The tray according to claim 1, wherein a top surface of the base is substantially flat.

12. The tray according to claim 1, wherein a bottom surface of the base has a plurality of receiving areas for receiving therein the tops of similar fluid containers in a layer in a similar tray beneath the base.

13. The tray according to claim 1, wherein each of the first pair of opposed walls includes a handle portion.

14. The tray according to claim 13, wherein the handle portion includes a top bar.

15. The tray according to claim 14, wherein the top bar protrudes above an upper edge of the first pair of opposed walls.

16. The tray according to claim 14, wherein the top bar includes at least one inwardly extending projection to provide lateral support to fluid containers loaded in the tray.

17. The tray according to claim 1, wherein the first pair of opposed walls include an upper wall portion having a double-walled construction, the upper wall portion including columns for providing lateral support to fluid containers loaded in the tray.

18. The tray according to claim 1, wherein the first pair of opposed walls include a lower wall portion having an alternating arrangement of lower wall panels extending upwardly from the base and cutout portions.

19. A low depth tray for fluid containers, comprising:

a base;

a pair of opposed end walls extending upwardly from the base; and a pair of opposed side walls extending upwardly from the base and integrally joined with the pair of opposed end walls to form a storage area, each of the pair of opposed side walls including a lower wall portion and an upper wall portion, the lower wall portion including an alternating arrangement of lower wall panels extending upwardly from the base and cutout portions, and the upper wall portion including an alternating arrangement of first areas having a single-walled construction and second areas for contacting the fluid containers, the first areas having an outer surface co-planar with an outer surface of the second areas, wherein at least one of the first areas has an upper edge which is lower in height than an upper edge of the second areas and the first areas vary in height to form a non-symmetrical contour confined to the upper wall portion, wherein the lower wall portion nests within the corresponding first areas of a tray disposed therebelow.

20. A low depth tray for fluid containers, comprising:

a base;

a first pair of opposed walls extending upwardly from the base; and a second pair of opposed walls extending upwardly from the base and integrally joined with the first pair of opposed walls to form a storage area, each of the second pair of opposed walls including an upper wall portion and a lower wall portion, the upper wall portion including an alternating arrangement of first areas having a single-walled construction and second areas for contacting the fluid containers, the first areas having an outer surface co-planar with an outer surface of the second areas, wherein at least one of the first areas has an upper edge which is lower in height than an upper edge of the second areas and the first areas vary in height to form a wavelike configuration along the upper wall portion, wherein the wavelike configuration along a first one of the second pair of opposed walls has an opposite orientation compared with the wavelike configuration along a second one of the second pair of opposed side walls.

21. The tray according to claim 20, wherein the second areas have a double-walled construction.

22. The tray according to claim 20, wherein the first areas include upper wall panels, and the second areas include column portions.

23. The tray according to claim 20, wherein the second areas include portions extending into the storage area.

24. The tray according to claim 20, wherein the lower wall portion includes an alternating arrangement of lower wall panels extending upwardly from the base and cutout portions.

25. The tray according to claim 24, wherein the lower wall panels have a single-walled construction.

26. The tray according to claim 24, wherein the upper wall portion includes a transition area immediately above the lower wall panels.

27. The tray according to claim 26, wherein the transition area has a double-walled construction.

28. The tray according to claim 20, wherein each of the first pair of opposed walls includes a handle portion.

29. The tray according to claim 20, wherein the first pair of opposed walls include an upper wall portion having a double-walled construction, the upper wall portion including columns for providing lateral support to fluid containers loaded in the tray, and a lower wall portion having an alternating arrangement of lower wall panels extending upwardly from the base and cutout portions.

* * * * *